US010236170B2

(12) United States Patent
Chiu et al.

(10) Patent No.: US 10,236,170 B2
(45) **Date of Patent: *Mar. 19, 2019**

(54) METHODS AND DEVICES FOR GENERATING DOUBLE EMULSIONS

(71) Applicant: University of Washington through its Center for Commercialization, Seattle, WA (US)

(72) Inventors: Daniel T. Chiu, Seattle, WA (US); Dingsheng Liu, Seattle, WA (US)

(73) Assignee: University of Washington through its Center for Commercialization, Seattle, WA (US)

( * ) Notice: Subject to any disclaimer, the term of this patent is extended or adjusted under 35 U.S.C. 154(b) by 31 days.

This patent is subject to a terminal disclaimer.

(21) Appl. No.: 15/454,558

(22) Filed: Mar. 9, 2017

(65) Prior Publication Data

US 2017/0250063 A1 Aug. 31, 2017

Related U.S. Application Data

(63) Continuation of application No. 14/891,620, filed as application No. PCT/US2014/040358 on May 30, 2014, now Pat. No. 9,997,344.

(Continued)

(51) Int. Cl.
*H01J 49/16* (2006.01)
*B05B 5/03* (2006.01)

(Continued)

(52) U.S. Cl.
CPC ..... *H01J 49/165* (2013.01); *B05B 5/025* (2013.01); *B05B 5/03* (2013.01); *H01J 49/0445* (2013.01)

(58) Field of Classification Search
CPC ..... H01J 49/165; B05B 5/03

(Continued)

(56) References Cited

U.S. PATENT DOCUMENTS 5,825,026 A 10/1998 Baykut
8,580,165 B2 11/2013 Noritomi et al.

(Continued)

FOREIGN PATENT DOCUMENTS

WO WO-2010148106 A1 12/2010
WO WO-2011023405 A1 3/2011

(Continued)

OTHER PUBLICATIONS

Abate et al., High-order multiple emulsions formed in poly(dimethylsiloxane) microfluidics. Small. Sep. 2009;5( 18):2030-2.

(Continued)

*Primary Examiner* — Nicole Ippolito
(74) *Attorney, Agent, or Firm* — Wilson Sonsini Goodrich & Rosati

(57) ABSTRACT

The present disclosure describes devices and methods capable of generating multi¬phase emulsions, including double emulsion droplets in a gas phase. The present disclosure also describes interfaces for coupling a multi-phase emulsion droplet source to an analytical instrument such as a mass spectrometer. The present disclosure further describes methods, systems, and apparatuses for using the devices and interfaces described to perform analysis, including mass spectrometry. The present disclosure also describes methods, systems, and apparatuses for generating and using multi-phase emulsions to perform analysis.

15 Claims, 19 Drawing Sheets

Related U.S. Application Data

(60) Provisional application No. 61/829,586, filed on May 31, 2013.

(51) Int. Cl.
*H01J 49/04* (2006.01)
*B05B 5/025* (2006.01)

(58) Field of Classification Search
USPC ..... 250/281, 282, 288
See application file for complete search history.

(56) References Cited

U.S. PATENT DOCUMENTS

| | | | | |
|---|---|---|---|---|
| 9,997,344 | B2 * | 6/2018 | Chiu | H01J 49/0445 |
| 2003/0015425 | A1 | 1/2003 | Bohm et al. | |
| 2009/0012187 | A1 | 1/2009 | Chu et al. | |
| 2011/0083964 | A1 | 4/2011 | Ulmanella | |
| 2011/0189298 | A1 | 8/2011 | Vos et al. | |
| 2012/0174650 | A1 | 7/2012 | Ariessohn et al. | |
| 2012/0199732 | A1 | 8/2012 | Chetwani et al. | |
| 2012/0309002 | A1 | 12/2012 | Link | |
| 2013/0187040 | A1 | 7/2013 | Abell et al. | |
| 2013/0277461 | A1 | 10/2013 | Ripoll et al. | |
| 2014/0051180 | A1 | 2/2014 | Cooks et al. | |
| 2016/0086785 | A1 * | 3/2016 | Chiu | H01J 49/0445 250/282 |

FOREIGN PATENT DOCUMENTS

| | | | |
|---|---|---|---|
| WO | WO-2012001421 | A1 | 1/2012 |
| WO | WO-2013119753 | A1 | 8/2013 |
| WO | WO-2014194272 | A2 | 12/2014 |
| WO | WO-2014194272 | A3 | 3/2015 |

OTHER PUBLICATIONS

Amantonico, et al. Single-cell MALDI-MS as an analytical tool for studying intrapopulation metabolic heterogeneity of unicellular organisms. Anal Chem. Sep. 1, 2010;82(17):7394-400. doi: 10.1021/ac1015326.

Anna, S.L., et al., Formation of dispersions using flow focusing in microchannels, Applied Physics Letters, vol. 82, No. 3, pp. 364-366 (2003).

Bai, et al. A double droplet trap system for studying mass transport across a droplet-droplet interface. Lab Chip. May 21, 2010;10(10):1284-5. doi: 10.1039/b925133b. Epub Feb. 16, 2010.

Bauer, et al. Hydrophilic PDMS microchannels for high-throughput formation of oil-in-water microdroplets and water-in-oil-in-water double emulsions. Lab Chip. Jul. 21, 2010;10(14):1814-9. doi: 10.1039/c004046k. Epub May 5, 2010.

Chiu, et al. Chemistry and biology in femtoliter and picoliter volume droplets. Acc Chem Res. May 19, 2009;42(5):649-58. doi: 10.1021/ar8002464.

Chiu, et al. Droplets for ultrasmall-volume analysis. Anal Chem. Jul. 1, 2009;81(13):5111-8. doi: 10.1021/ac900306q.

Chiu. Interfacing droplet microfluidics with chemical separation for cellular analysis. Anal Bioanal Chem. Aug. 2010;397(8):3179-83. doi: 10.1007/s00216-010-3686-8. Epub Apr. 11, 2010.

Courtois, et al. An integrated device for monitoring time-dependent in vitro expression from single genes in picolitre droplets. Chembiochem. Feb. 15, 2008;9(3):439-46. doi: 10.1002/cbic.200700536.

Dada, et al. Simplified Sheath Flow Cuvette Design for Ultrasensitive Laser Induced Fluorescence Detection in Capillary Electrophoresis. Analyst. Jul. 7, 2012; 137(13): 3099-3101.

Dahlin, et al. Capillary electrophoresis coupled to mass spectrometry from a polymer modified poly(dimethylsiloxane) microchip with an integrated graphite electrospray tip. Analyst. Feb. 2005;130(2):193-9. Epub Jan. 6, 2005.

Edris, A., et al., Encapsulation of orange oil in a spray dried double emulsion, Nahrung/Food, vol. 45, No. 2, pp. 133-137 (2001).

Engel, et al. Insulin: intestinal absorption as water-in-oil-in-water emulsions. Nature. Aug. 24, 1968;219(5156):856-7.

Fernandez De La Mora, et al. The effect of charge emission from electrified liquid cones. J. Fluid Mech. 1994; 243:561-574.

Ganan-Calvo, A., Generation of Steady Liquid Microthreads and MicronSized Monodisperse Sprays in Gas Streams, Physical Review Letters, vol. 80, No. 2 (1998).

Ganan-Calvo, A.M., Perfectly Monodisperse Microbubbling by Capillary Flow Focusing, Physical Review Letters, vol. 87, No. 27, pp. 274501-1 to 274501-4 (2001).

Gu, et al. Droplets formation and merging in two-phase flow microfluidics. Int J Mol Sci. 2011;12(4):2572-97. doi: 10.3390/ijms12042572. Epub Apr. 15, 2011.

He, et al. The effect of electric field on droplet formation and motion in a viscous liquid. Can. J. Chem. Eng. 1991; 69:1174-1183.

Hiraoka, et al. High[flow liquid chromatography/mass spectrometry interface using a parallel ion spray. Mass Spectrom. 1995; 9:1349-1355.

Huebner, et al. Microdroplets: a sea of applications? Lab Chip. Aug. 2008;8(8):1244-54. doi: 10.1039/b806405a. Epub Jun. 24, 2008.

International preliminary report on patentability dated Dec. 10, 2015 for PCT Application No. US2014/040358.

International search report and written opinion dated Jan. 13, 2015 for PCT Application No. US2014/040358.

Issadore, et al. Microwave dielectric heating of drops in microfluidic devices. Lab Chip. Jun. 21, 2009;9(12):1701-6. doi: 10.1039/b822357b. Epub Mar. 19, 2009.

Kebarle, et al. In Electrospray Ionization Mass Spectrometry, Fundamentals, Instrumentation and Applications, (Ed: R.B. Cole), Wiley: New York, 1997, Chapter 1, pp. 3-63.

Kelly, et al. Dilution-free analysis from picoliter droplets by nano-electrospray ionization mass spectrometry. Angew Chem Int Ed Engl. 2009;48(37):6832-5. doi: 10.1002/anie.200902501.

Kelly, et al. Elastomeric microchip electrospray emitter for stable cone-jet mode operation in the nanoflow regime. Anal Chem. May 15, 2008;80(10):3824-31. doi: 10.1021/ac8000786. Epub Apr. 18, 2008.

Kim, et al. Electrohydrodynamic generation and delivery of monodisperse picoliter droplets using a poly(dimethylsiloxane) microchip. Anal Chem. Dec. 1, 2006;78(23):8011-9.

Kim, et al. Microfabricated PDMS multichannel emitter for electrospray ionization mass spectrometry. J Am Soc Mass Spectrom. Apr. 2001;12(4):463-9.

Lee, M.H., et al., Preparation of Silica Particles Encapsulating Retinol Using O/W/O Multiple Emulsions, Journal of Colloid and Interface Science, vol. 240, pp. 83-89 (2001).

Lee. Microdrop generation, CRC Press, 2003.

Liu, et al. Controlled generation of double emulsions in air. Anal Chem. Jul. 2, 2013;85(13):6190-4. doi: 10.1021/ac400844p. Epub Jun. 14, 2013.

Liu, et al. Gas-Liquid Mass Transfer in Taylor Flow through Circular Capillaries. Ind. Eng. Chem. Res. 2011; 50(4):2323-2330.

Liu, et al. Hydrodynamics of Taylor flow in noncircular capillaries. Chem. Eng. Proc. 200; 47(12):2098-2106.

Liu, et al. Hydrogenation of 2-ethylanthraquinone under Taylor flow in single square channel monolith reactors. AlChE Journal. 2009; 55:726-736.

Loscertales, I.G., et al., Micro/Nano Encapsulation via Electrified Coaxial Liquid Jets, Science, vol. 295, pp. 1695-1698 (2002).

McDonald, et al. Fabrication of microfluidic systems in poly(dimethylsiloxane). Electrophoresis. 2000; 21:27-40.

Nie, et al. Sampling from nanoliter plugs via asymmetrical splitting of segmented flow. Anal Chem. Sep. 15, 2010;82(18):7852-6. doi: 10.1021/ac101723x.

Notice of allowance dated Nov. 21, 2016 for U.S. Appl. No. 14/891,620.

Okushima, S., et al,. Controlled Production of Monodisperse Double Emulsions by Two-Step Droplet Breakup in Microfluidic Devices, Langmuir, vol. 20, pp. 9905-9908 (2004).

Pei, et al. Rapid and label-free screening of enzyme inhibitors using segmented flow electrospray ionization mass spectrometry. J Am Soc Mass Spectrom. Jul. 2010;21(7):1107-13. doi: 10.1016/j.jasms.2010.02.013. Epub Feb. 10, 2010.

(56) References Cited

OTHER PUBLICATIONS

Song, et al. A microfluidic system for controlling reaction networks in time. Angew Chem Int Ed Engl. Feb. 17, 2003;42(7):767-772.
Song, et al. On-chip titration of an anticoagulant argatroban and determination of the clotting time within whole blood or plasma using a plug-based microfluidic system. Anal Chem. Jul. 15, 2006;78(14):4839-49.
Song, et al. Reactions in droplets in microfluidic channels. Angew Chem Int Ed Engl. Nov. 13, 2006;45(44):7336-56.
Sun, et al. Ultrasensitive nanoelectrospray ionization-mass spectrometry using poly(dimethylsiloxane) microchips with monolithically integrated emitters. Analyst. Sep. 2010;135(9):2296-302. doi: 10.1039/c0an00253d. Epub Jul. 9, 2010.
Svedberg, et al. Poly(dimethylsiloxane) microchip: microchannel with integrated open electrospray tip. Lab Chip. Aug. 2004;4(4):322-7. Epub May 14, 2004.
Tang, et al. Dependence of ion intensity in electrospray mass spectrometry on the concentration of the analytes in the electrosprayed solution. Anal. Chem. 1993; 65(24):3654-3668.
Theberge, et al. Microdroplets in microfluidics: an evolving platform for discoveries in chemistry and biology. Angew Chem Int Ed Engl. Aug. 9, 2010;49(34):5846-68. doi: 10.1002/anie.200906653.
Thorsen, et al. Dynamic pattern formation in a vesicle-generating microfluidic device. Physical Review Letters. American Physical Society. 2001; 86(18):4163-4166.
Urban, et al. High-density micro-arrays for mass spectrometry. Lab Chip. Dec. 7, 2010;10(23):3206-9. doi: 10.1039/c0lc00211a. Epub Oct. 11, 2010.
Utada, A.'S., et al., Monodisperse Double Emulsions Generated from a Microcapillary Device, Science, vol. 308, pp. 537-541 (2005).
Volny, et al. High efficiency in soft landing of biomolecular ions on a plasma-treated metal surface: are double-digit yields possible? J Mass Spectrom. Jan. 2006;41(1):124-6.
Volny, et al. Nanoliter segmented-flow sampling mass spectrometry with online compartmentalization. Anal Chem. Apr. 1, 2014;86(7):3647-52. doi: 10.1021/ac500365r. Epub Mar. 21, 2014.
Whitesides. The origins and the future of microfluidics. Nature. Jul. 27, 2006;442(7101):368-73.
Yamashita, et al. Electrospray ion source. Another variation on the free-jet theme. J. Phys. Chem. 1984; 88:4451-4459.
Yamashita, et al. Negative ion production with the electrospray ion source. J. Phys. Chem. 1984; 88:4671-4675.
Yen, et al. A rapid and economical method for profiling feature heights during microfabrication. Lab Chip. Mar. 7, 2011;11(5):974-7. doi: 10.1039/c0lc00470g. Epub Jan. 13, 2011.
U.S. Appl. No. 14/891,620 Corrected Notice of Allowability dated May 7, 2018.

* cited by examiner t=0 ms t=32 ms t=97 ms t=129 ms t=226 ms t=259 ms

METHODS AND DEVICES FOR GENERATING DOUBLE EMULSIONS

This application is a Continuation Application of U.S. application Ser. No. 14/891,620, filed Nov. 16, 2015, now U.S. Pat. No. 9,997,344, issued Jun. 12, 2018, which is a U.S. National Phase Application under 35 U.S.C. § 371 of International Application No. PCT/US2014/040358, filed May 30, 2014, which claims the benefit of U.S. Provisional Application No. 61/829,586, filed May 31, 2013, which application is incorporated herein by reference in its entirety for all purposes.

STATEMENT AS TO FEDERALLY SPONSORED RESEARCH

This invention was made with U.S. Government support under RO1GM094905, awarded by the National Institutes of Health. The U.S. Government has certain rights in the invention.

BACKGROUND OF THE INVENTION

Droplet microfluidics has shown promise in recent years in a range of chemical and biological applications (Whitesides, G. M. Nature 2006, 442, 368-373; Song, H.; Chen, D. L.; Ismagilov, R. F. Angew. Chem. Int. Ed. 2006, 45, 7336-7356; Huebner, A.; Sharma, S.; Srisa-art, M.; Hollfelder, F.; Edel, J. B.; Demello, A. J. Lab chip 2008, 8, 1244-1254; Liu, D.; Wang, S. Chem. Eng. Proc. 2008, 47, 2098-2106; Liu, D.; Zhang, J.; Li, D.; Kong, Q.; Zhang, T.; Wang, S. AIChE J. 2009, 55, 726-736; Chiu, D. T.; Lorenz, R. M. Acc. Chem. Res. 2009, 42, 649-658; Therberge, A. B.; Courtois, F.; Schaerli, Y.; Fischlechner, M.; Abell, C.; Hollfelder, F.; Huck, W. T. S. Angew. Chem. Int. Ed. 2010, 49, 5846-5868; Bai, Y.; He, X.; Liu, D.; Patil, S. N.; Bratton, D.; Huebner, A.; Hollfelder, F.; Abell, C.; Huck, W. T. S. Lab Chip 2010, 10, 1281-1285; Chiu, D. T. Anal. Bioanal. Chem. 2010, 397, 3179-3183; Liu, D.; Wang, S. Ind. Eng. Chem. Res. 2011, 50, 2323-2330; Anna, S. L.; Bontoux, N.; Stone, H. A.; Appl. Phys. Lett. 2003, 82, 364-366; Thorsen, T.; Roberts, R. W.; Arnold, F. H.; Quake, S. R. Phys. Rev. Lett. 2001, 86, 4163-4166). A small sub-area of droplet microfluidics has been focused on the formation of double emulsions, which are droplets of dispersed phase containing even smaller droplets within. Double emulsions are found in diverse areas, from food, cosmetics, to pharmaceutics (Edris, A.; Bergnstahl, B. Food/Nahrung. 2001, 45, 133-137; Engel, R. H.; Riggi, S. J.; Fahrenbach, M. J. Nature 1968, 219, 856-857; Lee, M.; Oh, S.; Moon, S.; Bae, S. J. Colloid Interface Sci. 2001, 240, 83-89).

Microfluidics approaches have been devised for producing double emulsions in the condensed phase (Abate, A. R.; Weitz, D. A. Small 2009, 5, 2030-2032; Utada, A. S.; Lorenceau, E.; Link, D. R.; Kaplan, P. D.; Stone, H. A.; Weitz, D. A. Science 2005, 308, 537-541; Okushina, S.; Nisisako, T.; Torii, T.; Higuchi, T. Langmuir 2004, 20, 9905-9908; Bauer, W. C.; Fischlechner, M.; Abell, C.; Huck, W. T. S. Lab chip 2010, 10, 1814-1819), however, a variety of applications for the use of double emulsions remain unexplored. For example, there is a need to introduce double emulsions and other droplets into analytical instruments, such as gas chromatographs.

SUMMARY OF THE INVENTION

In various aspects, the present disclosure provides a device for producing a droplet, the device comprising: a first fluidic channel, having a proximal end and a distal end, in fluidic communication with a first liquid and in electrical communication with a first electrode, wherein the proximal end of the first fluidic channel is connected to the first electrode; a second fluidic channel in fluidic communication with a second liquid, wherein the second liquid is immiscible with the first liquid, and wherein the second fluidic channel is in fluidic communication with the first fluidic channel; a droplet emitter, having a proximal end and a distal end, wherein the proximal end of the droplet emitter is in fluidic communication with the distal end of the first fluidic channel and the distal end of the droplet emitter is contacted with a gas; a second electrode comprising an opening configured to allow the passage of a droplet emitted from the droplet emitter; and a voltage source in electrical communication with the first electrode, the second electrode, or a combination thereof, wherein the voltage source is sufficient to generate a droplet emitted from the droplet emitter, thereby forming a double emulsion.

In various aspects, the present disclosure provides an interface for coupling a droplet source to an analytical instrument, the interface comprising: an outer surface, having a proximal end and a distal end, providing a substantially enclosed inner space; an inlet to the substantially enclosed inner space, the inlet disposed on the proximal end of the outer surface; an electrostatic lens disposed within the substantially enclosed inner space and between the proximal end and distal end of the outer surface; a vacuum port in the outer surface configured to connect to a vacuum source; and an aperture disposed on the distal end of the outer surface, wherein the interface is configured to allow the passage of a droplet comprising an analyte through the inlet and into the substantially enclosed inner space, and wherein the interface is configured to allow the analyte to pass through the electrostatic lens and into the analytical instrument.

In various aspects, the present disclosure provides a mass spectrometry system comprising: a microfluidic device configured to generate a droplet, wherein the droplet comprises a double emulsion and an analyte; an interface configured to receive the droplet from the microfluidic device; and a mass spectrometer configured to receive the analyte from the interface, In various aspects, the present disclosure provides a method for producing a droplet, the method comprising: generating an electric field between a first electrode and a second electrode, wherein the first electrode is in electrical communication with a first fluidic channel and wherein the second electrode is contacted with a gas; flowing a first liquid through the first fluidic channel; flowing a second liquid through a second fluidic channel, wherein the second liquid is immiscible with the first liquid, and wherein the second fluidic channel is in fluidic communication with the first fluidic channel; contacting the first fluid with the second fluid at the junction of the first channel and the second channel; generating a discrete partition of the first liquid surrounded at least in part by the second liquid; flowing the discrete partition through a droplet emitter, the droplet emitter comprising a proximal end and a distal end, wherein the proximal end is in fluidic communication with the first channel and the distal end is contacted with the gas; and producing a droplet from the distal end of the droplet emitter, wherein the droplet is contacted with the gas, and wherein the droplet and gas together comprise a double emulsion, In various aspects, the present disclosure provides a method for performing mass spectrometry, the method comprising: contacting a first liquid comprising an analyte with a second liquid, wherein the second liquid is immiscible with the first liquid; generating a discrete partition of the first liquid surrounded at least in part by the second liquid; applying an electric force to the discrete partition, thereby producing a droplet comprising a double emulsion and the analyte; evaporating the first liquid of the droplet, the second liquid of the droplet, or a combination thereof; ionizing the analyte; transporting the analyte to a mass spectrometer; and obtaining the mass spectrum of the analyte, the ion mobility spectrum of the analyte, or a combination thereof.

In various aspects, the present disclosure provides a method for performing mass spectrometry, the method comprising: flowing a first liquid through a fluidic channel, the liquid comprising an analyte; flowing the first liquid through a droplet emitter, the droplet emitter comprising a proximal end and a distal end, wherein the proximal end is in fluidic communication with the channel and the distal end is contacted with a gas; applying an electric force to the first liquid, thereby producing a droplet comprising the liquid and the analyte; ionizing the analyte; transporting the analyte to a mass spectrometer; and obtaining the mass spectrum of the analyte, the ion mobility spectrum of the analyte, or a combination thereof.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

FIGS. 4A and 4D used an aqueous flow rate of 0.2 μL/min, an oil flow rate of 0.2 μL/min, an applied voltage of 1.10 kV; FIGS. 4B and 4E used an aqueous flow rate of 0.12 μL/min, an oil flow rate of 0.12 μL/min, an applied voltage of 1.01 kV; FIGS. 4C and 4F used an aqueous flow rate of 0.06 μL/min, an oil flow rate of 0.06 μL/min, and an applied voltage of 1.01 kV.

FIG. 9A shows a 120-second data acquisition, FIG. 9B shows a 60-second data acquisition, and FIG. 9C shows a 30-second data acquisition.

FIG. 14 shows a comparison with the spectra obtained by summing several plugs.

FIG. 15A shows the overall spectrum. FIG. 15B shows a spectrum zoomed on the lower m/z region of the spectrum in the main figure, while the inset shows a zoom on the glycerophospolipid region of the spectrum.

FIG. 15B shows the fatty acids.

FIG. 17A shows the sum of the spectra of several plugs. FIG. 17B shows a spectrum of a single plug.

DETAILED DESCRIPTION OF THE INVENTION

Figure 1C:
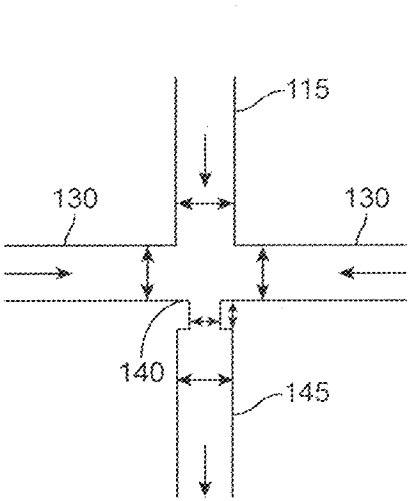
FIG. 1C shows a schematic of the flow focusing geometry.

The present invention is based in part on the surprising discovery by the inventors that using the present devices and methods, droplets comprising double emulsions can be formed in air and further that those droplets can be introduced into analytical instruments, e.g., mass spectrometers. According to some aspects of the present disclosure, the rate at which double emulsions are generated is controllable so the microfluidic sampling rate matches the duty cycle of a mass spectrometer. According to certain aspects, the droplets produced according to the present disclosure do not wet the surface of the droplet emitter from which they are introduced into the gas phase.

Compared with the generation of double emulsions in the condensed phase, formation of double emulsions in air is more challenging because gas has a much lower viscosity, which in turn necessitates high gas flow rates to generate enough shear stress to form the droplet in air. For example, one method is based on flow focusing using two concentric tubes, (Ganan-Calvo, A. M. Phys. Rev. Lett. 1998, 80, 285-288; Ganan-Calvo, A. M.; Gordillo, J. M. Phys. Rev. Lett. 2001, 87, 274501) where the inner tube and the outer tube contain aqueous solution and oil flowing toward the nozzle, respectively. According to this method, a high pressure gas stream is forced to flow through the outer tube to shear off the oil phase into droplets, containing smaller aqueous droplets inside, in the gas phase. The speed at which the droplets are generated using this method is too high for interfacing with mass spectrometry and the process is too uncontrollable.

The introduction of solutions into mass spectrometers (MS) has been used since the advent of electrospray ionization (ESI) (M. Yamashita, J. B. Fenn, J. Phys. Chem. 1984, 88, 4451-4459; M. Yamashita, J. B. Fenn, J. Phys. Chem. 1984, 88, 4671-4675). The homogeneous nature of solutions and the linear flow regime provide a constant delivery of analytes dissolved in the solvent, which is essential for quantitative analysis. The concentration dependence of the electrospray ion signal (see e.g., J. Fernandez de la Mora, I. G. Locertales, J. Fluid Mech. 1994, 243, 561-574; P. Kebarle, Y. Ho, in Electrospray Ionization Mass Spectrometry, Fundamentals, Instrumentation and Applications, (Ed: R. B. Cole), Wiley: New York, 1997, Chapter 1, pp. 3-63; L. Tang, P. Kebarle, Anal. Chem. 1993, 65, 3654-3668) becomes a limiting factor when the sample is originally confined to a small volume, such as that of a single cell. For example, dissolving the content of a single cell, ranging from $10^{-13}$ to $10^{-12}$ L in volume, in a solvent volume of $10^{-6}$ L and subsequent introduction into the mass spectrometer by nanospray ionization results in a $10^6$- to $10^7$-fold dilution of the cell components, e.g., from micromolar to picomolar. Such concentrations are not only at the limit of detection for methods using electrospraying, but also handling such highly diluted solutions is prone to contamination by other exogenous components obscuring or suppressing the analyte signal. These issues have been recognized for other concentration-dependent analytical methods, e.g., fluorescence spectroscopy and several approaches have been developed to overcome the dilution problem (O. O. Dada, B. J. Huge, N. J. Dovichi, Analyst 2012, 137, 3099-3101; A. Amantonico, P. L. Urban, S. R. Fagerer, R. M. Balabin, R. Zenobi, Anal. Chem. 2010, 82, 7394-7400). One approach relies on compartmentalization of the analyte solution into small volume droplets that are separated by an immiscible liquid in a channel of a microfluidic device (H. Song, J. D. Tice, R. F. Ismagilov, Angew. Chem., Int. Ed. 2003, 42, 768-772; H. Song, D. L. Chen, R. F. Ismagilov, Angew. Chem., Int. Ed. 2006, 45, 7336-7340; H. Song, H.-W. Li, M. S. Munson, T. G. Van Ha, R. G. Ismagilov, Anal. Chem. 2006, 78, 4839; D. T. Chiu, R. M. Lorenz, G. D. M Jeffries, Anal. Chem. 2009, 81, 5111-5118). Reducing the droplet volume reduces the dilution factor for the contents of a single cell and other small-volume samples and potentially results in concentrations that are more readily handled by ESI-MS or spectroscopic methods (J. Pei, Q. Li, R. T. Kennedy, J. Am. Soc. Mass Spectrom. 2010, 21, 1107-1113; J. Nie, R. T. Kennedy, Anal. Chem. 2010, 82, 7852-7856; R. T. Kelly, K. Tang, D. Irimia, M. Toner, R. D. Smith, Anal. Chem. 2008, 80, 3824-3831).

The methods and devices of the present disclosure complement other approaches to ultrasensitive detection of single-cell content (K. Hiraoka, H. Fukasawa, F. Matshusita, K. Aizawa, Rapid Commun. Mass Spectrom. 1995, 9, 1349-1355; G. Baykut (Bruker-Franzen Analytik, GmbH Bremen, DE), U.S. Pat. No. 5,825,026, 1998; P. L. Urban, K. Jefimovs, A. Amantico, S. R. Fagerer, T. Schmid, S. Madler, J. Puigmarti-Luis, N. Goedecke, R. Zenobi, Lab Chip 2010, 10, 3206-3209; D. Issadore, K. J. Humphry, K. A. Brown, L. Sandberg, D. A. Weitz, R. M. Westervelt, Lab Chip 2009, 9, 1701-1706; Courtois, L. F. Olguin, G. Whyte, D. Bratton, W. T. S. Huck, C. Abell, F. Hollfelder, Chem Bio Chem. 2008, 9, 439).

The present disclosure relates to methods and devices for the controlled generation of a multi-phase emulsion comprising a gas phase, as well as interfaces and systems for performing analysis of analytes delivered to various analytical devices. In some aspects, the analytes are delivered via droplets. In some aspects, the present disclosure provides methods, devices, interfaces and systems that can be used in the performance of mass spectrometry.

As used herein, the terms "multi-phase emulsion" and "double emulsion" are used interchangeably, and include any combination of three or more fluids wherein each of the three or more fluids is immiscible with, but in physical contact with, at least one of the other fluids. As used herein, the term "fluid" means any liquid phase matter or gas phase matter. As used herein, the term "immiscible fluids" or "immiscible liquids" means two or more fluids that, under a given set of experimental conditions, do not undergo mixing or blending to an appreciable degree to form a homogeneous mixture, even when in physical contact with one another.

In various aspects of the present disclosure, a double emulsion of droplets can be produced between three or more immiscible fluids. In some aspects, the double emulsion comprises an inner droplet comprising a first liquid, the inner droplet encapsulated in an outer droplet comprising a second liquid, the outer droplet encapsulated in a gas.

In some aspects, the present disclosure describes the controlled generation of double emulsions in the gas phase, which was carried out, in certain embodiments, using an integrated emitter in a polydimethylsiloxane (PDMS) microfluidic chip. Such an integrated emitter can be formed using a molding approach, in which metal wires with desirable diameters were used as emitter molds. The generation of double emulsions in air was achieved with electrohydrodynamic actuation, which offers controllable force exerting on the double emulsions. This capability was developed for future integration of droplet microfluidics with mass spectrometry (MS), where each aqueous droplet in the microchannel is introduced into the gas phase as a double emulsion for subsequent ionization and MS analysis.

In some aspects, the present disclosure describes a new system for coupling microfluidics to a simple mass spectrometer that achieves efficient sample delivery from compartmentalized aqueous droplets. Droplet microfluidics offers tools for manipulation of small volumes that are difficult to achieve by other means, while modern mass spectrometry provides superior detection capabilities. So far, the combination of both methods has been limited due to challenges in sample ionization because, under normal operating conditions, the immiscible bi-phase composition of a liquid stream is poorly compatible with electrospray (R. T. Kelly, K. Tang, D. Irimia, M. Toner, R. D. Smith, Anal. Chem. 2008, 80, 3824-3831; R. T. Kelly, J. S. Page, I. Marginean, K. Tang, R. D. Smith, Angew. Chem. Int. Ed. 2009, 48, 6832-6835, S6832/1-S6832/2).

In the present disclosure, devices and methods are provided that overcome these limitations and achieve attomole limits of detection per single compartment while demonstrating substantial tolerance towards ions present in solution, buffers, blood plasma, and other difficult matrices.

Devices and Methods for Generating Double Emulsions

The present disclosure provides devices and methods for generating double emulsions in a gas phase. In some aspects, a microfluidic device comprising fluidic channels is provided. In some aspects, the fluidic channels are connected and in fluidic communication with one another at one or more junctions. In some aspects, the microfluidic device can also comprise a droplet emitter. In some aspects, the droplet emitter is configured to emit droplets, including emulsion droplets, from the device. The terms "emitter" and "droplet emitter" are used interchangeably herein.

As used herein, the term "in fluidic communication with" (and variations thereof) refers to the existence of a fluid path between components, and neither implies nor excludes the existence of any intermediate structures or components, nor implies that a path is always open or available for fluid flow.

In some aspects, the present disclosure provides an integrated emitter which avoids the dead volume at the junction region between the fluidic channels and assembling external emitters. Delivery of droplets using electrohydrodynamics is easy to integrate with microfluidics chips, and is convenient for controlling droplet size and frequency, especially for the generation of larger droplets (tens of microns in diameter and above) at a lower droplet-generation frequency (tens to hundreds of Hz) that are needed for coupling with the mass spectrometer (Kim, S. J.; Song, Y.; Skipper, P. L.; Han, J. Anal. Chem. 2006, 78, 8011-8019; Lee, E. R. Microdrop generation, CRC Press, 2003).

In some aspects of the disclosure, fluidic channels, emitters, and other components can be fabricated at least in part from polymeric materials. In some aspects, the device can be fabricated at least in part from, without limitation, polydimethylsiloxane, polymethylmethacrylate, polyethylene, polyester, polytetrafluoroethylene, polycarbonate, polyvinyl chloride, fluoroethylpropylene, lexan, polystyrene, cyclic olefin copolymers, polyurethane, polyurethane methacrylate, polyestercarbonate, polypropylene, polybutylene, polyacrylate, polycaprolactone, polyketone, polyphthalamide, cellulose acetate, polyacrylonitrile, polysulfone, epoxy polymers, thermoplastics, fluoropolymer, polyvinylidene fluoride, polyamide, polyimide or a combination thereof.

In some aspects, fluidic channels, emitters, and other components can be fabricated at least in part from, without limitation, inorganic materials (glass, quartz, silicon, GaAs, silicon nitride), fused silica, ceramic, glass (organic), metals and/or other materials and combinations thereof. In some aspects, the device can comprise channels made capillaries, including but not limited to fused silica capillaries.

In some aspects, fluidic channels, emitters, and other components can be fabricated at least in part from, without limitation, porous membranes, woven or non-woven fibers (such as cloth or mesh) of wool, metal (e.g., stainless steel or Monel), glass, paper, or synthetic (e.g., nylon, polypropylene, and various polyesters), sintered stainless steel and other metals, porous inorganic materials such as alumna, silica or carbon, and combinations thereof.

In some aspects, one or more surfaces of the fluidic channels, emitters, and other components may be chemically modified to enhance wetting or to assist in the adsorption of select cells, particles, or molecules. Surface-modification chemicals may include, without limitation, silanes such as trimethylchlorosilane, hexamethyldisilazane, (Tridecafluoro-1,1,2,2-tetrahydrooctyl)trichlorosilane, chlorodimethyloctylsilane, Octadecyltrichlorosilane or γ-methyacryloxypropyltrimethyoxy-silane; polymers such as acrylic acid, acrylamide, dimethylacrylamide, 2-hydroxyethyl acrylate, polyvinylalcohol, poly(vinylpyrrolidone), poly(ethylene imine), Polyethylene glycol, epoxy poly(dimethylacrylamide), or PEG-monomethoxyl acrylate; surfactants such as Pluronic surfactants, Poly(ethylene glycol)-based surfactants, sodium dodecylsulfate dodecyltrimethylammonium chloride, cetyltriethylammonium bromide, or Polybrene; cellulose derivatives such as hydroxypropylcellulose, or hydroxypropylmethylcellulose; amines such as ethylamine, diethylamine, triethylamine, or triethanolamine, fluorine-containing compounds such as those containing polytetrafluoroethylene or Teflon.

In some aspects, the surface of the emitter is chemically pretreated with any of the chemical surface modifications described above. In certain preferred aspects, the surface of the emitter is pretreated with a perfluorocarbon. In certain preferred aspects, the surface of the emitter is silanized.

In some aspects, the device comprises at least one fluidic channel having a proximal end where liquid enters the channel and a distal end where liquid exits the channel. In some aspects, the channel has a smallest dimension. The smallest dimension of the channel can be the width, height or length of the channel. In some aspects, the smallest dimension of the channel is in the range of microns, tens of microns, or hundreds of microns.

In some aspects, a channel comprises a smallest dimension between 10 microns and 30 microns, between 20 microns and 40 microns, between 30 microns and 50 microns, between 40 microns and 60 microns, between 50 microns and 70 microns, between 60 microns and 80 microns, between 70 microns and 90 microns, between 80 microns and 100 microns, between 90 microns and 110 microns, between 100 microns and 300 microns, between 200 microns and 400 microns, between 300 microns and 500 microns, between 400 microns and 600 microns, between 500 microns and 700 microns, between 600 microns and 800 microns, between 700 microns and 900 microns, or between 800 microns and 1000 microns.

In some aspects, the axial length of a channel is a straight line. In other aspects, the length of the channel may comprise a curvature, resulting in a tortuous flow path for fluids flowing through the channel. In some aspects, the axial length of the channel may comprise junctions with other channels. In some aspects, the device may comprise a junction, such as a T-junction. In some aspects, the geometry of the channels and their junctions may be configured to achieve droplet emulsions by means of flow-focusing. In some aspects, the device is configured to generate droplet emulsions wherein a droplet of a first liquid is completely surrounded by a second, immiscible liquid. In some aspects, the device is configured to generate a discrete partition of the first liquid surrounded at least in part by a second, immiscible liquid.

As used herein, a "discrete partition" of a first liquid is similar to a droplet in that it is surrounded by, and encapsulated in, substances other than the first liquid. However, a discrete partition is not necessarily spherical in shape and is not necessarily surrounded entirely by one other substance. For example in some aspects, a discrete partition of a first liquid is surrounded in part by a second liquid and in part by walls of a fluidic channel. In some aspects, discrete partitions are referred to herein as "plugs" and/or "compartments."

In some aspects, the device comprises an emitter in fluidic communication with the distal end of a channel and in fluidic communication with a gas phase. In some aspects, liquids exit the channel in the form of droplets emitted by the emitter. In some aspects, the droplet emitter is conical in shape. In some aspects, the inner diameter of the droplet emitter is between 10 microns and 30 microns, between 20 microns and 40 microns, between 30 microns and 50 microns, between 40 microns and 60 microns, between 50 microns and 70 microns, between 60 microns and 80 microns, between 70 microns and 90 microns, between 80 microns and 100 microns, between 90 microns and 110 microns, between 100 microns and 300 microns, between 200 microns and 400 microns, between 300 microns and 500 microns, between 400 microns and 600 microns, between 500 microns and 700 microns, between 600 microns and 800 microns, between 700 microns and 900 microns, or between 800 microns and 1000 microns.

In some aspects, fluids can be introduced into channels and their flow through the channels controlled using computer-controlled syringe pumps or modulated air pressure. In some aspects, fluids can be introduced into the channels and/or made to flow through the channels by devices that induce hydrodynamic fluidic pressure, including without limitation devices that operate on the basis of mechanical principles (e.g., external syringe pumps, pneumatic membrane pumps, vibrating membrane pumps, vacuum devices, centrifugal forces, and capillary action); electrical or magnetic principles (e.g., electroosmotic flow, electrokinetic pumps piezoelectric/ultrasonic pumps, ferrofluidic plugs, electrohydrodynamic pumps, and magnetohydrodynamic pumps); thermodynamic principles (e.g., gas bubble generation/phase-change-induced volume expansion); surface-wetting principles (e.g., electrowetting, chemically, thermally, and radioactively induced surface-tension gradient).

According to various aspects of the present disclosure, fluids can be introduced into the channels and their flow through the channels in response to a gradient across the length of the first and/or second channel. In certain aspects, the flow results from a pressure gradient or an electric field gradient. The mechanism inducing flow in the first channel can be the same or different from the mechanism inducing flow in the second channel.

In addition, fluid drive force can be provided by gravity feed, surface tension (like capillary action), electrostatic forces (electroosmotic flow), centrifugal flow (substrate disposed on a compact disc and rotated), magnetic forces (oscillating ions causes flow), magnetohydrodynamic forces and a vacuum or pressure differential.

Fluid flow control devices, such as those enumerated with regard to methods and devices for inducing hydrodynamic fluid pressure or fluid drive force, can be coupled to an input port or an output port of the present subject matter. In one example, multiple ports are provided at either or both of the inlet and outlet and one or more ports are coupled to a fluid flow control device.

In certain preferred aspects, fluids can be introduced into channels and their flow through the channels controlled using electrohydrodynamic actuation. As used herein, the term "electrohydrodynamic actuation" means the use of an electrical field and/or electrical potential to generate the flow of one or more liquids. In some aspects of the disclosure, electrohydrodynamic actuation provides a mechanism for the controlled generation of double emulsion droplets in a gas phase—such as, for example, water-in-oil emulsion droplets encapsulated in air.

In some aspects, electrohydrodynamic actuation is implemented via an electrical field and/or electrical force generated by a voltage source that drives the flow of a fluid through a channel. In some aspects the voltage source is in electrical communication with a first electrode that is in electrical communication with a channel and/or other components of a fluidic device, such as an emitter. In some aspects the voltage source is in electrical communication with a second electrode that is in fluidic communication with a gas phase. In some aspects the second electrode comprises a hole configured to allow the passage of a droplet emitted from the emitter into the gas phase, such as a double emulsion droplet.

In some aspects the first electrode is a working electrode and the second electrode is a ground electrode. In other aspects the second electrode is a working electrode and the first electrode is a ground electrode.

As used herein, the term "in electrical communication with" means that the subject electrical components are configured and positioned so as to complete an electrical circuit between one another when the components are supplied with power. Thus, components in electrical communication with one another will carry an electrical current originating from the same source. The terms "electrical communication" and "conductive communication" are used interchangeably herein.

In some aspects, the first and/or second electrodes comprise an electrically conductive material, such as an electrically conductive metal. In some aspects, the first and/or second electrodes comprise silver, gold, platinum, steel, iron, copper or a combination thereof.

In some aspects, the voltage source generates an electrical field between the first electrode and the second electrode. In some aspects, the second electrode is a positive electrode and the first electrode is a negative electrode. In some aspects, the first electrode is a positive electrode and the second electrode is a negative electrode.

In some aspects, the first electrode is a positive electrode and negative charges in a fluid are drawn back toward the first electrode, polarizing the fluid in a channel of the device. In some aspects, the channel contains liquid droplets or discrete partitions that are surrounded at least in part by a second, immiscible liquid, and when the electric field is high enough, net positive charges in one or both of the liquids cause a double emulsion droplet to form at an emitter tip at the distal end of the channel, until the double emulsion droplet is ejected toward the second, negatively charged electrode by the electrical force acting on it.

In some aspects, the first electrode is a negative electrode and positive charges in a fluid are drawn back toward the first electrode, polarizing the fluid in a channel of the device. In some aspects, the channel contains liquid droplets encapsulated in a second, immiscible liquid, and when the electric field is high enough, net negative charges in one or both of the liquids cause a double emulsion droplet to form at an emitter tip at the distal end of the channel, until the double emulsion droplet is ejected toward the second, positively charged electrode by the electrical force acting on it.

In some aspects, the electrical force generated by the voltage source is between about 10 V and about 100 V, between about 100 V and about 500 V, between about 500 V and about 1000 V, between about 1000 V and about 1500 V, between about 1500 V and about 2000 V, between about 2000 V and about 2500 V, between about 2500 V and about 3000 V, between about 3000 V and about 3500 V, between about 3500 V and about 4000 V, between about 4000 V and about 4500 V, or between about 4500 V and about 5000 V. In some aspects, the electrical force generated by the voltage source is between 10 V and 100 V, between 100 V and 500 V, between 500 V and 1000 V, between 1000 V and 1500 V, between 1500 V and 2000 V, between 2000 V and 2500 V, between 2500 V and 3000 V, between 3000 V and 3500 V, between 3500 V and 4000 V, between 4000 V and 4500 V, or between 4500 V and 5000 V.

In some aspects, the electrical force generated by the voltage source is sufficient to enable precise control over various parameters of the double emulsion droplets generated, including without limitation, the diameter of an inner droplet of the emulsion, the diameter of an outer droplet of the emulsion, the number of inner droplets in each outer droplet of the emulsion, and the frequency or rate at which droplets are emitted from the emitter.

In some aspects, the electrical force generated by the voltage source is sufficient to generate a double emulsion droplet comprising one, two, three, four, five or more inner droplets comprising a first liquid, the inner droplets encapsulated in an outer droplet comprising a second liquid, the outer droplet encapsulated in a gas phase.

In some aspects, the double emulsion comprises an aqueous inner droplet and an oil-based outer droplet. In some aspects, it is desirable to have a precisely pre-defined number of aqueous droplets encapsulated per oil droplet, such as one aqueous droplet encapsulated within each oil droplet. The approach disclosed herein satisfies these criteria and is based on the electrohydrodynamic dispensing of double emulsions at a nozzle or emitter tip.

In some aspects, the electrical force generated by the voltage source is sufficient to generate a double emulsion droplet, wherein the diameter of the inner droplet is between 5 microns and 15 microns, between 10 microns and 30 microns, between 20 microns and 40 microns, between 30 microns and 50 microns, between 40 microns and 60 microns, between 50 microns and 70 microns, between 60 microns and 80 microns, between 70 microns and 90 microns, between 80 microns and 100 microns, between 90 microns and 110 microns, between 100 microns and 300 microns, between 200 microns and 400 microns, between 300 microns and 500 microns, between 400 microns and 600 microns, between 500 microns and 700 microns, between 600 microns and 800 microns, between 700 microns and 900 microns, or between 800 microns and 1000 microns.

In some aspects, the electrical force generated by the voltage source is sufficient to generate a double emulsion droplet, wherein the diameter of the outer droplet is between 5 microns and 15 microns, between 10 microns and 30 microns, between 20 microns and 40 microns, between 30 microns and 50 microns, between 40 microns and 60 microns, between 50 microns and 70 microns, between 60 microns and 80 microns, between 70 microns and 90 microns, between 80 microns and 100 microns, between 90 microns and 110 microns, between 100 microns and 300 microns, between 200 microns and 400 microns, between 300 microns and 500 microns, between 400 microns and 600 microns, between 500 microns and 700 microns, between 600 microns and 800 microns, between 700 microns and 900 microns, or between 800 microns and 1000 microns.

In some aspects, the electrical force generated by the voltage source is sufficient to generate a plurality of the double emulsion droplets. In some aspects, more than 50%, more than 60%, more than 70%, more than 80%, more than 90%, more than 95%, or more than 99% of the plurality of double emulsion droplets contain an equal number of inner droplets.

In some aspects, the electrical force generated by the voltage source is sufficient to generate a plurality of double emulsion droplets at a rate between about 1 Hz and about 10 Hz, between about 10 Hz and about 100 Hz, between about 100 Hz and about 1000 Hz, or between about 1000 Hz and about 10,000 Hz. In some aspects, the electrical force generated by the voltage source is sufficient to generate a plurality of double emulsion droplets at a rate between 1 Hz and 10 Hz, between 10 Hz and 100 Hz, between 100 Hz and 1000 Hz, or between 1000 Hz and 10,000 Hz.

In some aspects, any of the voltage sources disclosed herein can be a commercially available voltage power supply, or a custom fabricated voltage power supply. In some aspects, any of the voltage sources disclosed herein can provide direct current. In some aspects, any of the voltage sources disclosed herein can provide alternating current. Other types of voltage source can be used for any of the voltage sources disclosed herein, and can be determined by one of ordinary skill in the art according the specific requirements of his or her application.

In some aspects, the devices and methods described herein are capable of generating droplets, such as water-in oil emulsion droplets, at a tunable rate of Hz to thousands of Hz, but preferably in the few Hz, or tens of Hz, or hundreds of Hz range. Such a rate is desirable because in many cases it matches with the scanning frequency of, for example, a time-of-flight mass spectrometer (TOF-MS).

In some representative aspects, the present application provides a number of devices capable of generating double emulsions in the gas phase comprising: a first fluidic channel, having a proximal end and a distal end, in fluidic communication with an aqueous sample and in conductive communication with an electrode; a second fluidic channel, having a proximal end and a distal end, in fluidic communication with an oil that is immiscible with the aqueous sample, wherein the second fluidic channel connects with the first fluidic channel in between the proximal and distal end; an emitter in fluidic communication with the distal end of the first fluidic channel in conductive communication with an electrode; a ground electrode comprising a hole configured to allow the passage of double emulsions emitted from the emitter; and a voltage source in electrical communication with the electrodes, wherein the voltage source is sufficient to produce double emulsions.

In various aspects, the present disclosure provides a device for producing a droplet, the device comprising: a first fluidic channel, having a proximal end and a distal end, in fluidic communication with a first liquid and in electrical communication with a first electrode, wherein the proximal end of the first fluidic channel is connected to the first electrode; a second fluidic channel in fluidic communication with a second liquid, wherein the second liquid is immiscible with the first liquid, and wherein the second fluidic channel is in fluidic communication with the first fluidic channel; a droplet emitter, having a proximal end and a distal end, wherein the proximal end of the droplet emitter is in fluidic communication with the distal end of the first fluidic channel and the distal end of the droplet emitter is contacted with a gas; a second electrode comprising an opening configured to allow the passage of a droplet emitted from the droplet emitter; and a voltage source in electrical communication with the first electrode, the second electrode, or a combination thereof, wherein the voltage source is sufficient to generate a droplet emitted from the droplet emitter, thereby forming a double emulsion.

In further aspects, the second fluidic channel is connected with the first fluidic channel at a junction located between the proximal end and distal end of the first channel.

In other aspects, one or both of the first channel or the second channel comprises a material independently selected from silicon, fused silica, ceramic, glass, polydimethylsiloxane, polymethylmethacrylate, polyethylene, polyester, polytetrafluoroethylene, polycarbonate, polyvinyl chloride, fluoroethylpropylene, lexan, polystyrene, cyclic olefin copolymers, polyurethane, polyurethane methacrylate, polyestercarbonate, polypropylene, polybutylene, polyacrylate, polycaprolactone, polyketone, polyphthalamide, cellulose acetate, polyacrylonitrile, polysulfone, epoxy polymers, thermoplastics, fluoropolymer, polyvinylidene fluoride, polyamide, polyimide or a combination thereof.

In further aspects, the droplet emitter is in electrical communication with the first electrode.

In some aspects, the inner diameter of the droplet emitter is between 10 microns and 30 microns, between 20 microns and 40 microns, between 30 microns and 50 microns, between 40 microns and 60 microns, between 50 microns and 70 microns, between 60 microns and 80 microns, between 70 microns and 90 microns, between 80 microns and 100 microns, between 90 microns and 110 microns, between 100 microns and 300 microns, between 200 microns and 400 microns, between 300 microns and 500 microns, between 400 microns and 600 microns, between 500 microns and 700 microns, between 600 microns and 800 microns, between 700 microns and 900 microns or between 800 microns and 1000 microns.

In some aspects, the surface of the droplet emitter is chemically modified.

In other aspects, the device further comprises a pump in fluidic communication with at least one of the first liquid and the second liquid.

Fabrication of Devices for Generating Double Emulsions

Methods of fabricating a device for generating double emulsions are provided herein. The methods of fabricating fluidic devices described herein are a non-limiting set of exemplary methods.

In some aspects, the present disclosure provides a simple polymer molding method to form an integrated emitter with a three-dimensional conical shape in a PDMS chip. Although there are many existing integrated PDMS emitters, their tapered structure is two dimensional or quasi-two dimensional because of fabrication constraints (Kim, J. S.; Knapp, D. R. J. Am. Soc. Mass. Spectrom. 2001, 12, 463-469; Svedberg, M.; Veszelei, M.; Axelsson, J.; Vangbo, M.; Nikolajeff, F. Lab chip 2004, 4, 322-327; Kelly, R. T.; Page, J. S.; Marginean, I.; Tang, K.; Smith, R. D. Angew. Chem. Int. Ed. 2009, 48, 6832-6835; Sun, X.; Kelly, R. T.; Tang, K.; Smith, R. D. Analyst 2010, 135, 2296-2302). This is not suitable for generating double emulsions because the 2D shape can cause adhesion and spreading of liquids at the emitter tip. The surface of a 3D integrated emitter formed by molding technique can be silanized by trichloro(1,1,2,2-H4-perfluorooctyl)silane to facilitate detachment of the double emulsion from the tip.

In some aspects, a device for generating double emulsions can be fabricated by replication or direct fabrication. Examples include, without limitation, semiconductor fabrication techniques and methods including photolithography, growing a crystalline structure, and etching (reactive ion etching and wet etching), laser ablation, replica molding, injection molding and embossing (application of heat and pressure), imprinting, and combinations thereof.

In some aspects, a lithographic technique can be used to directly fabricate features of the device on a chip. In some aspects, a photoresist is spin-coated onto a substrate and exposed to UV radiation through a photomask to transfer the pattern from the photomask to the photoresist. The substrate is then exposed to gaseous or liquid reactants to etch through the open regions of the photoresist. The photoresist is then removed and the substrate, now consisting of recessed flow channels, is then bonded to a transparent substrate to form an enclosed chip.

In some aspects, a replication technique may be used to fabricate a device for generating double emulsions. A replication master with relief features is used as a mold to cast polymer against. The liquid polymer resin is dispensed onto the replication master and may be cured thermally or with radiation, depending on the initiators used. The cured resin may be removed from the master and then bonded to a transparent substrate to form an enclosed chip.

In some aspects, a silicon wafer molding master is produced, from which polymer slabs incorporating structural features of the molding master can be replicated. In some aspects, a negative photoresist is spun onto a silicon wafer. The photoresist is baked and then partially exposed to ultraviolet light through a patterned photomask using a mask aligner. The portion of the photoresist layer exposed to ultraviolet light is cross-linked by the radiation, and becomes insoluble in a developer solution. Exposing the photoresist layer to the developer solution removes uncross-linked photoresist and leaves raised structures of cross-linked photoresist on the surface of the silicon, essentially a negative relief image of the original photomask. The application of photoresist, ultraviolet light exposure, and development in developer solution may be repeated to create multi-level layered structures. In some aspects, the resulting master mold is passivated with fluorosilane to allow a PDMS slab to be cast on the master mold and removed. In some aspects, positive photoresist layers are used to create positive, relief images. In some aspects, microstructures are produced directly in silicon or other substrate materials by etching with reactive chemicals in gaseous or liquid phase, by ablating with focused laser beams, or by bombarding with directed charged particle beams such as ions, electrons or plasma.

In some aspects, liquid polymer is poured over a master mold and baked to cure the liquid polymer into a soft, semi-solid slab. The cured slab of polymer is then peeled from the master mold, and oxidized in an oxygen plasma. In some aspects, the cured slab of polymer is then bonded against another molded polymer slab to form enclosed channels. In some aspects, the cured PDMS is peeled from the master mold and bonded to a substrate of material such as glass, quartz, or silicon. In some aspects, a curable thermoset or photocurable polymer is used. In some aspects, the aforementioned microstructures are directly produced in a substrate by chemical etching, laser ablation, or charged particle bombardment and bonded to another substrate to form an enclosed fluidic channel.

In some aspects, a device for generating double emulsions is replicated by injection-molding of thermoplastic materials. In some aspects, solid plastic pellets are loaded into a hopper and softened under hydraulic pressure and temperature. The liquefied material is then injected into a master mold with channel features. Upon cooling the plastic replica solidifies and is removed and bonded to another substrate to form an enclosed fluidic device.

Fluids for Generating Double Emulsions

In some aspects, the present disclosure provides devices and methods for generating a double emulsion. In some aspects, the double emulsion comprises an inner droplet comprising a first liquid, the inner droplet encapsulated in an outer droplet comprising a second liquid that is immiscible with the first liquid, the outer droplet encapsulated in a gas.

In some aspects, the first liquid is aqueous. Possible aqueous fluids that can be used as one phase of a droplet emulsion include without limitation water, various PCR and RT-PCR solutions, isothermal amplification solutions such as for LAMP or NASBA, buffer solutions, cerebrospinal fluid or artificial cerebrospinal fluid, blood samples, plasma samples, serum samples, solutions that contain cell lysates or secretions or bacterial lysates or secretions, and other biological samples containing proteins, bacteria, viral particles and/or cells (eukaryotic, prokaryotic, or particles thereof) among others.

In certain aspects, the aqueous solutions loaded on the devices can have cells expressing a malignant phenotype, fetal cells, circulating endothelial cells, tumor cells, cells infected with a virus, cells transfected with a gene of interest, or T-cells or B-cells present in the peripheral blood of subjects afflicted with autoimmune or autoreactive disorders, or other subtypes of immune cells, or rare cells or biological particles (e.g., exosomes, mitochondria) that circulate in peripheral blood or in the lymphatic system or spinal fluids or other body fluids. The cells or biological particles can, in some circumstances, be rare in a sample and the discretization can be used, for example, to spatially isolate the cells, thereby allowing for detection of the rare cells or biological particles.

In some aspects, the first liquid comprises an analyte to be analyzed. The analyte may comprise, without limitation, a small molecule, a drug, a toxin, a carbohydrate, a sugar, a lipid, a fatty acid, a metabolite, a polynucleotide such as DNA or RNA, an amino acid, a peptide, a polypeptide such as a protein (e.g., an antibody, a glycoprotein or an avidin protein), a cell such as a prokaryotic cell or a eukaryotic cell, a cell lysate, a cellular fraction or organelle, a biological or synthetic vesicle such as liposome, a virus or viral particle, a polymer or any combination thereof.

In some aspects, the second liquid, which is immiscible with the first fluid, is an oil, but it does not need to be an oil. Potential liquids that can serve as the second liquid include but are not limited to, fluorocarbon based oils, silicon compound based oils, hydrocarbon based oils such as mineral oil and hexadecane, vegetable based oils, ionic liquids, an aqueous liquid that is immiscible with the first liquid, or that forms a physical barrier with the first liquid.

In some aspects, the second liquid comprises a hydrocarbon based liquid, a fluorocarbon based liquid, a silicone based liquid, or a combination thereof. In some aspects, the second liquid comprises a mineral oil, a vegetable oil, a silicone oil, a fluorinated oil, a fluorinated alcohol, a Fluorinert, a Tegosoft, a perfluorinated ester, a perfluorinated ether or a combination thereof. In some aspects, the second liquid comprises perfluorohexane, perfluorodecalin, hexadecane or a combination thereof.

In some aspects, it may be desirable to use a liquid having a sufficiently low boiling point to generate double emulsions. In some aspects, the boiling point of a liquid used to generate double emulsions is less than 250° C., less than 200° C., less than 150° C., less than 100° C. or less than 50° C.

In some aspects, it may be desirable to use a liquid having a sufficiently high vapor pressure to generate double emulsions. In some aspects, the vapor pressure of a liquid used to generate double emulsions is higher than 5 Torr, higher than 15 Torr, higher than 25 Torr, higher than 35 Torr, higher than 45 Torr, higher than 55 Torr, higher than 65 Torr, higher than 75 Torr, higher than 85 Torr, higher than 95 Torr, higher than 105 Torr, higher than 115 Torr, higher than 125 Torr, higher than 1355 Torr, higher than 145 Torr, higher than 155 Torr, higher than 165 Torr, higher than 175 Torr, higher than 185 Torr, higher than 195 Torr, or higher than 205 Torr at room temperature.

In certain aspects, the emulsion system can comprise two immiscible fluids that are both aqueous or both non-aqueous. In further aspects, both emulsion fluids can be oil based where the oils are immiscible with each other. For example, one of the oils can be a hydrocarbon based oil and the other oil can be a fluorocarbon based oil.

In other emulsion systems, both fluids can be primarily aqueous but still be immiscible with each other. In some aspects, this occurs when the aqueous solutions contain components that phase separate from each other. Some examples of solutes that can be used include, but are not limited to, systems containing dextran, ficoll, methylcellulose, polyethylene glycol (PEG) of varying length, copolymers of polyethylene glycol and polypropylene glycol, polyvinyl alcohol (PVA), polyvinyl pyrrolidone (PVP), Repal PES, $K_3PO_4$, sodium citrate, sodium sulfate, $Na_2HPO_4$, and $K_3PO_4$.

In certain aspects of the present disclosure, either liquid can comprise a fluid interface modification. Fluid interface modification elements include interface stabilizing or modifying molecules such as, but not limited to, surfactants, lipids, phospholipids, glycolipids, proteins, peptides, nanoparticles, polymers, precipitants, microparticles, or other components. In some aspects, one or more fluid interface modification elements can be present in a fluid that will be comprised in an inner droplet. In some aspects, one or more fluid interface modification elements can be present in a fluid that will be comprised in an outer droplet. The fluid interface modification elements present in a fluid that will be comprised in one phase of the emulsion can be the same or different from the fluid interface modification elements present in a fluid that will be comprised in another phase of the emulsion.

In some aspects, of the present disclosure, the fluid interface modification element can be used to prevent coalescence of neighboring emulsion droplets, leading to long-term emulsion stability. In some aspects, fluid interface modification elements can have some other or additional important role, such as providing a biocompatible surface within droplets, which may or may not also contribute to emulsion stability. In some aspects, the components can play a role in controlling transport of components between the fluids or between droplets. In some aspects, surfactants can be included to, e.g., improve stability of the droplets and/or to facilitate droplet formation.

Suitable surfactants can include, but are not limited to, non-ionic surfactants, ionic surfactants, silicone-based surfactants, fluorinated surfactants or a combination thereof. Non-ionic surfactants can include, for example, sorbitan monostearate (Span 60), octylphenoxyethoxyethanol (Triton X-100), polyoxyethylenesorbitan monooleate (Tween 80) and sorbitan monooleate (Span 80). Silicone-based surfactants can include, for example, ABIL WE 09 surfactant. Other types of surfactants generally well known in the art can similarly be used. Additional examples of fluid interface modification elements include without limitation ABIL EM90, TEGOSOFT DEC, bovine serum albumin, sorbitans, polysorbates (e.g., PEG-ylated sorbitan such as TWEEN 20), sodium dodecylsulfate, 1H,1H,2H,2H-perfluorooctanol, monolein, oleic acid, phospholipids, and Pico-Surf, among others.

In some aspects, the surfactant can be present at a variety of concentrations or ranges of concentrations, such as approximately 0.01%, 0.1%, 0.25%, 0.5%, 1%, 5%, or 10% by weight.

Interfaces for Coupling a Droplet Source to an Analytical Instrument

The present disclosure provides methods, devices, systems and apparatuses for an interface capable of coupling a droplet source to an analytical instrument. In some aspects, the droplet source is a microfluidic droplet source, such as a microfluidic device that generates double emulsion droplets. In some aspects, the analytical instrument is a mass spectrometer, an ion mobility spectrometer, or a combination thereof. In some aspects, the analytical instrument includes a gas chromatographer or other instrument configured to analyze a sample or analyte. In some aspects, the interface is configured to modify a droplet and a sample or analyte contained in the droplet to be suitable for analysis by the analytical instrument. For example, in some aspects the interface is configured to evaporate the liquid droplet comprising an analyte and to ionize the analyte, thereby making the analyte suitable for analysis by a mass spectrometer. In further aspects, the interface is configured to ionize an analyte within a droplet and to evaporate a droplet comprising the ionized analyte. In some aspects, the ionization occurs before the liquid is evaporated. In other aspects, the ionization occurs after evaporation occurs.

In some aspects, the present disclosure provides an interface with a large inlet opening (e.g., 1.5 mm, but other diameters, either smaller or larger can also be used) for efficient droplet introduction into a vacuum system and an ion transfer device, combining an electrostatic tube lens element with an infrared mirror. In some aspects this combination allows for infrared laser-assisted droplet evaporation in the rough vacuum region of a mass spectrometer and formation of gas-phase ions.

In some aspects, an interface for coupling a microfluidic droplet source to an analytical instrument is provided, wherein the interface is contained by an outer surface providing a substantially enclosed inner space. In some aspects, the outer surface has a proximal end and a distal end. In some aspects, a droplet enters the substantially enclosed inner space from the proximal end of the outer surface. In various aspects, the droplet comprises an analyte. In some aspects, the droplet is partially or completely evaporated in the interface. In some aspects, the droplet is evaporated in the interface prior to or in the course of ionization. In other aspects, the analyte is ionized in the interface prior to evaporation of the droplet. In some aspects, a droplet exits the substantially enclosed inner space from the distal end of the outer surface. In some aspects, the outer surface comprises ports for components such as, without limitation, a vacuum source, a laser or other light source, and/or an aperture.

The outer surface of the interface can comprise a rectangular box shape, a cylindrical tube shape, or other suitable shape. The shape of the outer surface of the interface can be determined by one of ordinary skill in the art according to the dimensions of the components inside the enclosed inner space, and according to the space constraints of the instruments that the interface is in physical proximity to, including without limitation a vacuum, a laser or other light source, and/or an analytical instrument. For example, in some aspects the interface and a microfluidic droplet source are configured so as to be attached to a modified mass spectrometer.

In some aspects, the largest dimension of the outer surface of the interface is less than 50 millimeters. In some aspects, the largest dimension of the outer surface is between about 50 millimeters and about 100 millimeters, between about 100 millimeters and about 150 millimeters, between about 150 millimeters and about 200 millimeters, between about 200 millimeters and about 300 millimeters, between about 300 millimeters and about 400 millimeters, between about 400 millimeters and about 500 millimeters, between about 500 millimeters and about 600 millimeters, between about 600 millimeters and about 700 millimeters, between about 700 millimeters and about 800 millimeters, between about 800 millimeters and about 900 millimeters, or between about 900 millimeters and about 1000 millimeters. In some aspects, the largest dimension of the outer surface is between 50 millimeters and 100 millimeters, between 100 millimeters and 150 millimeters, between 150 millimeters and 200 millimeters, between 200 millimeters and 300 millimeters, between 300 millimeters and 400 millimeters, between 400 millimeters and 500 millimeters, between 500 millimeters and 600 millimeters, between 600 millimeters and 700 millimeters, between 700 millimeters and 800 millimeters, between 800 millimeters and 900 millimeters, or between 900 millimeters and 1000 millimeters.

In some aspects, the interface comprises an inlet. In some aspects the inlet is a capillary inlet. In some aspects the inlet is configured to allow the passage of liquid droplets into the substantially enclosed inner space. In some aspects, the capillary inlet is between about 0.1 millimeters and about 0.5 millimeters in diameter, between about 0.5 millimeters and about 1 millimeter in diameter, or between about 1 millimeter and about 5 millimeters in diameter. In some aspects, the capillary inlet is between 0.1 millimeters and 0.5 millimeters in diameter, between 0.5 millimeters and 1 millimeter in diameter, or between 1 millimeter and 5 millimeters in diameter. In some aspects, the capillary inlet comprises a material selected from a metal, a glass or a combination thereof. In some aspects, the capillary inlet comprises a glass-lined stainless steel capillary.

In some aspects, the interface comprises a port transparent to laser light disposed on the outer surface. In some aspects, the port comprises a material selected from ZnSe, $BaF_2$, KBr, CsI, KCl, CdTe, $CaF_2$, GaAs, NaCl, Ge, LiF, $SiO_2$, TlBr, ZnS, $Ge_{33}As_{12}Se_5$ or a combination thereof.

In some aspects, the interface comprises a light source configured to pass light through the port into the substantially enclosed inner space. In some aspects the light source is a laser. In some aspects the light source comprises a light emitting diode. In some aspects the light source comprises a lamp. In some aspects the light source further comprises an emission filter, such as a band-pass filter. In some aspects, the intensity of the light source is sufficient to evaporate aqueous droplets and double emulsion droplets in the gas phase. In some aspects, the light source emits infrared light. In some aspects, the light source emits visible light. In some aspects, the light source emits light having a wavelength between about 200 nanometers and about 300 nanometers, about 250 nanometers and about 350 nanometers, about 300 nanometers and about 400 nanometers, about 350 nanometers and about 450 nanometers, about 400 nanometers and about 500 nanometers, about 450 nanometers and about 550 nanometers, about 500 nanometers and about 600 nanometers, about 550 nanometers and about 650 nanometers, about 600 nanometers and about 700 nanometers, about 650 nanometers and about 750 nanometers, about 700 nanometers and about 800 nanometers, about 750 nanometers and about 850 nanometers, about 800 nanometers and about 900 nanometers, about 850 nanometers and about 950 nanometers, about 900 nanometers and about 1000 nanometers, about 950 nanometers and about 1050 nanometers, about 1000 nanometers and about 1100 nanometers, about 1150 nanometers and about 1250 nanometers, or about 1200 nanometers and about 1300 nanometers are used. In some aspects, the light source emits light having a wavelength between 200 nanometers and 300 nanometers, 250 nanometers and 350 nanometers, 300 nanometers and 400 nanometers, 350 nanometers and 450 nanometers, 400 nanometers and 500 nanometers, 450 nanometers and 550 nanometers, 500 nanometers and 600 nanometers, 550 nanometers and 650 nanometers, 600 nanometers and 700 nanometers, 650 nanometers and 750 nanometers, 700 nanometers and 800 nanometers, 750 nanometers and 850 nanometers, 800 nanometers and 900 nanometers, 850 nanometers and 950 nanometers, 900 nanometers and 1000 nanometers, 950 nanometers and 1050 nanometers, 1000 nanometers and 1100 nanometers, 1150 nanometers and 1250 nanometers, or 1200 nanometers and 1300 nanometers are used.

In some aspects the interface comprises a block of metal configured to absorb at least some of the power generated by a light source. In some aspects the block of metal comprises anodized aluminum. In some aspects the block of metal is mounted inside a vacuum manifold.

In some aspects, the interface comprises an electrostatic lens disposed within the substantially enclosed inner space. In some aspects the electrostatic lens is a tube lens and the outer surface of the tube is coated with a substance that reflects light. In some aspects, the tube lens is coated with, composed of, or otherwise comprising Au, Ag, or a dielectric mirror material. Examples of dielectric mirror materials include, without limitation, magnesium fluoride, silicon dioxide, tantalum pentoxide, zinc sulfide, titanium dioxide, porcelain, glass, and polymers such as parylene.

In some aspects the electrostatic lens is a tube lens and the tube comprises a main axis. In some aspects, the electrostatic lens is a tube lens and the tube comprises a main axis that is between about 10 mm and about 20 mm long, between about 20 mm and about 30 mm long, between about 30 mm and about 40 mm long, between about 40 mm and about 50 mm long, between about 50 mm and about 60 mm long, between about 60 mm and about 70 mm long, between about 70 mm and about 80 mm long, between about 80 mm and about 90 mm long, or between about 90 mm and about 100 mm long. In some aspects, the electrostatic lens is a tube lens and the tube comprises a main axis that is between 10 mm and 20 mm long, between 20 mm and 30 mm long, between 30 mm and 40 mm long, between 40 mm and 50 mm long, between 50 mm and 60 mm long, between 60 mm and 70 mm long, between 70 mm and 80 mm long, between 80 mm and 90 mm long, or between 90 mm and 100 mm long. In some aspects, the electrostatic lens is a tube lens and the tube comprises a main axis that is less than 10 mm long. In some aspects, the electrostatic lens is a tube lens and the tube comprises a main axis that is greater than 100 mm long.

In some aspects the electrostatic lens is a tube lens and the tube comprises a shortest dimension that is between about 2 mm and about 4 mm, between about 4 mm and about 6 mm, between about 6 mm and about 8 mm, between about 8 mm and about 10 mm, between about 10 mm and about 12 mm, between about 12 mm and about 14 mm, between about 14 mm and about 16 mm, between about 16 mm and about 18 mm, or between about 18 mm and about 20 mm. In some aspects the electrostatic lens is a tube lens and the tube comprises a shortest dimension that is between 2 mm and 4 mm, between 4 mm and 6 mm, between 6 mm and 8 mm, between 8 mm and 10 mm, between 10 mm and 12 mm, between 12 mm and 14 mm, between 14 mm and 16 mm, between 16 mm and 18 mm, or between 18 mm and 20 mm. In some aspects, the electrostatic lens is a tube lens and the tube comprises a shortest dimension that is less than 2 mm. In some aspects, the electrostatic lens is a tube lens and the tube comprises a shortest dimension that is greater than 20 mm.

In some aspects the electrostatic lens is a tube lens and the tube comprises a plurality of connected sides parallel to the main axis. In some aspects the electrostatic lens is a tube lens and the tube comprises 3 connected sides, 4 connected sides, 5 connected sides, 6 connected sides, 7 connected sides, 8 connected sides, 9 connected sides, 10 connected sides or more than 10 connected sides parallel to the main axis. In some aspects the electrostatic lens is a tube lens and the tube has four connected sides and is rectangular in shape.

In some aspects the electrostatic lens is a tube lens and the tube is cylindrical. In some aspects the electrostatic lens is a tube lens and the tube is cylindrical and the cylinder is formed by one continuous side parallel to the main axis.

In some aspects the electrostatic lens is a tube lens and the tube is open at the end of the main axis most proximal to the source of droplets, the end of the main axis most distal to the source of the droplets, or both ends of the main axis. In some aspects the electrostatic lens is a tube lens and the tube is configured to allow passage of a sample or analyte through the electrostatic lens.

In some aspects the electrostatic lens is a tube lens and the tube comprises a notch in a side configured for visible light or infrared light to enter the electrostatic lens and reach the optical lens or mirror.

In some aspects the electrostatic lens is a tube lens and the tube comprises an optical lens or mirror. In some aspects the electrostatic lens or mirror comprises a crystal. In some aspects the optical lens or mirror is disposed at an angle other than parallel to the main axis. In some aspects the optical lens or mirror reflects light at an angle between about 0 degrees and about 10 degrees, between about 10 degrees and about 20 degrees, between about 20 degrees and about 30 degrees, between about 30 degrees and about 40 degrees, between about 40 degrees and about 50 degrees, between about 50 degrees and about 60 degrees, between about 60 degrees and about 70 degrees, between about 70 degrees and about 80 degrees, or between about 80 degrees and about 90 degrees from the perpendicular (normal) to the main axis. In some aspects the optical lens or mirror reflects light at an angle between 0 degrees and 10 degrees, between 10 degrees and 20 degrees, between 20 degrees and 30 degrees, between 30 degrees and 40 degrees, between 40 degrees and 50 degrees, between 50 degrees and 60 degrees, between 60 degrees and 70 degrees, between 70 degrees and 80 degrees, or between 80 degrees and 90 degrees from the perpendicular (normal) to the main axis. In some aspects the optical lens or mirror reflects light at a 27 degree angle from the normal to the main axis.

In some aspects the electrostatic lens is a tube lens and the tube is configured to reflect light off of the optical lens or mirror and through the electrostatic tube reflecting a plurality of times off of the plurality of sides of the electrostatic tube. In some aspects the electrostatic lens is a tube lens and the tube is configured to reflect light off of the optical lens or mirror and through the electrostatic tube reflecting up to 2 times, 3 times, 4 times, 5 times, 6 times, 7 times, 8 times, 9 times or more than 9 times off of the plurality of sides of the electrostatic tube.

In some aspects, a droplet comprising an analyte enters the electrostatic lens from the proximal end of the interface. In some aspects the electrostatic lens is configured to partially or completely evaporate the droplet so that the analyte is contained in little or no liquid as it exits the electrostatic lens towards the distal end of the interface.

In some aspects, the electrostatic lens comprises a tube lens, a cylinder lens, a quadrupole lens, a magnetic lens, a multipole lens or a combination thereof. In some aspects, the electrostatic lens comprises a commercially available component, a custom fabricated component, or combinations of commercially available and custom fabricated components.

In some aspects, the interface comprises a voltage source connected to the capillary. In some aspects, the voltage source connected to the capillary is sufficient to maintain the capillary at an electrical potential between about 10 V and about 50 V, between about 50 V and about 100 V, between about 100 V and about 500 V, between about 500 V and about 1000 V, or between about 1000 V and about 5000 V. In some aspects, the voltage source connected to the capillary is sufficient to maintain the capillary at an electrical potential between 10 V and 50 V, between 50 V and 100 V, between 100 V and 500 V, between 500 V and 1000 V, or between 1000 V and 5000 V. In some aspects, the voltage source connected to the capillary is sufficient to maintain the capillary at an electrical potential greater than 5000 V.

In some aspects, the voltage source connected to the capillary is sufficient to maintain the capillary at an electrical potential between about 10 V and about 100 V, between about 100 V and about 200 V, between about 200 V and about 300 V, between about 300 V and about 400 V, between about 400 V and about 500 V, between about 500 V and about 600 V, between about 600 V and about 700 V, between about 700 V and about 800 V, or between about 800 V and about 900 V. In some aspects, the voltage source connected to the capillary is sufficient to maintain the capillary at an electrical potential between 10 V and 100 V, between 100 V and 200 V, between 200 V and 300 V, between 300 V and 400 V, between 400 V and 500 V, between 500 V and 600 V, between 600 V and 700 V, between 700 V and 800 V, or between 800 V and 900 V. In some aspects, the voltage source connected to the capillary is sufficient to maintain the capillary at an electrical potential greater than 900 V In some aspects, the interface comprises a voltage source connected to the electrostatic lens. In some aspects, the voltage source connected to the electrostatic lens is sufficient to maintain the electrostatic lens at an electrical potential between about 50 V and about 100 V, between about 100 V and about 500 V, between about 500 V and about 1000 V, or between about 1000 V and about 5000 V. In some aspects, the voltage source connected to the electrostatic lens is sufficient to maintain the electrostatic lens at an electrical potential between 50 V and 100 V, between 100 V and 500 V, between 500 V and 1000 V, or between 1000 V and 5000 V. In some aspects, the voltage source connected to the electrostatic lens is sufficient to maintain the electrostatic lens at an electrical potential greater than about 5000 V. In some aspects, the voltage source connected to the electrostatic lens is sufficient to maintain the electrostatic lens at an electrical potential between about 100 V and about 200 V, between about 200 V and about 300 V, between about 300 V and about 400 V, between about 400 V and about 500 V, between about 500 V and about 600 V, between about 600 V and about 700 V, between about 700 V and about 800 V, or between about 800 V and about 900 V. In some aspects, the voltage source connected to the electrostatic lens is sufficient to maintain the electrostatic lens at an electrical potential between 100 V and 200 V, between 200 V and 300 V, between 300 V and 400 V, between 400 V and 500 V, between 500 V and 600 V, between 600 V and 700 V, between 700 V and 800 V, or between 800 V and 900 V.

In some aspects, the interface comprises a vacuum port in the outer surface configured to connect to a vacuum source. In some aspects, the outer surface allows for the air pressure of the substantially enclosed inner space to be reduced by means of the vacuum source connected to the vacuum port in the outer surface. In some aspects, the vacuum source is sufficient to reduce the air pressure in the substantially enclosed inner space to below atmospheric air pressure. In some aspects, the vacuum source is sufficient to reduce to the air pressure in the substantially enclosed inner space to less than 1 Torr, less than 2 Torr, less than 3 Torr, less than 4 Torr, less than 5 Torr, less than 6 Torr, less than 7 Torr, less than 8 Torr, less than 9 Torr less than 10 Torr, less than 50 Torr, or less than 100 Torr.

In some aspects, the interface comprises an aperture in the outer surface. In some aspects the aperture is configured to allow droplets passing through the capillary inlet and the electrostatic lens to pass through the aperture. In some aspects the aperture is configured to allow a sample or an analyte passing through the capillary inlet and the electrostatic lens to pass through the aperture. In some aspects, the aperture is configured to deliver an analyte exiting the interface to another vacuum region. In some aspects, the aperture is configured to deliver an analyte exiting the interface to an analysis instrument. In some aspects, the aperture is configured to deliver an analyte exiting the interface to a mass spectrometer. In some aspects, the aperture is configured to deliver an analyte exiting the interface to a time-of-flight mass spectrometer, a quadrupole mass spectrometer, an ion trap mass spectrometer, a linear ion trap mass spectrometer, an orbitrap mass spectrometer, a magnetic sector mass spectrometer, an ion cyclotron resonance mass spectrometer, an ion mobility spectrometer, or a variant thereof, or a combination thereof. In some aspects, the aperture is configured to deliver an analyte exiting the interface to a gas chromatographer.

In a representative aspect, the present application provides interfaces for coupling a microfluidic droplet source to a mass spectrometer comprising: an outer surface providing a substantially enclosed inner space; a capillary inlet configured to allow the passage of droplets into the substantially enclosed inner space; a port transparent to laser light disposed on the outer surface; a laser configured to pass light through the port into the substantially enclosed inner space; a tube lens, disposed within the substantially enclosed inner space, coated with a substance that reflects light comprising: a main axis; a plurality of connected sides parallel to the main axis; and an optical lens at angle other than parallel to the main axis, wherein the tube lens is configured to reflect the laser light off of the lens and through the tube lens bouncing a plurality of times off of the plurality of sides of the tube lens; a voltage source connected to the capillary; a voltage source connected to the tube lens; a vacuum port in the outer surface configured to connect to a vacuum source; and an aperture in the outer surface configured to allow the passage of droplets through the capillary inlet and tube lens In a representative aspect, the present application also provides interfaces for coupling a microfluidic droplet source to a mass spectrometer comprising: an outer surface providing a substantially enclosed inner space; a capillary inlet configured to allow the passage of droplets into the substantially enclosed inner space; a voltage source connected to the capillary; a vacuum port in the outer surface configured to connect to a vacuum source; and an aperture in the outer surface configured to allow the passage of droplets through the capillary inlet.

In various aspects, the present disclosure provides an interface for coupling a droplet source to an analytical instrument, the interface comprising: an outer surface, having a proximal end and a distal end, providing a substantially enclosed inner space; an inlet to the substantially enclosed inner space, the inlet disposed on the proximal end of the outer surface; an electrostatic lens disposed within the substantially enclosed inner space and between the proximal end and distal end of the outer surface; a vacuum port in the outer surface configured to connect to a vacuum source; and an aperture disposed on the distal end of the outer surface, wherein the interface is configured to allow the passage of a droplet comprising an analyte through the inlet and into the substantially enclosed inner space, and wherein the interface is configured to allow the analyte to pass through the electrostatic lens and into the analytical instrument.

In some aspects, the inlet comprises an opening, wherein the opening has a smallest dimension of between about 0.1 millimeters and about 0.5 millimeters, between about 0.5 millimeters and about 1 millimeter, between about 1 millimeter and about 5 millimeters, or between about 5 millimeters and about 20 millimeters.

In other aspects, the inlet comprises a material selected from a metal, a glass or a combination thereof.

In further aspects, the interface further comprises a voltage source, wherein the voltage source is in electrical communication with the inlet, the electrostatic lens or a combination thereof.

In other aspects, the interface further comprises a light port disposed on the outer surface, wherein the light port is transparent to light. In further aspects, the light port comprises a material selected from ZnSe, $BaF_2$, KBr, CsI, KCl, CdTe, $CaF_2$, GaAs, NaCl, Ge, LiF, $SiO_2$, TlBr, ZnS, $Ge_{33}As_{12}Se_5$ or a combination thereof.

In further aspects, the interface further comprises a light source, wherein the light source is configured to pass light through the light port and into the electrostatic lens. In some aspects, the light source emits infrared light. In other aspects, the intensity of light emitted from the light source is sufficient to substantially evaporate a liquid droplet passing through the substantially enclosed inner space.

In some aspects, the electrostatic lens further comprises a light-reflective substance, wherein the light-reflective substance comprises a material selected from Au, Ag, a dielectric mirror material or a combination thereof. In other aspects, the electrostatic lens comprises an optical lens, a mirror or a combination thereof. In some aspects, the electrostatic lens comprises a tube lens.

Systems for Performing Assays Using Double Emulsions

The present disclosure provides systems for performing assays using double emulsion droplets. In some aspects, the analytical system comprises a droplet source and an interface for coupling the droplet source to an analytical instrument. In some aspects the droplet source is a microfluidic device for generating double emulsions, as described above. In some aspects, the interface is an interface for coupling a droplet source to an analytical instrument, as described above. In some aspects, the system comprises a droplet source comprising a droplet emitter and an interface comprising a capillary inlet configured to allow the passage of droplets emitted by the emitter.

Figure 6A:
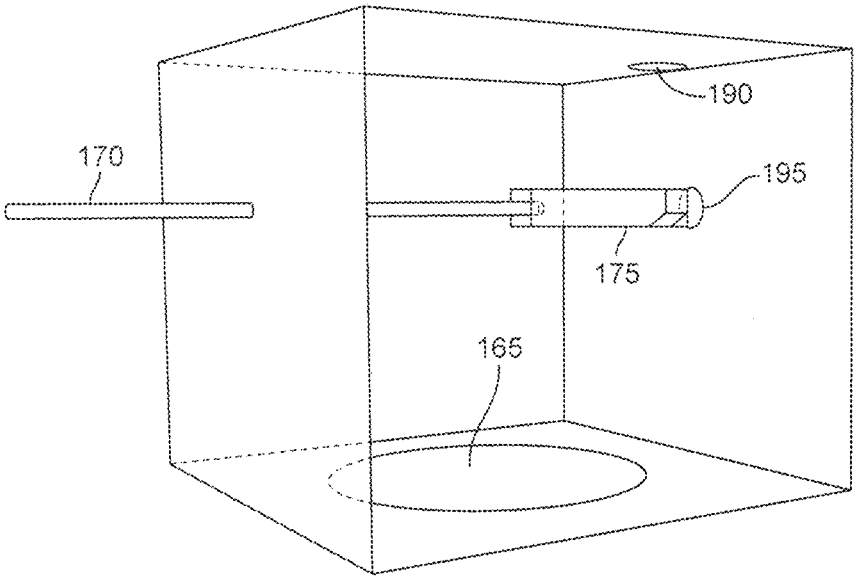
FIG. 6A shows a schema of the interface for coupling of droplet microfluidics with mass spectrometry, including a capillary inlet (glass lined capillary) 170, an ISO-K 63 vacuum port 165, a ZnSe infrared transparent laser port 190, a gold-lined rectangular tube lens 175 (see FIG. 8 for details) and an aperture to the next vacuum region 195.

In some aspects, continuous streams of separated immiscible liquid phase compartments (e.g., water and fluorinated oil, FIG. 7) are generated in a microfluidic device which is realized as a PDMS chip (D. Liu, B. Hakimi, M. Volny, J. Rolfs, X. Chen, F. Turecek, D. T. Chiu, Anal. Chem. 2013, 85, 6190-6194) or a fused silica capillary T-junction. The stream is converted to droplets and flown into the vacuum system. The droplets are evaporated by multi-pass laser beam in an IR-reflective electrostatic tube (FIG. 8), the contents of the aqueous compartments are ionized, and ions are transferred to the high-vacuum region and mass analyzed in a mass spectrometer. In certain embodiments the mass spectrometer is a reflectron time-of-flight mass spectrometer. The oil phase is vaporized and pumped out before reaching the mass spectrometer. To accomplish these operations, the mass spectrometer for the detection of segmented flow compartments can be furnished with a vacuum manifold specifically designed for interfacing the droplets with the high-vacuum system. In some aspects, a commercially available mass spectrometer, such as a LCT Premier ESI-TOF mass spectrometer (Waters), can be modified to accommodate the new manifold. A schematic drawing of the new interface is shown in FIG. 6A.

In some aspects, the system comprises a vacuum region abutting the aperture on the outer surface of the interface. In some aspects, the vacuum source is sufficient to reduce to the air pressure in the vacuum region to less than 1 Torr, less than 2 Torr, less than 3 Torr, less than 4 Torr, less than 5 Torr, less than 6 Torr, less than 7 Torr, less than 8 Torr, less than 9 Torr, less than 10 Torr, less than 50 Torr, or less than 100 Torr.

In some aspects, the system comprises an ionization source configured to ionize an analyte. In some aspects the ionization source is configured to perform soft ionization. In some aspects the ionization source is configured to cause little or no fragmentation of an analyte. In some aspects the ionization source comprises electrospray ionization, matrix assisted laser desorption ionization, soft laser desorption, chemical ionization, atmospheric pressure chemical ionization, fast atom bombardment, or a variant thereof, or a combination thereof.

In some aspects the system comprises a mass spectrometer configured to accept the ionized analyte. In some aspects, the system comprises a time-of-flight mass spectrometer, a quadrupole mass spectrometer, an ion trap mass spectrometer, a linear ion trap mass spectrometer, an orbitrap mass spectrometer, a magnetic sector mass spectrometer, an ion cyclotron resonance mass spectrometer, an ion mobility spectrometer, a gas chromatographer, or a variant thereof, or a combination thereof. In some aspects the system comprises an analytical instrument.

In some aspects, the system comprises a mass spectrometer that measures the mass spectrum of an analyte. In some aspects, the analyte comprises ions and the mass spectrum of the analyte characterizes the mass-to-charge ratio of the ions. In some aspects, the mass spectrum of the analyte can be used to determine the identity of the analyte.

In some aspects, the system comprises a time-of-flight mass spectrometer, in which the mass-to-charge ratios of the ions are determined using a time measurement. In some aspects, the ions are accelerated by an electric field and the velocity of each ion depends on its mass-to-charge ratio. In some aspects, the time-of-flight mass spectrometer will measure the time that it takes for an ion to reach a detector, and calculate the mass-to-charge ratio of the ion from this measurement.

In some aspects, the system comprises a quadrupole mass spectrometer. In some aspects, the quadrupole mass spectrometer comprises four parallel metal rods, wherein each opposing rod is connected together electrically, and a radio frequency voltage is applied between one pair of rods and the other. In some aspects, a direct current voltage is then superimposed on the radio frequency voltage. In some aspects, ions travel down the quadrupole between the rods. In some aspects, only ions of a certain mass-to-charge ratio will reach the detector for a given ratio of voltages, allowing identification of ions according to their mass-to-charge ratios.

In some aspects, the system comprises an ion trap mass spectrometer. In some aspects, the ion trap mass spectrometer uses an electric field to separate ions by their mass-to-charge ratios. In some aspects, the ion trap mass spectrometer comprises a ring electrode of a specific voltage and grounded end cap electrodes. In some aspects, ions enter an area between the electrodes through one of the end caps and an electric field produced by the electrodes causes ions to orbit in the area. As the radio frequency voltage increases, heavier mass ion orbits become more stabilized and the light mass ions become less stabilized, causing them to collide with the wall, and eliminating the possibility of traveling to and being detected by a detector. In some aspects, the ion trap mass spectrometer selectively detects trapped ions in order of increasing mass by gradually increasing the applied radio frequency voltage.

In some aspects, the system comprises a linear ion trap mass spectrometer. In some aspects, the linear ion trap mass spectrometer operates similarly to an ion trap mass spectrometer, except that it uses a two-dimensional electric field instead of a three-dimensional electric field.

In some aspects, the system comprises an orbitrap mass spectrometer. In some aspects the orbitrap mass spectrometer comprises an outer barrel-like electrode and a coaxial inner spindle-like electrode that that traps ions in an orbital motion around the spindle. In some aspects, ions entering the electric field of the orbitrap mass spectrometer move with different rotational frequencies, such that ions of a specific mass-to-charge ratio spread into rings that can be differentiated.

In some aspects, the system comprises a magnetic sector mass spectrometer. In some aspects, different ion species entering a magnetic field generated within the magnetic sector mass spectrometer will separate physically in space into different beams.

In some aspects, the system comprises an ion cyclotron resonance mass spectrometer. In some aspects the ion cyclotron resonance mass spectrometer uses a magnetic field to trap ions into an orbit inside of it. In some aspects, the magnetic field is held constant so that the frequency of the orbit depends only on the charge and mass of the ions, and the mass-to-charge ratio of each ion can be determined from the angular velocity of the ion.

In some aspects, the system comprises an ion mobility spectrometer. In some aspects, ions entering the ion mobility spectrometer travel through a drift tube which has an applied electric field and a carrier buffer gas that opposes the motion of the ions. At the end of the tube is a detector. The migration time of an ion through the tube is determined by the ion's distinct mass, charge, size and shape, allowing the ion mobility spectrometer to identify each ion according to its migration time, or ion mobility.

In some aspects, the analyte comprises ions and the ion mobility spectrum of the analyte characterizes the mobility of the ions. In some aspects, the ion mobility spectrum of the analyte can be used to determine the identity of the analyte.

In some aspects, the system comprises a gas chromatographer. In some aspects, an analyte entering the gas chromatographer is heated and vaporized at an injection port, and then transported through a column by an inert gas. In some aspects, components of an analyte are isolated and/or identified based on their boiling points and on their relative affinity for a stationary phase, such as a viscous liquid present within the column. In some aspects, the distinct components of the analyte are detected and represented as peaks on a chromatogram. In some aspects, the chromatogram can be used to identify the analyte.

Other analytical instruments, including but not limited to other mass spectrometers, will occur to one of ordinary skill in the art for use with the systems, methods, and devices disclosed herein. Because advances in analytical instruments in general and mass spectrometers in particular are frequent, the descriptions of analytical instruments such as mass spectrometers contained herein are intended only as examples for purposes of illustrating an embodiment of an analytical instrument. Many other types, configurations, variants, or combinations of analytical instruments are possible and can be incorporated for use with the systems, methods, and devices disclosed herein.

In some aspects, aqueous droplets enter the mass spectrometer. In some aspects, the aqueous droplets comprise an analyte. In some aspects, the diameters of the aqueous droplets introduced into the mass spectrometer or interface can be in the range of 1-1000 microns, but preferably in the 20-100 microns in diameter. Such droplets are in a range suitable for single-cell analysis. In some aspects, the diameter of an aqueous droplet entering the mass spectrometer or other analytical instrument is less than 10 microns, less than 20 microns, less than 30 microns, less than 40 microns, less than 50 microns, less than 60 microns, less than 70 microns, less than 80 microns, less than 90 microns, less than 100 microns, less than 200 microns, less than 300 microns, less than 400 microns, less than 500 microns, less than 600 microns, less than 700 microns, less than 800 microns, less than 900 microns, or less than 1000 microns. In other aspects, an analyte that is not contained in a droplet enters the mass spectrometer, such as an analyte that enters the mass spectrometer after the liquid droplet that contained the analyte has already evaporated. In some aspects, the analytical system is configured to ionize and measure a plurality of analytes, such as a plurality of analytes in a sample.

In some aspects, the system provides a computer comprising a processor and a memory device with instructions stored thereon, the instructions comprising executable commands that, when executed, cause the processor to operate an analytical instrument to measure an ionized analyte, store the measurements and analyze the measurements. In some aspects the analytical instrument is a mass spectrometer and the commands when executed cause the processor to operate the mass spectrometer to measure the mass spectrum of the analyte, the ion mobility spectrum of the analyte, or a combination thereof, store the mass spectrum, ion mobility spectrum, or combination thereof and analyze the measured mass spectrum, ion mobility spectrum, or combination thereof. In some aspects, the processor is configured to analyze the measured mass spectrum, ion mobility spectrum, or combination thereof to determine the identity of the ionized analyte. In some aspects, the processor is configured to analyze a measurement obtained from a plurality of analytes.

Examples of a processor include, but are not limited to, a personal computing device that stores information acquired by an analytical instrument such as a mass spectrometer, and software running on the personal computing device that processes the information. In some aspects, an information processor or component thereof can be embedded in an analytical instrument, such as in a chip integrated into a mass spectrometer that stores information acquired by the mass spectrometer either permanently or temporarily. In other aspects, an information processor and an analytical instrument can be components of a fully integrated device that both acquires and stores information, such as the mass spectrum of an ionized sample or analyte.

In some aspects, the system provides a computer-readable storage medium for acquiring, storing and analyzing a measurement. The computer-readable storage medium has stored thereon instructions that, when executed by one or more processors of a computer, cause the computer to: operate an analytical instrument to acquire a measurement, store the measurement, and analyze the measurement. In some aspects, the computer analyzes the mass and/or charge of an ionized analyte. In some aspects, the computer analyzes the measurement to detect and/or determine the concentration of a target analyte of interest in a sample. In some aspects, the computer analyzes measurements obtained from a plurality of analytes.

In various aspects, the present disclosure provides a mass spectrometry system comprising: a microfluidic device configured to generate a droplet, wherein the droplet comprises a double emulsion and an analyte; an interface configured to receive the droplet from the microfluidic device; and a mass spectrometer configured to receive the analyte from the interface In some aspects, the system further comprises a vacuum region configured to receive the droplet from the interface and configured to deliver the droplet to the mass spectrometer. In other aspects, the system further comprises an ionization source configured to ionize the analyte.

In some aspects, the mass spectrometer is a time-of-flight (TOF) mass spectrometer, a quadrupole mass spectrometer, an ion trap mass spectrometer, a linear ion trap mass spectrometer, an orbitrap mass spectrometer, a magnetic sector mass spectrometer, an ion cyclotron resonance mass spectrometer, an ion mobility spectrometer, or a combination thereof.

In some aspects, the system further comprises a computer comprising a processor and a memory device with instructions stored thereon, the instructions comprising executable commands that, when executed, cause the processor to: operate the mass spectrometer to measure the mass spectrum of the analyte, the ion mobility spectrum of the analyte, or a combination thereof. store the measured mass spectrum, ion mobility spectrum or combination thereof; and analyze the measured mass spectrum, ion mobility spectrum or combination thereof to determine the identity of the analyte.

In various aspects, the present disclosure provides a method for producing a droplet, the method comprising: generating an electric field between a first electrode and a second electrode, wherein the first electrode is in electrical communication with a first fluidic channel and wherein the second electrode is contacted with a gas; flowing a first liquid through the first fluidic channel; flowing a second liquid through a second fluidic channel, wherein the second liquid is immiscible with the first liquid, and wherein the second fluidic channel is in fluidic communication with the first fluidic channel; contacting the first fluid with the second fluid at the junction of the first channel and the second channel; generating a discrete partition of the first liquid surrounded at least in part by the second liquid; flowing the discrete partition through a droplet emitter, the droplet emitter comprising a proximal end and a distal end, wherein the proximal end is in fluidic communication with the first channel and the distal end is contacted with the gas; and producing a droplet from the distal end of the droplet emitter, wherein the droplet is contacted with the gas, and wherein the droplet and gas together comprise a double emulsion.

In some aspects, the first liquid comprises an analyte.

In various aspects, the present disclosure provides a method for performing mass spectrometry, the method comprising: contacting a first liquid comprising an analyte with a second liquid, wherein the second liquid is immiscible with the first liquid; generating a discrete partition of the first liquid surrounded at least in part by the second liquid; applying an electric force to the discrete partition, thereby producing a droplet comprising a double emulsion and the analyte; evaporating the first liquid of the droplet, the second liquid of the droplet, or a combination thereof; ionizing the analyte; transporting the analyte to a mass spectrometer; and obtaining the mass spectrum of the analyte, the ion mobility spectrum of the analyte, or a combination thereof.

In some aspects, the second liquid comprises an oil. In further aspects, the boiling point of the second liquid is less than 250° C., less than 200° C., less than 150° C., less than 100° C. or less than 50° C. In other aspects, the second liquid has a vapor pressure higher than 5 Torr, higher than 15 Torr, higher than 25 Torr, higher than 35 Torr, higher than 45 Torr, higher than 55 Torr, higher than 65 Torr, higher than 75 Torr, higher than 85 Torr, higher than 95 Torr, higher than 105 Torr, higher than 115 Torr, higher than 125 Torr, higher than 1355 Torr, higher than 145 Torr, higher than 155 Torr, higher than 165 Torr, higher than 175 Torr, higher than 185 Torr, higher than 195 Torr, or higher than 205 Torr at room temperature. In further aspects, the second liquid comprises a liquid selected from a hydrocarbon-based liquid, a fluorocarbon-based liquid, a silicone-based liquid or a combination thereof. In further aspects, the second liquid comprises a liquid selected from a mineral oil, a vegetable oil, a silicone oil, a fluorinated oil, a fluorinated alcohol, a Fluorinert, a Tegosoft, a perfluorinated ester, a perfluorinated ether or a combination thereof.

In some aspects, one or both of the first liquid or the second liquid comprises a surfactant.

In other aspects, the method further comprises the use of a plurality of inner droplets comprising the first liquid, wherein the plurality of inner droplets is positioned within an outer droplet comprising the second liquid. In some aspects, the diameter of at least one inner droplet is between 5 microns and 15 microns, between 10 microns and 30 microns, between 20 microns and 40 microns, between 30 microns and 50 microns, between 40 microns and 60 microns, between 50 microns and 70 microns, between 60 microns and 80 microns, between 70 microns and 90 microns, between 80 microns and 100 microns, between 90 microns and 110 microns, between 100 microns and 300 microns, between 200 microns and 400 microns, between 300 microns and 500 microns, between 400 microns and 600 microns, between 500 microns and 700 microns, between 600 microns and 800 microns, between 700 microns and 900 microns, or between 800 microns and 1000 microns.

In some aspects, the order of the ionizing, the evaporating and the transporting is interchangeable.

In various aspects, the present disclosure provides a method for performing mass spectrometry, the method comprising: flowing a first liquid through a fluidic channel, the liquid comprising an analyte; flowing the first liquid through a droplet emitter, the droplet emitter comprising a proximal end and a distal end, wherein the proximal end is in fluidic communication with the channel and the distal end is contacted with a gas; applying an electric force to the first liquid, thereby producing a droplet comprising the liquid and the analyte; ionizing the analyte; transporting the analyte to a mass spectrometer; and obtaining the mass spectrum of the analyte, the ion mobility spectrum of the analyte, or a combination thereof.

In some aspects, the first liquid is aqueous.

In other aspects, the analyte is selected from a small molecule, a polynucleotide, a polypeptide, a lipid, a carbohydrate, a metabolite, a drug, a cell, a cell lysate, a virus, a polymer or a combination thereof. In some aspects, the analyte comprises a protein.

In further aspects, the diameter of the droplet is between 5 microns and 15 microns, between 10 microns and 30 microns, between 20 microns and 40 microns, between 30 microns and 50 microns, between 40 microns and 60 microns, between 50 microns and 70 microns, between 60 microns and 80 microns, between 70 microns and 90 microns, between 80 microns and 100 microns, between 90 microns and 110 microns, between 100 microns and 300 microns, between 200 microns and 400 microns, between 300 microns and 500 microns, between 400 microns and 600 microns, between 500 microns and 700 microns, between 600 microns and 800 microns, between 700 microns and 900 microns, or between 800 microns and 1000 microns.

In some aspects, the method further comprises producing a plurality of droplets. In further aspects, the droplets are produced at a rate between about 1 Hz and about 10 Hz, between about 10 Hz and about 100 Hz, between about 100 Hz and about 1000 Hz or between about 1000 Hz and about 10,000 Hz.

In some aspects, the mass spectrometer is a time-of-flight (TOF) mass spectrometer, a quadrupole mass spectrometer, an ion trap mass spectrometer, a linear ion trap mass spectrometer, an orbitrap mass spectrometer, a magnetic sector mass spectrometer, an ion cyclotron resonance mass spectrometer, an ion mobility spectrometer or a combination thereof.

In certain aspects, the method further comprises electronically storing the measured mass spectrum, ion mobility spectrum, or combination thereof; and analyzing the measured mass spectrum, ion mobility spectrum, or combination thereof to determine the identity of the analyte.

In some aspects, the applying the electric force comprises generating an electrical potential, wherein the electrical potential is between about 10 V and about 100 V, between about 100 V and about 500 V, between about 500 V and about 1000 V, between about 1000 V and about 1500 V, between about 1500 V and about 2000 V, between about 2000 V and about 2500 V, between about 2500 V and about 3000 V, between about 3000 V and about 3500 V, between about 3500 V and about 4000 V, between about 4000 V and about 4500 V, or between about 4500 V and about 5000 V.

In further aspects, the ionizing the analyte comprises generating an electrical potential, wherein the electrical potential is between about 50 V and about 100 V, between about 100 V and about 500 V, between about 500 V and about 1000 V, or between about 1000 V and about 5000 V.

In some aspects, the method further comprises using a vacuum to lower the pressure experienced by the droplet to less than 1 Torr, less than 5 Torr, less than 10 Torr, less than 50 Torr, or less than 100 Torr.

In other aspects, the order of the ionizing and transporting is interchangeable.

In some aspects, a computer can be used to perform the methods described herein. In various aspects, a computer can be used to implement any of the systems or methods illustrated and described above. In some aspect, a computer can include a processor that communicates with a number of peripheral subsystems via a bus subsystem. These peripheral subsystems can include a storage subsystem, comprising a memory subsystem and a file storage subsystem, user interface input devices, user interface output devices, and a network interface subsystem.

In some aspects, a bus subsystem provides a mechanism for enabling the various components and subsystems of the computer to communicate with each other as intended. The bus subsystem can include a single bus or multiple busses.

In some aspects, a network interface subsystem provides an interface to other computers and networks. The network interface subsystem can serve as an interface for receiving data from and transmitting data to other systems from a computer. For example, a network interface subsystem can enable a computer to connect to the Internet and facilitate communications using the Internet.

In some aspect, the computer includes user interface input devices such as a keyboard, pointing devices such as a mouse, trackball, touchpad, or graphics tablet, a scanner, a barcode scanner, a touch screen incorporated into the display, audio input devices such as voice recognition systems, microphones, and other types of input devices. In general, use of the term "input device" is intended to include all possible types of devices and mechanisms for inputting information to a computer.

In some aspect, the computer includes user interface output devices such as a display subsystem, a printer, a fax machine, or non-visual displays such as audio output devices, etc. The display subsystem can be a cathode ray tube (CRT), a flat-panel device such as a liquid crystal display (LCD), or a projection device. In general, use of the term "output device" is intended to include all possible types of devices and mechanisms for outputting information from a computer.

In some aspects, the computer includes a storage subsystem that provides a computer-readable storage medium for storing the basic programming and data constructs. In some aspects, the storage subsystem stores software (programs, code modules, instructions) that when executed by a processor provides the functionality of the methods and systems described herein. These software modules or instructions can be executed by one or more processors. A storage subsystem can also provide a repository for storing data used in accordance with the present invention. The storage subsystem can include a memory subsystem and a file/disk storage subsystem.

In some aspects, the computer includes a memory subsystem that can include a number of memories including a main random access memory (RAM) for storage of instructions and data during program execution and a read only memory (ROM) in which fixed instructions are stored. A file storage subsystem provides a non-transitory persistent (non-volatile) storage for program and data files, and can include a hard disk drive, a floppy disk drive along with associated removable media, a Compact Disk Read Only Memory (CD-ROM) drive, an optical drive, removable media cartridges, and other like storage media.

The computer can be of various types including a personal computer, a portable computer, a workstation, a network computer, a mainframe, a kiosk, a server or any other data processing system. Due to the ever-changing nature of computers and networks, the description of computer contained herein is intended only as a specific example for purposes of illustrating the embodiment of the computer. Many other configurations having more or fewer components than the system described herein are possible.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings and/or examples making apparent to those skilled in the art how the several forms of the invention may be embodied in practice. The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary, 3rd Edition or a dictionary known to those of skill in the art, such as the Oxford Dictionary of Biochemistry and Molecular Biology (Ed. Anthony Smith, Oxford University Press, Oxford, 2004).

As used herein and unless otherwise indicated, the terms "a" and "an" are taken to mean "one," "at least one" or "one or more." Unless otherwise required by context, singular terms used herein shall include pluralities and plural terms shall include the singular.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to."

Words using the singular or plural number also include the plural and singular number, respectively. Additionally, the words "herein," "above," and "below" and words of similar import, when used in this application, shall refer to this application as a whole and not to any particular portions of the application.

EXAMPLES

The following examples are included to further describe some aspects of the present invention, and should not be used to limit the scope of the invention

Example 1

Generation of Double Emulsions

This example describes a method for the generation of double emulsions according to an aspect of the present disclosure.

Imaging and Analysis

A high-speed CCD camera (GC640, allied Vision Technologies Inc., Canada) was used to record the process of double emulsions generation. Brightfield images of double emulsions collected in vials were acquired with an Olympus MVX10 microscope (Tokyo, Japan), along with a CCD camera (GC1380, allied Vision Technologies Inc., Canada). Images were analyzed using Image J (NIH).

Figure 1B:
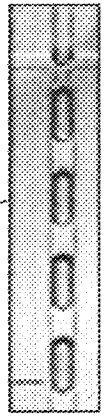
FIG. 1B depicts a micrograph showing generation of aqueous droplets in the flow focusing channel. The scale bar represents 50 μm.
Figure 1E:
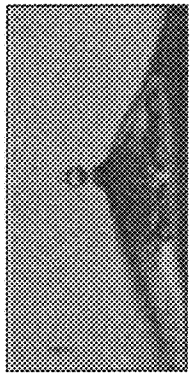
FIG. 1E shows a micrograph of the PDMS emitter. The scale bar represents 100 μm.
Figure 1D:
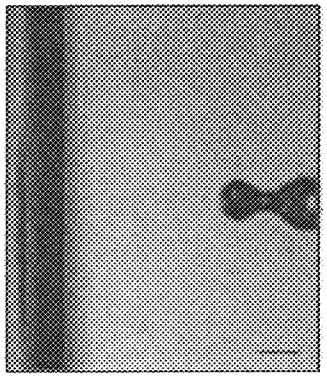
FIG. 1D shows a micrograph of copper plate, polydimethylsiloxane (PDMS) emitter, and the formation of double emulsion in air. The scale bar represents 100 μm.
Figure 1A:
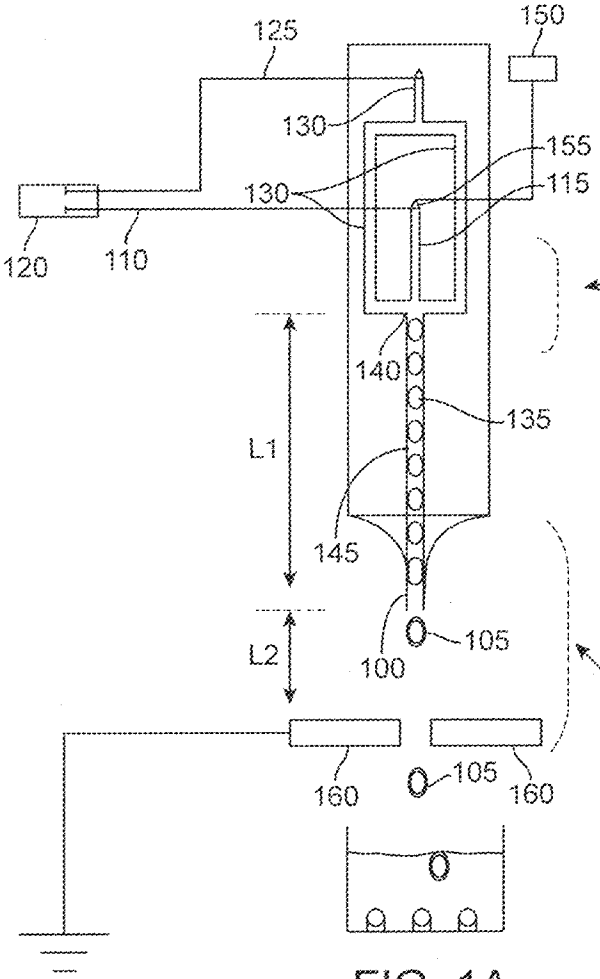
FIG. 1A shows a schematic of an exemplary experimental set up.

FIG. 1A shows the setup and design of the experiment. A PDMS microfluidic chip integrated with a fine droplet emitter 100 was used to produce double emulsion droplets 105 in the gas phase. An aqueous phase 110 flowed into the proximal end of a first channel 115 driven by a pump 120. An oil phase 125 flowed into a second channel 130 driven by the pump. Aqueous droplets 135 were generated in a continuous oil phase at a junction 140 using a flow focusing geometry (see also FIG. 1B). The aqueous droplets flowed down the distal portion 145 of the first channel to the distal end of the first channel, and then encountered the conical PDMS emitter 100 at the outlet. To generate double emulsions in the gas phase, a metal wire from a high voltage power supply 150 was connected to the aqueous phase as a positive (first, working) electrode 155 (inlet to first channel). The ground (second) electrode 160 was a thin copper plate with a small 500 micron diameter hole where the double emulsion droplets passed through. The copper plate and PDMS chip were mounted onto x-y-z translation stages so their relative position can be controlled and adjusted precisely. Typically, the distance between the emitter and the ground (second) copper plate (L2) was around 0.8 millimeter (FIGS. 1A and 1D).

Figure 3A:
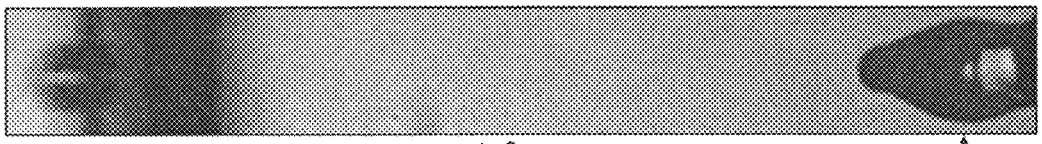
FIG. 3. depicts a series of images showing the generation of double emulsions in air. The solid and dashed arrows point to the front and back ends of the aqueous droplets. Voltage applied, 1.01 kV; oil-phase flow rate, 0.06 μL/min; aqueous-phase flow rate, 0.06 μL/min.
Figure 3B:
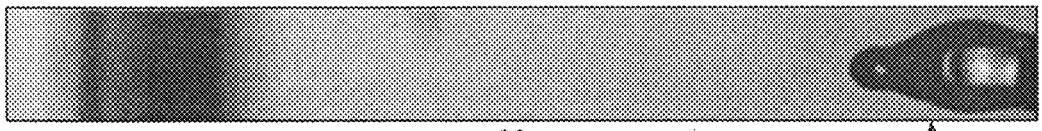
Figure 3C:
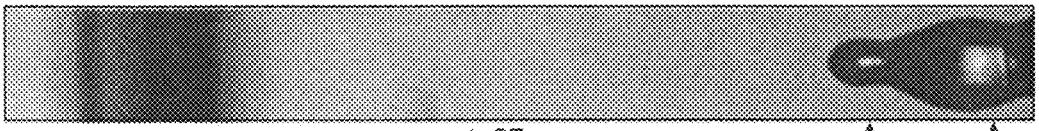
Figure 3D:
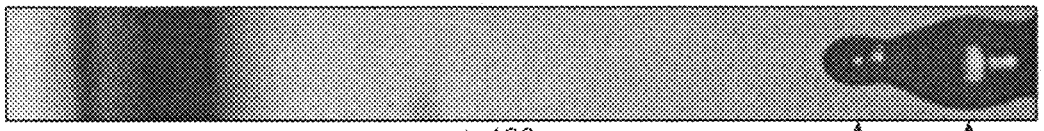
Figure 3E:
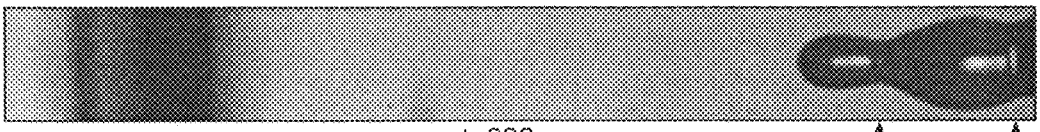
Figure 3F:
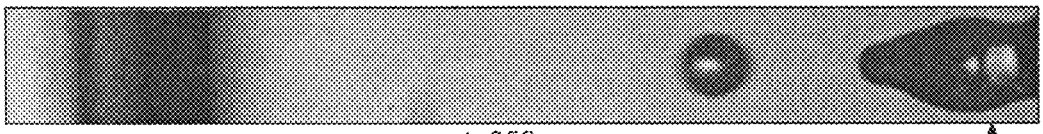

When the high positive voltage was applied to the device, an electric field gradient was present along the first channel. As a result, more negative charges were drawn back to upstream by the positive potential at the end of the first channel, and more positive charges were left in the droplets in the oil phase. Under the applied electric field, octanol also became polarized. Because of the net positive charges in the water droplets and the polarization of the liquids, electric force developed between the droplets and the ground (second) electrode. When the electric field was high enough, double emulsion formed at the emitter tip was ejected toward the copper plate (ground, second electrode). FIGS. 3A-3F are a series of images captured by a high speed camera showing the above described process. The arrows point to the front (solid arrow) and back (dashed arrow) ends of the aqueous droplets. In FIG. 3A, a previous double emulsion droplet just passed through the hole on the copper plate and a new droplet begins to form at the tip. FIGS. 3B-3F show the formation and ejection of a new double emulsion droplet.

Figure 4A:
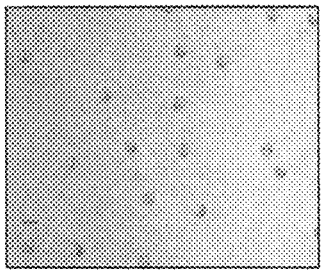
FIGS. 4A-4C show micrographs of double emulsions. Scale bars are 100 microns.
Figure 4B:
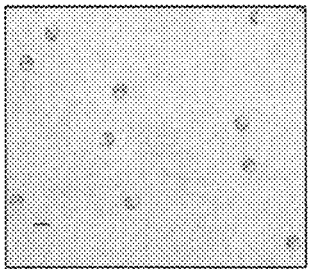
Figure 4C:
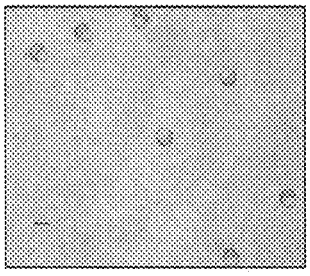
Figure 4D:
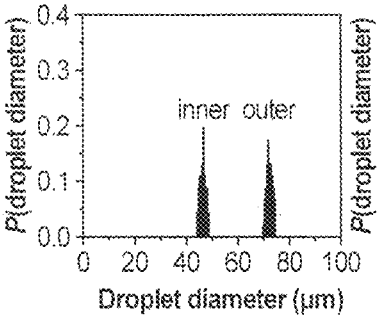
FIGS. 4D and 4F show distributions of the diameters of the inner and outer droplets of the double emulsions.
Figure 4E:
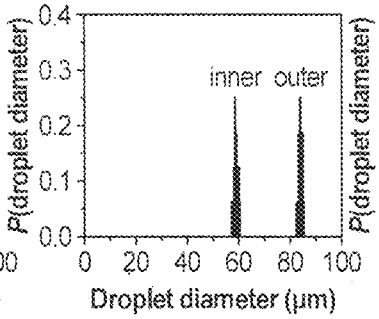
Figure 4F:
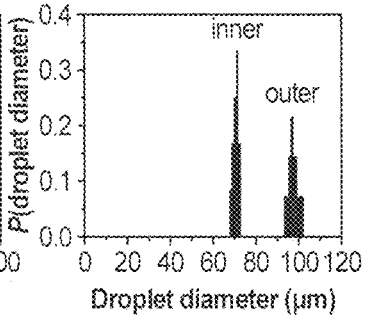
Figure 5:
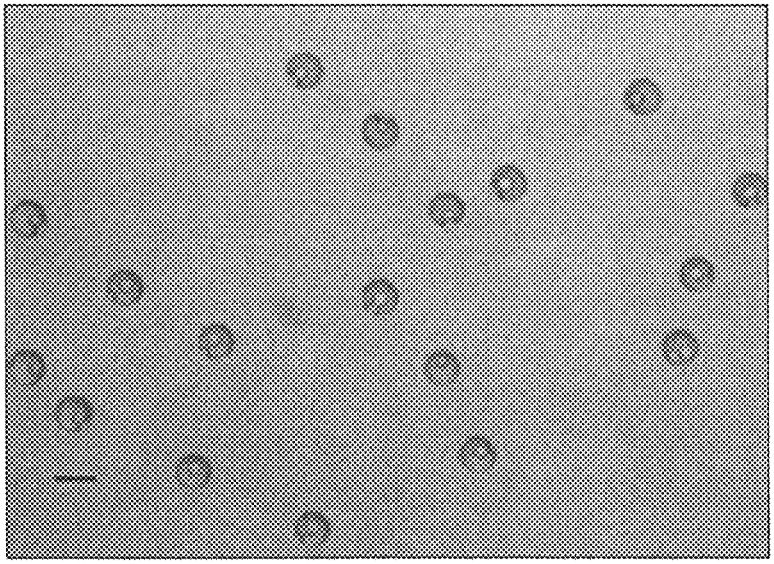
FIG. 5 shows a micrograph of double emulsions encapsulating two small droplets. The aqueous flow rate was 0.1 μL/min, the oil flow rate was 0.8 μL/min and the applied voltage was 1.12 kV. The scale bar represents 100 microns.

A glass vial filled with fluorinated oil was used to collect the ejected double emulsion droplets in order to characterize these droplets. The presence of positive charges on the droplets caused them to repel each other when they landed into the fluorinated oil. Most droplets were observed at the bottom of the vial. To maintain the stability of these droplets in contact with the vial bottom, the surface of the glass vial was treated with trichloro(1,1,2,2-H4-perfluorooctyl)silane. FIGS. 4A-4F show the collected double emulsion droplets at the bottom of the vial, as produced under different flow rates and voltages. To quantify the mono-dispersity of the double emulsions, the distributions of the diameters of the inner and outer droplets were measured FIGS. 4D-4F). It is evident that the distributions of droplet diameter are very narrow; the standard deviation is below 4% of the mean diameter in each of FIGS. 4D-4F. In addition, by changing the voltage, successive double emulsions encapsulating two, three, or four small droplets were formed in gas phase. FIG. 5 shows mono-dispersed double emulsions each encapsulating two small droplets inside.

This electrohydrodynamic method allowed for the controlled generation of water-in-oil double emulsions in air using an integrated PDMS emitter tip. This integrated emitter tip minimized issues associated with dead volume, which is often encountered when coupling microfluidic chips to an external emitter. Using this technique, droplets were able to be generated at a frequency range suitable for interfacing with MS and over a droplet size range tailored for single-cell analysis. Because this approach encapsulates preformed aqueous droplets, it allows the employment of droplet microfluidics for various droplet manipulations prior to the generation of double emulsions and introduction into the MS instrument. The double emulsions formed using this method are mono-disperse with the added flexibility of allowing us to control the number of aqueous droplets encapsulated per oil droplet. This method is a useful for coupling droplet microfluidics to mass spectrometers for sensitive droplet analysis.

Example 2

Fabrication of the Emitter

This example describes a method for the fabrication of an emitter according to an aspect of the present disclosure.

Materials and Supplies 1-octanol, trichloro(1,1,2,2-H4-perfluorooctyl)silane, Span 80 and fluorinated oil (FC-40) were purchased from Sigma-Aldrich. Metal wires (with 40 μm diameter) used as emitter molds were obtained from SANDVIK Company.

Fabrication of Microfluidic Device and Emitter Tip

Microfluidic channels were fabricated in PDMS using standard soft lithography method, which has been described in detail elsewhere (McDonald, J. C.; Duffy, D. C.; Anderson, J. R.; Chiu, D. T.; Wu, H.; Schueller, O. J. A.; Whitesides, G. M. Electrophoresis 2000, 21, 27-40). Briefly, Su8-2025 photoresist (MicroChem) was spin-coated onto a silicon wafer to form a film with desired thickness, as measured by a home-built interferometer on the finished master (Yen, G. S.; Fujimoto, B. S.; Schneider, T.; Huynh, D. T. K.; Jeffries, G. D. M. Chiu, D. T., Lab Chip 2011, 11, 974-977). To fabricate the microfluidic chip, the mixer of PDMS base and curing agent (10:1; Sylgard 184, Dow Corning, MI) was poured onto the master, degassed for 30 minutes, and then cured overnight in the oven at 70° C. After curing, the PDMS channel was peeled off the master and exposed to oxygen plasma, along with another piece of flat PDMS plate without molded structures. The PDMS channel then was sealed irreversibly against the flat PDMS plate. All the channels were 38 μm in height.

The geometry and surface chemistry of the emitter is crucial for the generation of a double emulsion. The present disclosure provides a polymer molding method to fabricate a fine conically shaped integrated emitter in PDMS chip FIG. 2A-2F). Briefly, a metal wire (the surface treated with perfluorosilane) was inserted into the first channel (see also FIG. 1A-1E) as an emitter mold, and freshly mixed PDMS solution was then dipped around it with a small pointed tip (FIG. 2D). After PDMS was cured, the metal wire was pulled out, and an integrated PDMS emitter was formed. FIG. 1E shows an image of the resulting PDMS emitter.

Surface Treatment

PDMS channel and emitter were treated with trichloro(1,1,2,2-H4-perfluorooctyl) silane to make their surface fluorophilic. 1-octanol and Milli-Q water were used as continuous phase and disperse phase, respectively. In order to make water droplets more stable, 1 wt % Span80 surfactant was added to octanol. Due to the desirable surface treatment, the adhesion of water and octanol on the emitter tip was significantly diminished.

Figure 2A:
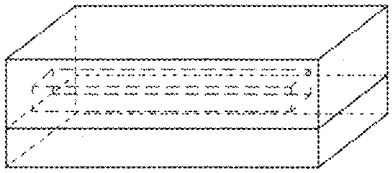
FIGS. 2A-2F depict a schematic showing the fabrication of the integrated PDMS emitter.
Figure 2B:
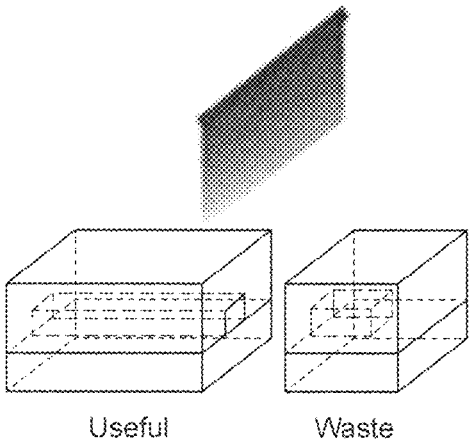
Figure 2C:
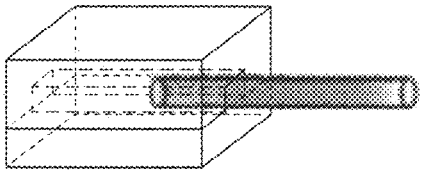
Figure 2D:
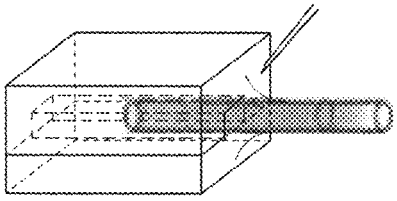
Figure 2E:
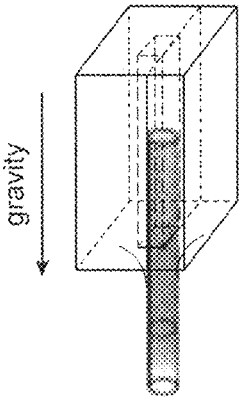
Figure 2F:
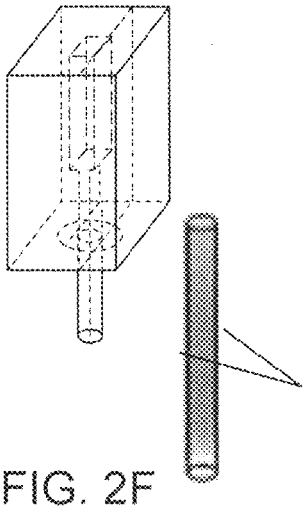

FIGS. 2A-2F show the fabrication of the emitter in the PDMS chip. Step 1: Fabrication of a PDMS top layer molded with flow focusing channels using soft lithography and rapid prototyping. The channels were sealed with a flat PDMS layer (FIG. 2A; here, only a part of the first channel (see FIGS. 1A-1E) is shown for simplicity). Step 2: Cutting of the chip vertically into two parts using a sharp blade such that the end of the first channel was exposed (FIG. 2B). Step 3: Insertion of a hard metal wire with the desired diameter (40 microns) into the exposed end of the first channel under a microscope (FIG. 2C). Step 4: Depositing of a small amount of uncured PDMS onto the metal wire and the peripheral PDMS surface surrounding the metal wire with a small pointed tip (FIG. 2D). Step 5: Turning of the whole chip from the horizontal to the vertical direction, and moving the chip into an oven at 110° C. (FIG. 2E). Once cured, the polymer adhered onto the side-wall where the first channel outlet was, and formed a steep cone with the metal wire at its center. Step 6: Removal of the chip from the oven and cooling to room temperature, after which tweezers are used to remove the wire from the first channel along the channel direction. The resulting integrated emitter had an inner diameter of 40 microns (FIG. 2F).

Example 3

Droplet Formation, Delivery to Mass Spectrometer Interface and Analysis

This example describes droplet formation and delivery to a mass spectrometer interface and subsequent analysis by mass spectrometer according to an aspect of the present disclosure.

Microfluidics

Figure 7:
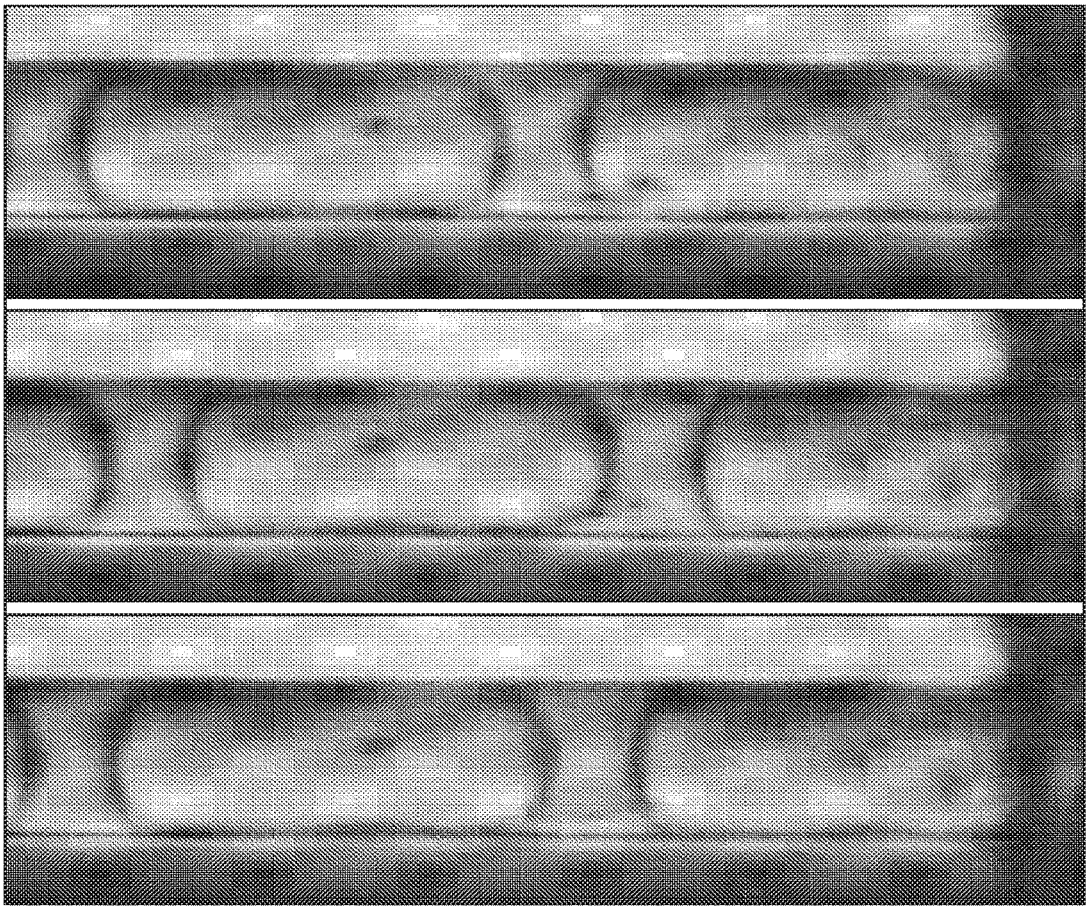
FIG. 7 shows an image of separated plugs of the water-based and perfluorohexane phase.

Aqueous droplets (plugs) were generated by a microfluidic T-junction (IDEX Corporation) using fluorinated oil (perfluorohexane, Aldrich, Madison, Wis.) as continuous phase (micrographs of the plugs can be found in FIG. 7). The phase materials were injected into the channels using syringe pumps (KDS100, KD Scientific Holliston, Mass.). The mass spectrometer interface used was compatible with any microfluidics channel or device that can be terminated by a capillary outlet. In this experiment, a T-junction droplet generator was used. This junction enabled nanoliter-size droplets to be produced at relatively low frequencies (approximately 10 Hz). The capillaries used to build the microfluidics channel were standard coated fused silica (50 micron inner diameter, 360 micron outer diameter) (Polymicro Technologies, Phoenix, Ariz.). Perfluorohexane was selected as immiscible phase of choice after a thorough study of different available liquids mainly because of its low boiling point and commercial availability.

Mass Spectrometer

A commercially available orthogonal reflectron time-of-flight mass spectrometer (Waters, Manchester, UK) was stripped of the Z-spray ion source and further modified to allow droplet sampling. In its original configuration the LCT Premier consisted of six differentially pumped regions, two of which were removed and replaced by the single manifold that allowed transport of droplets into the vacuum and the subsequent evaporation and ionization of the droplets' aqueous components. This manifold contained an interface as described below.

Interface

Figure 8:
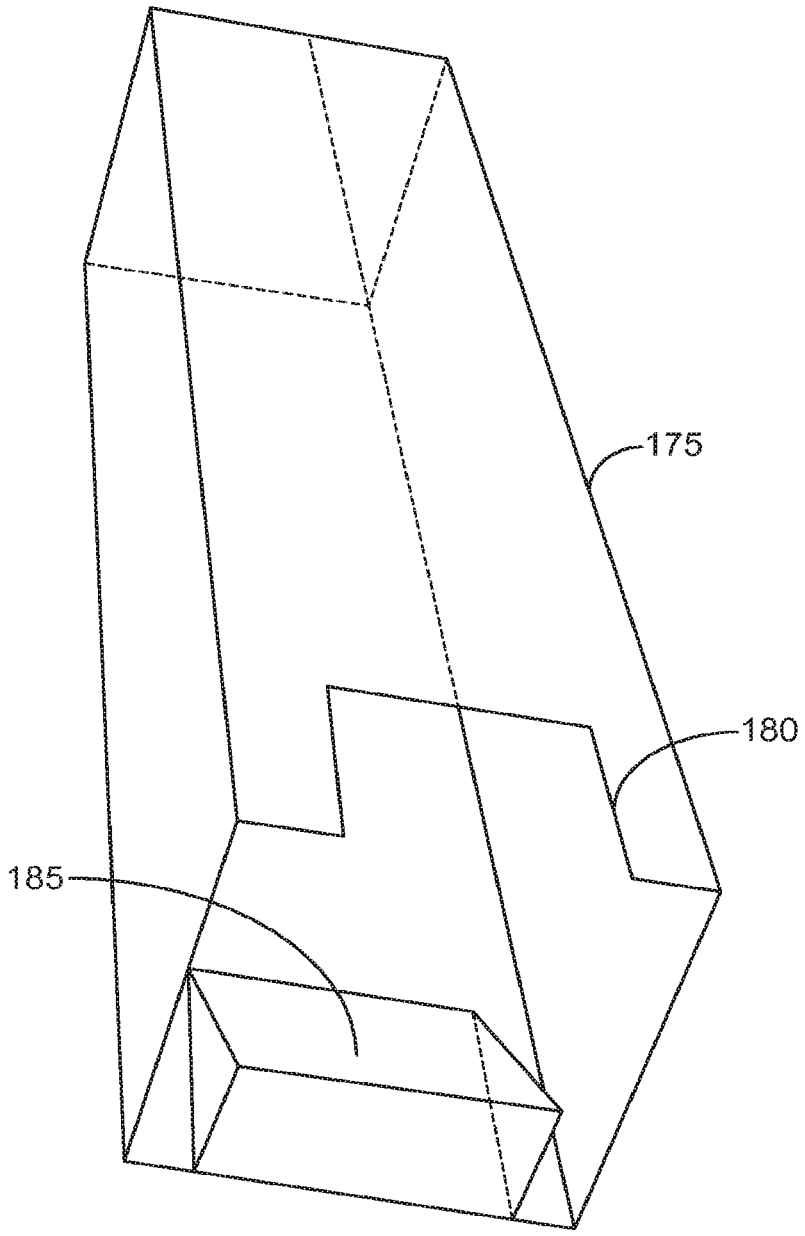
FIG. 8 shows an electrostatic tube with infrared reflective surface.

A glass-lined stainless steel capillary (1.5 millimeter inner diameter, 300 millimeter length), was used to transfer the droplets from atmospheric pressure into the first vacuum region, evacuated by a roots blower (140 liters/second; WAU 501, Leybold) through a vacuum port 165 to a pressure of approximately 1.5 Torr. The glass-lined stainless steel inlet capillary 170 (FIG. 6A) was located on the proximal end of the outer surface of the interface and kept at a high potential (500 V) and aligned with the main axis of the ion optics. A gold-plated tube lens 175 (FIG. 6A; Epner Technologies, New York, USA) was used inside the first vacuum region and also kept at a high potential of 400-500 V. The droplets were transported through this tube lens, which acts both as an electrostatic lens for freshly generated ions as well as a multi-reflection mirror for an IR-laser (25 W $CO_2$ laser, Synrad, Bothell, Wash., model 48-2, $2\omega$=10.6 microns, d=3.5 mm) used for droplet evaporation. FIG. 8 shows the electrostatic tube lens. The view shows a 6×6 milllimeter notch 180 in the top wall of the electrostatic lens for the entering infrared laser beam and a crystal 185 reflecting the beam at a 27 degree angle to the normal to allow up to 9 crossings of the droplet path. The laser is guided into the first vacuum region through a ZnSe light port 190 (FIG. 6A) and finally reflected by a mirror (both Thorlabs, Newton, N.J., USA) into the gold-coated tube lens. The remaining power of the laser beam was dissipated into a block of anodized aluminum which was also mounted inside the vacuum manifold. The sample exited the interface through an aperture 195 located on the distal end of the outer surface of the interface.

Software

The instrument control and data collection was performed using MassLynx 4.0 software (Waters). The spectra were then exported to Mmass 5.4 (www.mmass.org) for further processing. The Lipid maps database search at Lipidomics gateway (National Institute of General Medical Sciences) was performed using the embedded Mmass function.

Operation and Sample Analysis

Charged droplets (W. He, M. H. I. Baird, J. S. Chang, Can. J. Chem. Eng. 1991, 69, 1174-1183) are generated by applying a medium-high voltage (2-3 kV) at the tip of a fused silica capillary mounted at the exit from the microfluidic device. The aqueous or methanol droplets created from the tip are transported through the inlet capillary (1.5 millimeter inner diameter) with up to 96% efficiency, which although high, may be further optimized. This was rigorously determined for aqueous solutions of crystal violet in the following fashion. Droplets emitted from the tip and transmitted through the inlet capillary were collected in a small cup container inserted at the vacuum end of the capillary and the collected content was reanalyzed by a UV/VIS assay to quantify sample recovery. The method used was analogous to the quantitative analysis used in soft landing of electrosprayed material (M. Voloný, F. Tureček, J. Mass Spectrom. 2006, 41, 124-126).

Figure 9A:
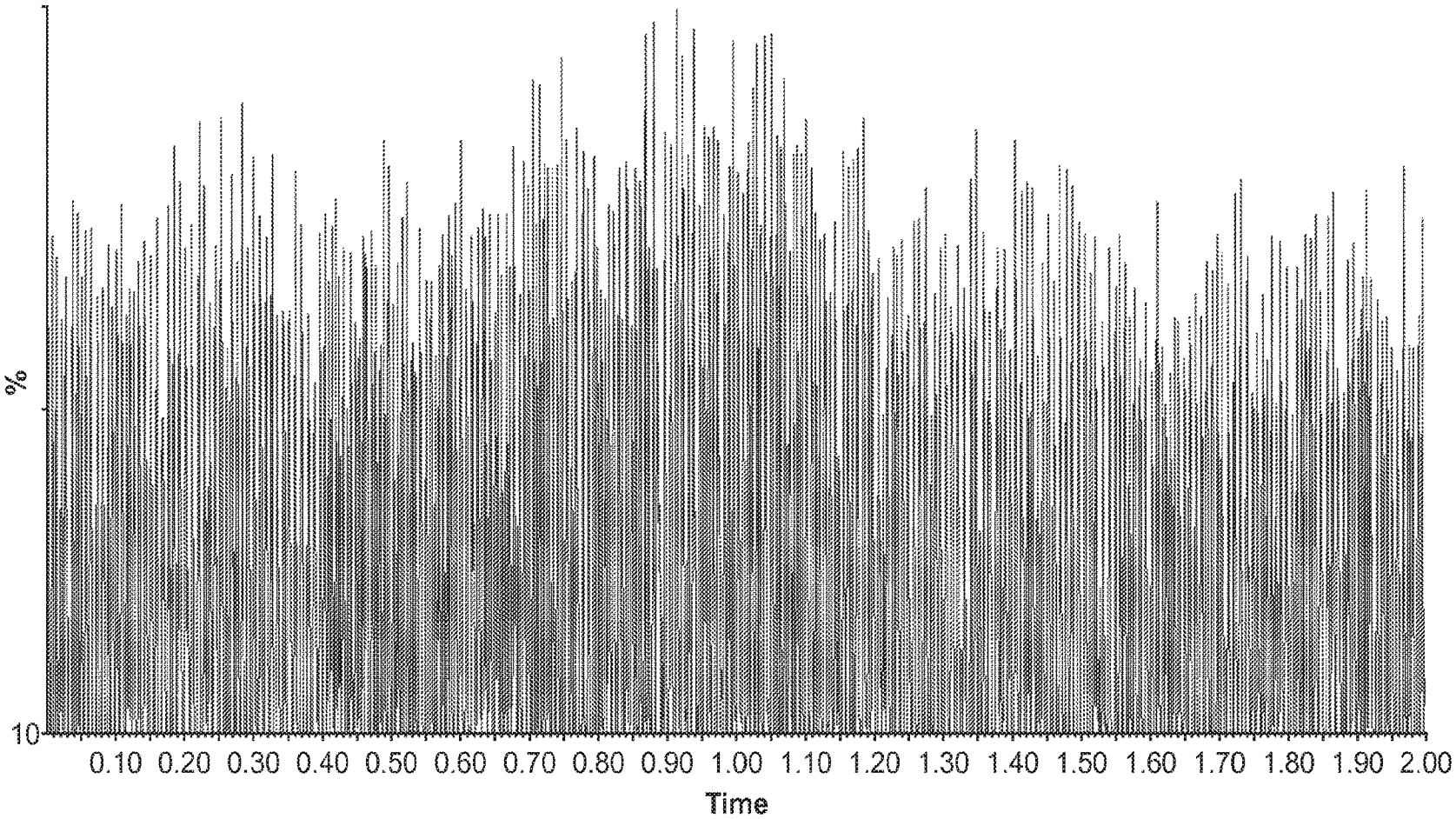
FIGS. 9A-9C shows recorded signals of a selected ion at mass/charge (m/z)=455±1 for plugs of verapamil in water separated by perfluorohexane.
Figure 9B:
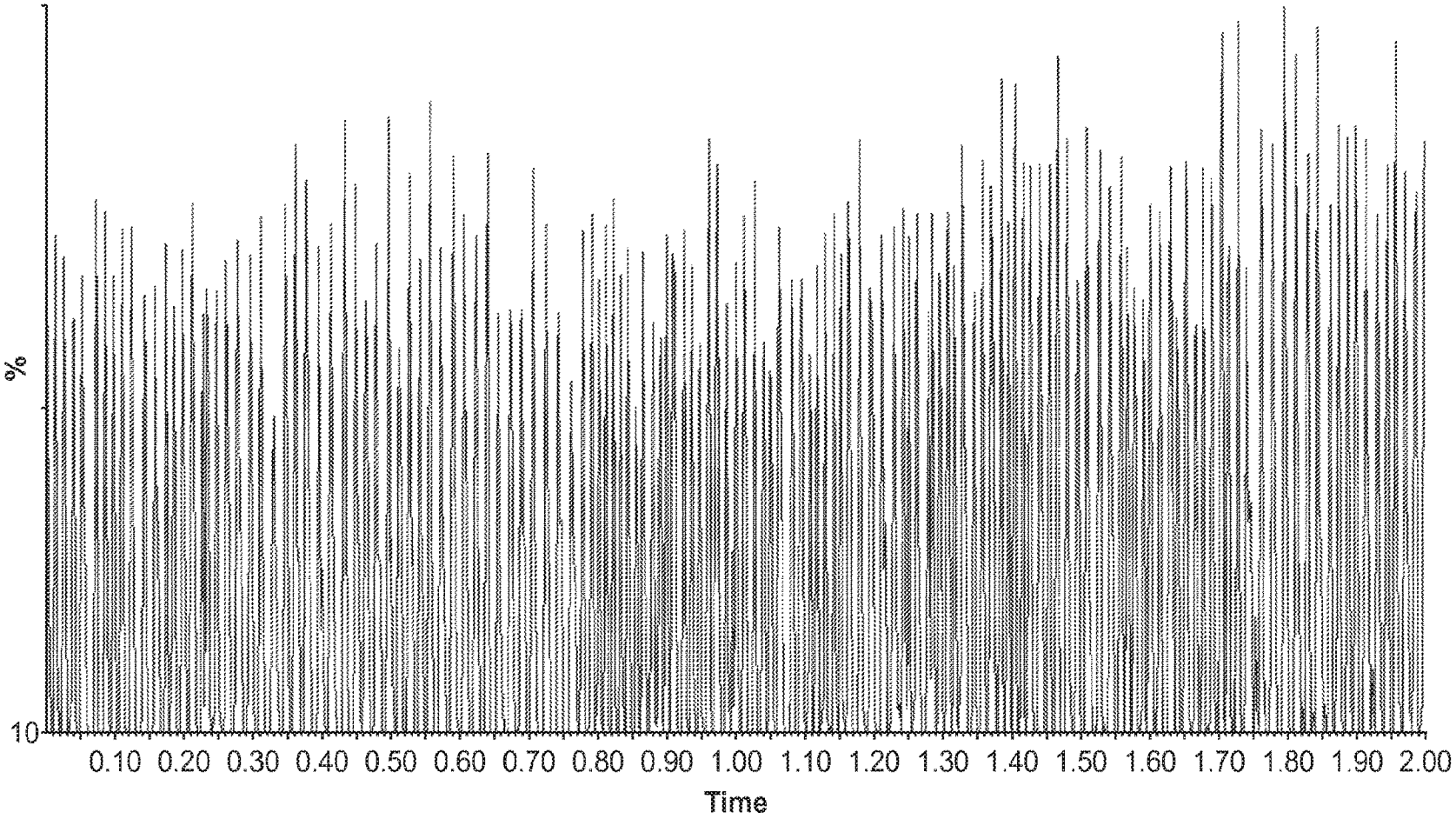
Figure 9C:
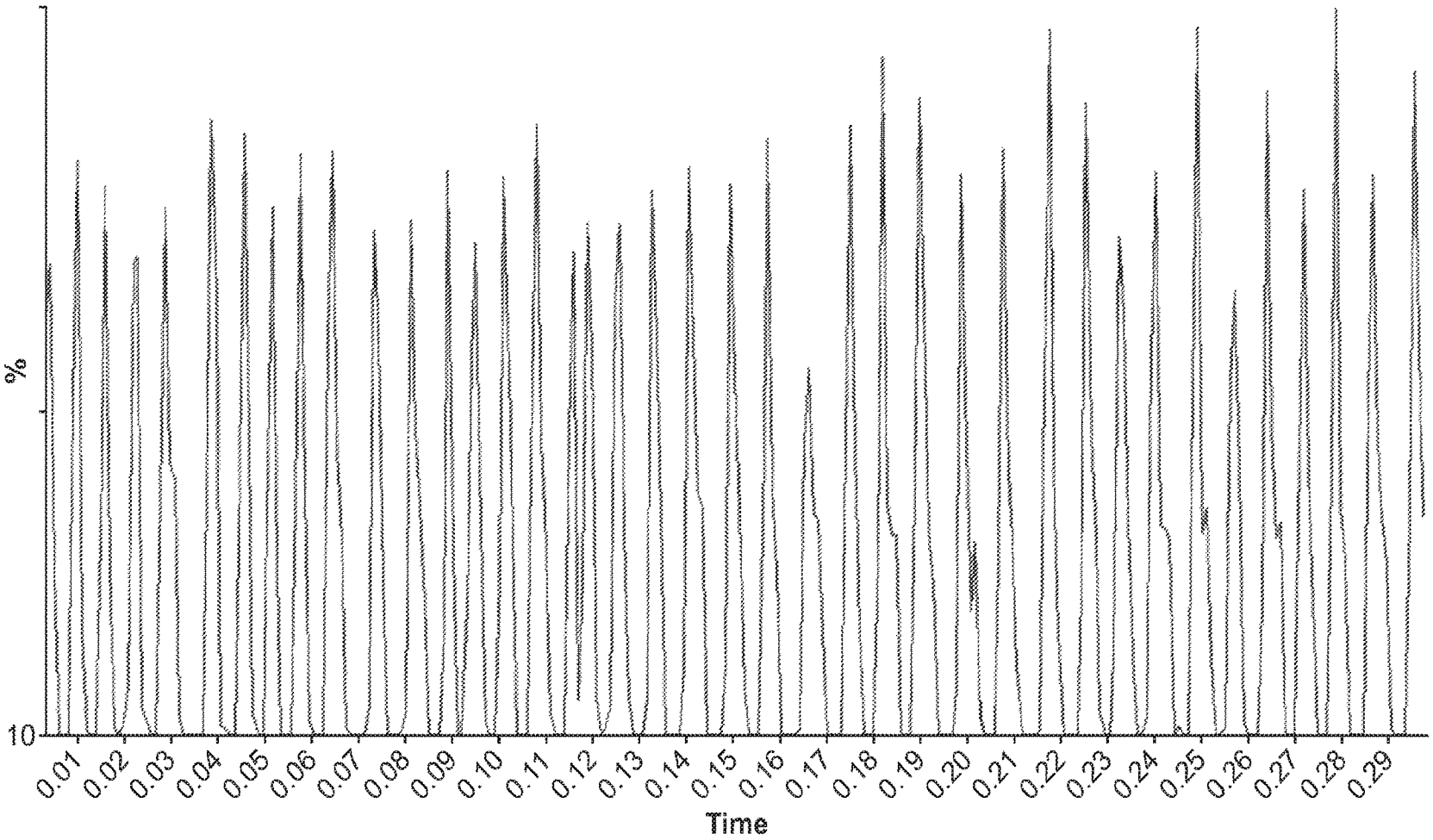

Individual aqueous droplets were ionized and monitored by mass spectrometry in a continuous flow of a two-phase plug stream. For system testing purposes, the aqueous plugs were loaded with $10^{-5}$ M verapamil that was monitored at mass/charge (m/z) 455±1. The ion signal generated from aqueous plugs showed substantial stability over 30-120 s (FIGS. 9A-9C). At the typical flow rates, 45 μL/hr (12.5 nL/s) and 150 μL/hr (41.7 nL/s) for the water-based phase and perfluorohexane, respectively, the ion signal from a droplet showed a mean baseline width of 1.7±0.7 s and the peaks of adjacent droplets were spaced by 3.0±0.5 s. Note that the ion signal drops to zero between two aqueous droplets, indicating that perfluorohexane does not ionize under these experimental conditions and generates no background signal in the mass spectrometer. Moreover, the perfect separation of ion signal from individual droplets that was achieved illustrates that there was no mixing of content from adjacent aqueous plugs due to carryover in the microfluidics system.

Figure 6B:
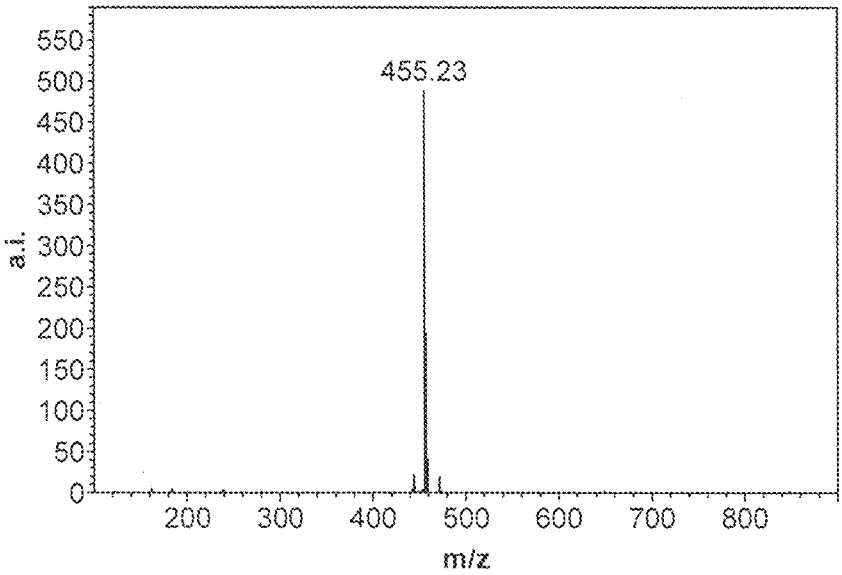
FIG. 6B shows a mass spectrum of 38 femtomoles of verapamil delivered in a single water compartment separated by immiscible plugs of perfluorohexane.

Given the aqueous plug volume (3.8 nL) and verapamil $10^{-5}$ M concentration, each plug contained 38 femtomoles of verapamil. The scan time of the mass spectrometer was set to 50 ms with 10 ms interscan delay, so that one plug of the verapamil solution roughly was sampled in five scans or 300 ms of data acquisition. The full mass spectrum in the m/z 100-1000 range obtained by averaging a single plug over 300 ms is shown in FIG. 6B. This shows the most abundant ion at m/z 455, which corresponds to protonated verapamil, and very little background peaks in the mass spectrum. The spectrum in FIG. 6B showed verapamil intensity of approximately 480 counts. By averaging mass spectra of 10 randomly selected plugs of verapamil-water solution from the same experiment, the average intensity value per plug was calculated to be 435±45 counts, indicating a 10% plug-to-plug variation. The plug-to-plug repeatability mainly depended on the plug generation in the microfluidic T-junction and transport into the mass spectrometer at the tip of the fused silica capillary. Considering the background signal in the spectrum (2 counts), the above-calculated average verapamil signal for the 38 femtomole plug was 73 times above the triple background level. From this value, the limit of detection for the verapamil load in a single plug was determined to be in a high attomole range.

Example 4

Delivery of Double Emulsions to Mass Spectrometer Interface and Analysis

This example describes delivery of double emulsions containing large molecular mass analytes to a mass spectrometer interface and subsequent analysis by mass spectrometer according to an aspect of the present disclosure.

Figure 10A:
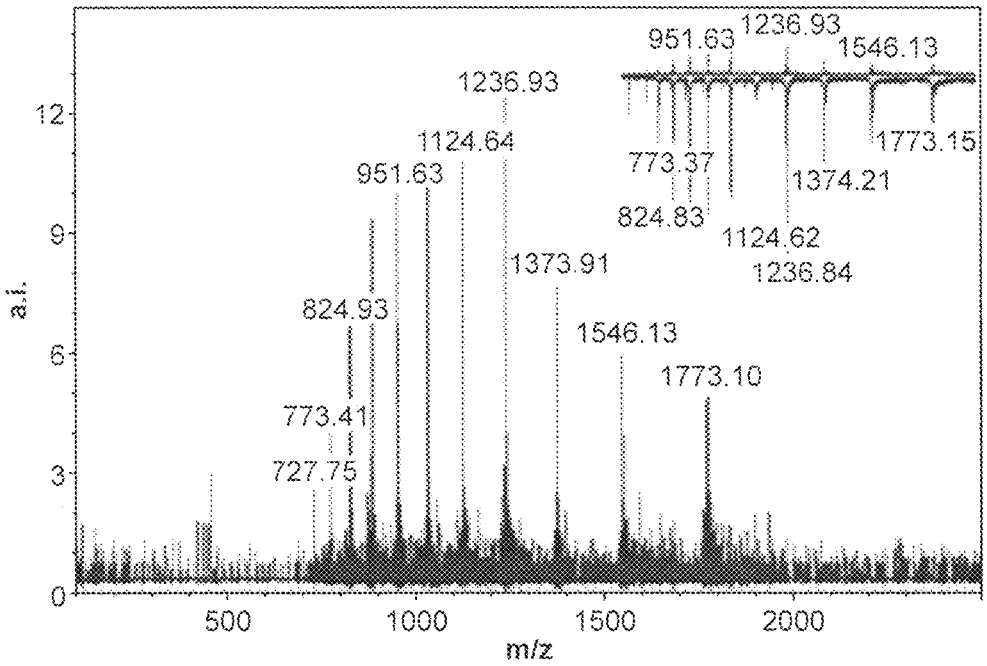
FIG. 10A shows a mass spectrum obtained by recording the signal of a single plug containing 80 femtomoles of cytochrome C in water. The inset shows a sum of spectra obtained from several plugs, confirming the m/z assignment for individual charge states, flipped against the single plug spectrum.
Figure 10B:
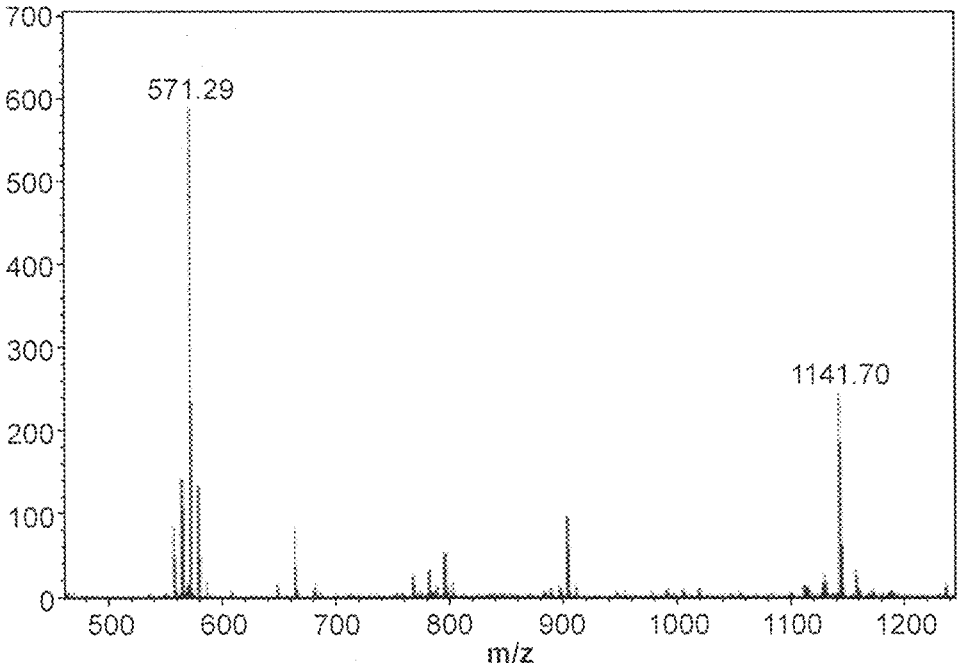
FIG. 10B shows a mass spectrum obtained by recording the signal of a single plug containing 600 femtomoles of Gramicidin-S in water.

The new sampling interface was found to work equally well for biopolymers. FIG. 10A shows the spectrum of a single plug that contained 80 femtomoles of cytochrome C in water containing 0.5% of formic acid. The inset in FIG. 10A shows the spectrum from a single plug flipped against the sum of spectra from several plugs illustrating the reproducibility of the protein charge states formed by droplet ionization. The most abundant peak corresponds to $[M^{+10}H^{+}]10^{+}$ at m/z 1236. The characteristic multiple charging of the protein analyte indicates that the ionization mechanism was not fundamentally different from the standard electrospray mechanism. It was noted that the spectrum showed no peak of dissociated heme at m/z 616, indicating that protein transition from the droplet into the gas phase, as well as the ionization process forming the multiply charged states, were sufficiently soft to prevent heme dissociation from the protein ion. FIG. 10B shows the spectrum of a single plug containing 600 femtomoles of the cyclic peptide gramicidine-S in water ($[MH]^{+}$ at m/z 1141). The spectrum is dominated by a doubly charged ion at m/z 571, pointing again to an electrospray-like ionization. Therefore, this method and device advantageously enable the soft ionization of analytes.

Example 5

Salt Tolerance of the Devices

This example describes the salt tolerance of the devices and methods of the present disclosure.

Figure 11A:
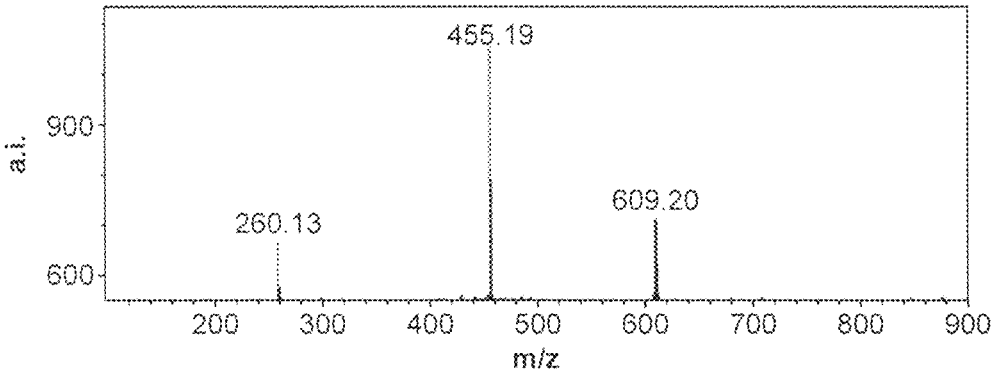
FIG. 11A shows a mass spectrum obtained by recording signal of a single plug containing propranolol (m/z=260), verapamil (m/z=455) and reserpine (m/z=609) in water.

The potential for quantitative analysis of the droplet-MS system often depends on its sensitivity to the presence of various matrices. This was first tested by detecting verapamil in a mixture of three analytes (propranolol, verapamil, and reserpine) that were contained at $10^{-5}$ M each in water plugs separated by perfluorohexane. The spectrum of the mixture showed substantially no verapamil signal suppression due to the presence of the other analytes (FIG. 11A).

Figure 11B:
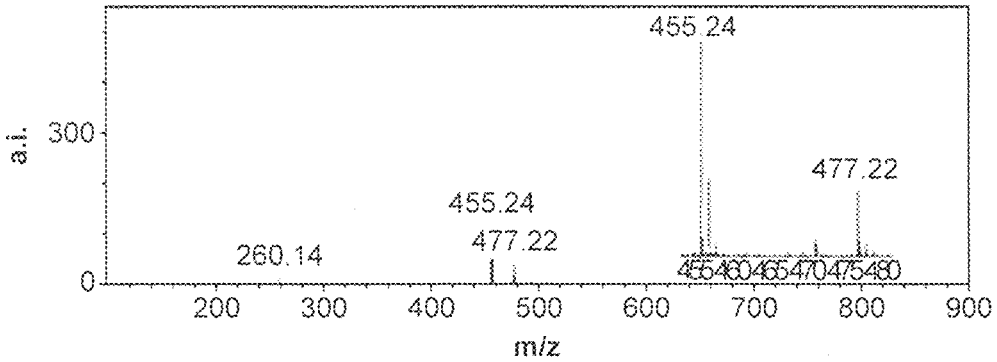
FIG. 11B shows a mass spectrum obtained by recording the signal of a single plug containing propranolol (m/z=260), verapamil (m/z=455) and reserpine (m/z=609; suppressed) in PBS. The inset shows spectrum detail zoomed on verapamil proton and sodium adducts. A comparison with the spectra in FIGS. 8 and 9 show much poorer tolerance of PBS on commercial instruments.
Figure 12A:
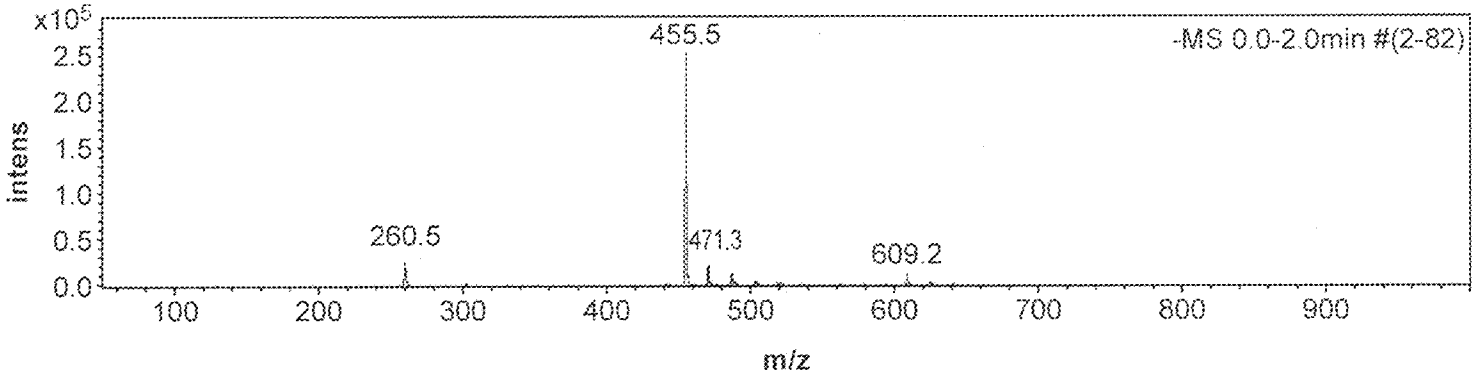
FIGS. 12A and 12B show a mass spectrum obtained by electrospray ionization of a mixture of propranolol (m/z 260), verapamil (m/z=455) and reserpine (m/z 609) in water (FIG. 12A) and PBS (FIG. 12B) using a Bruker Esquire ion trap mass spectrometer.
Figure 12B:
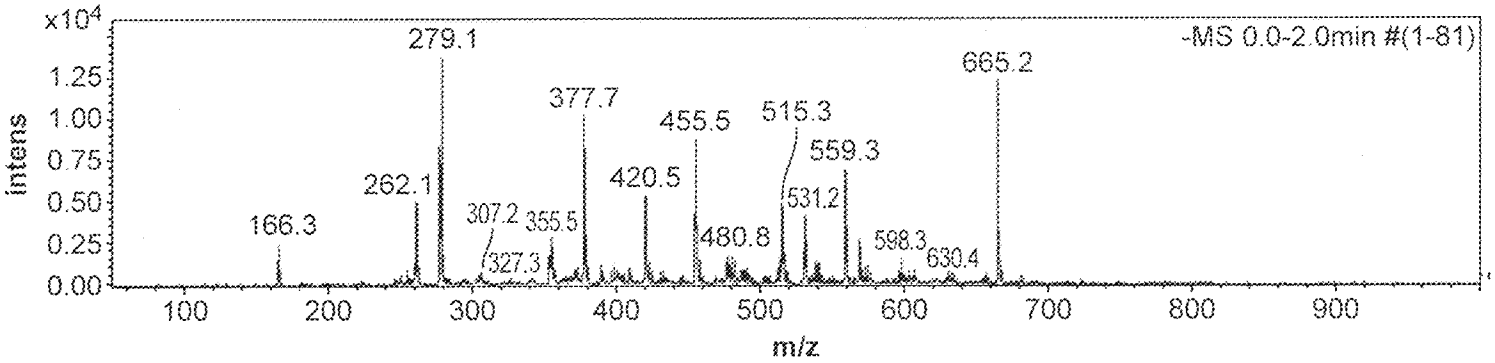
Figure 13A:
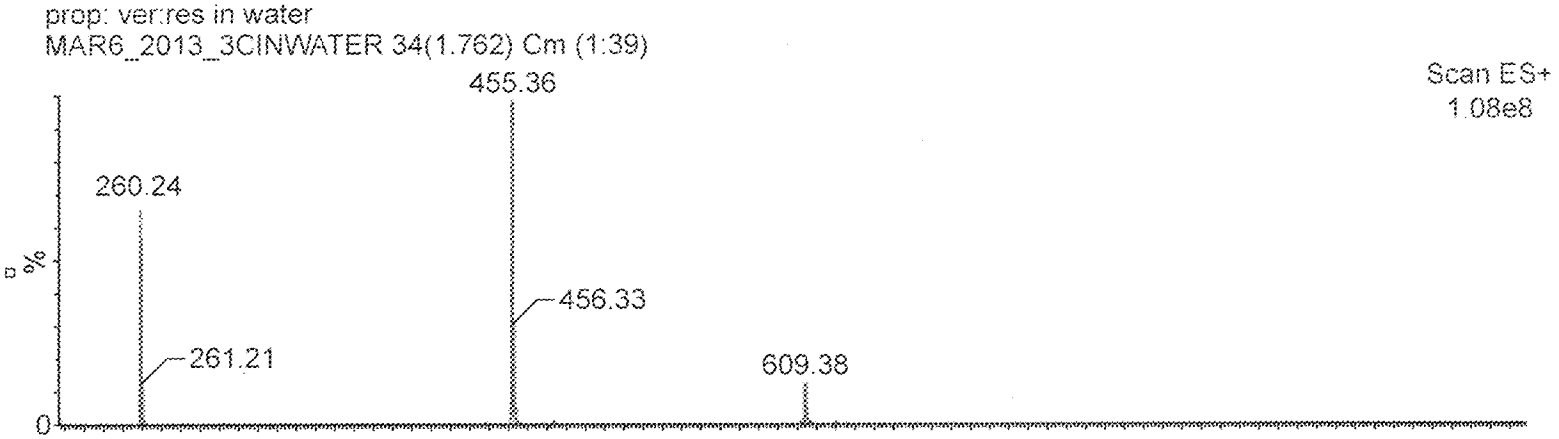
FIGS. 13A and 13B show a mass spectrum obtained by electrospray ionization of mixture of propranolol (m/z 260), verapamil (m/z 455) and reserpine (m/z 609) in water (FIG. 13A) and PBS (FIG. 13B) using a Waters Quattro Micro tandem quadrupole mass spectrometer.
Figure 13B:
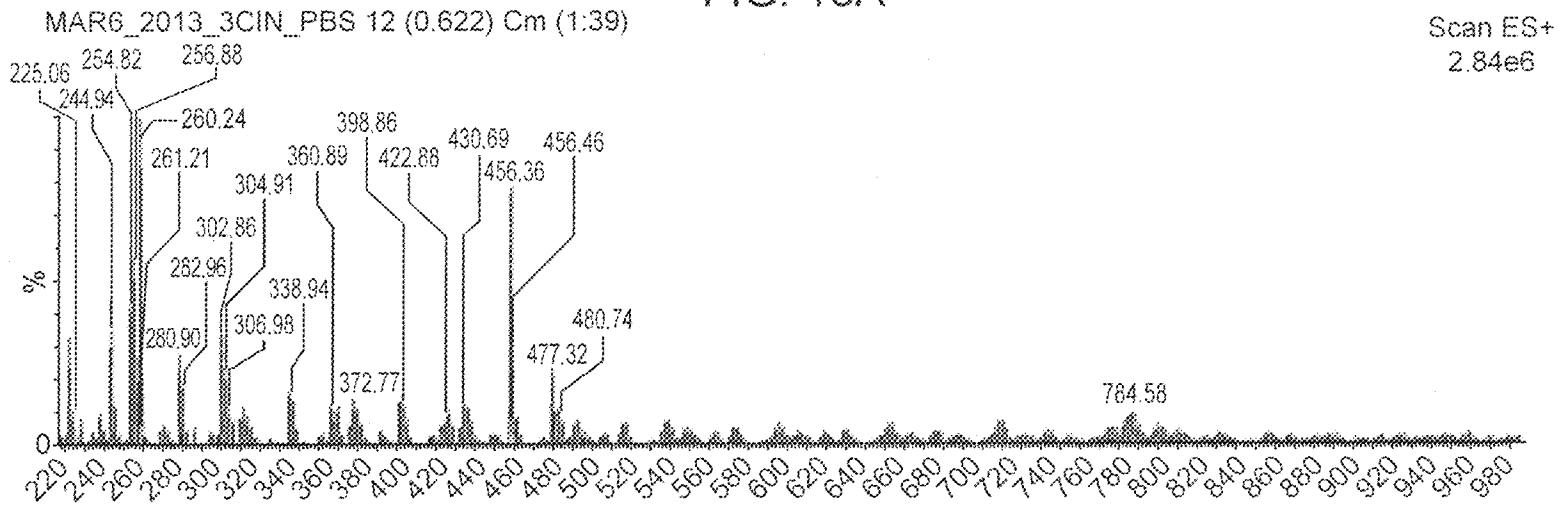

In a still more stringent test, plugs of analytes were generated from concentrated PBS buffer containing 11.9 mM phosphate, 137 mM sodium chloride, and 2.7 mM potassium chloride. The mass spectrum in FIG. 4B shows that propranolol and verapamil ions were formed, albeit with approximately four-fold signal suppression compared to a salt-free solution. The reserpine signal was almost completely suppressed. Under these high salt loading conditions, verapamil was the only analyte that also formed a sodium ion adduct at m/z 477 (FIG. 11B). Remarkably, even in the presence of the concentrated PBS buffer, the spectrum showed very low chemical noise due to the salt ions. This indicates that charged salt clusters were either not formed during droplet evaporation and subsequent ionization, or were not transmitted from the interface into the instrument. By comparison, when the same solutions of these three analytes in water and PBS were electrosprayed on a Bruker LC Esquire ion trap and a Waters Quattro Micro tandem quadrupole mass spectrometer, the spectra were strongly affected by PBS, and the reserpine peak at m/z 609 was at the noise level. In addition, the spectra obtained on both instruments, the Bruker LC Esquire in particular, showed very high levels of chemical noise due to the PBS buffer (FIGS. 9 and 12).

Figure 11C:
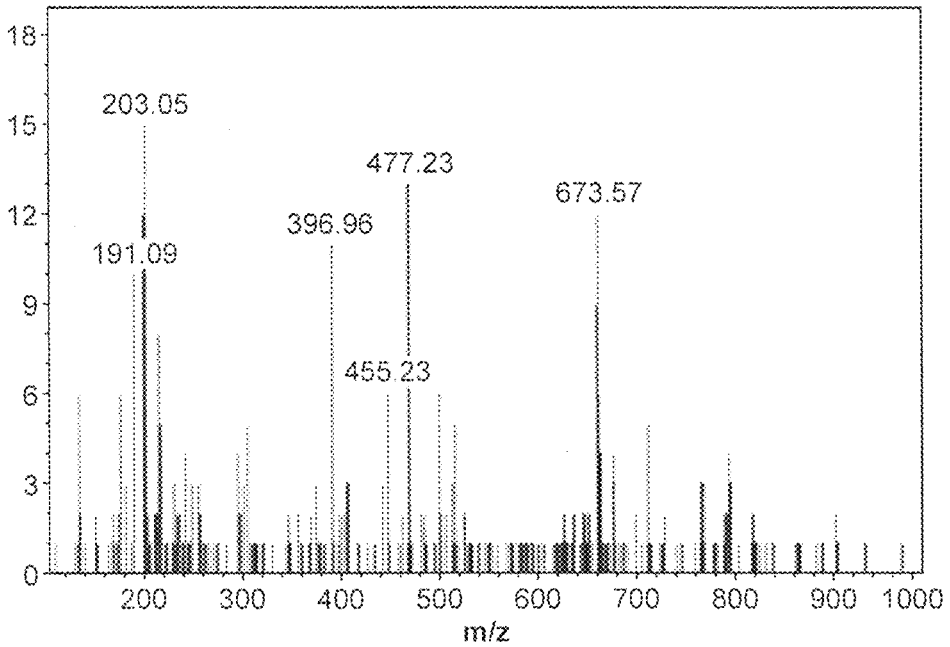
FIG. 11C shows a mass spectrum obtained by recording signal of a single plug containing 20 femtomoles of verapamil ($MH^+$ m/z 455; $MNa^+$ m/z 477) in porcine blood plasma.

Because the present droplet microfluidics interface was demonstrated to have superior and robust behavior in the presence of high salt content, it was attempted to analyze (i) porcine blood plasma mixed with verapamil solution in a 1:1 ratio to achieve a final concentration of verapamil in plasma at $5\times10^{-6}$ M and (ii) a cell lysate spiked with verapamil and propranolol. In the first experiment, EDTA was added to the plasma and centrifuged at 10,000 rpm immediately before mixing with the verapamil solution. Mass spectra from plugs of plasma separated by perfluorohexane were subsequently obtained. FIG. 11C shows a spectrum of a single plasma plug that contained 20 femtomoles of verapamil. This spectrum of FIG. 11C is notably dominated by a sodium adduct (m/z 477) whereas, in the PBS buffer, verapamil was predominantly protonated.

Example 6

Analysis of Cell Lysate

This example describes analyzing cell lysate according to certain aspects of the present disclosure utilizing the devices described in Examples 1 to 5.

All chemicals were purchased from Sigma-Aldrich. The cell line, MCF-7 adenocarcinoma (Panel HTB-22), was obtained from ATCC biological resource center. A standard porcine blood plasma sample was obtained from UW Department of Bioengineering. The modified mass spectrometer was a Waters LCT Premier with a reflectron-TOF mass analyzer and a multichannel plate ion detector. Only commercially available parts were used for building the bi-phase microfluidics system.

Human breast cancer cells (MCF-7) were cultured in EMEM (Eagles Minimum Essential Media) growth media (American Type Culture Collection) with 10% fetal bovine serum (FBS) and 1% penicillin/streptomycin. The cells were rinsed 3 times via centrifugation and re-suspension in DI water. The solution was then diluted to obtain a final concentration of $1.2\times10^{6}$ cells/milliliter.

Figure 14A:
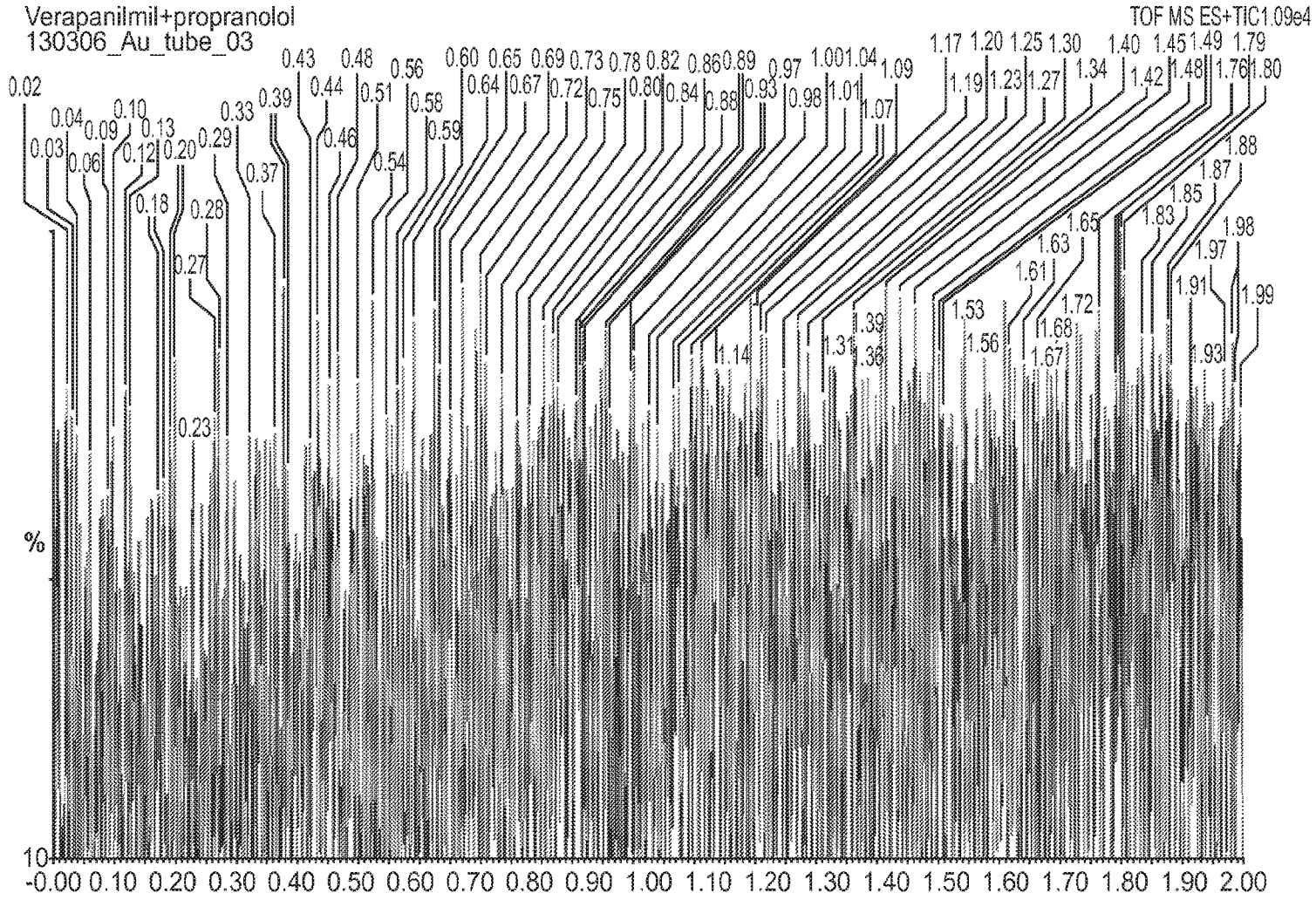
FIGS. 14A and 14B show the analysis of plugs of verapamil and propranolol in the cell lysate separated by perfluorohexane. The figure shows the recorded signal of total ion current for a 120-second acquisition (FIG. 14A) and a 30-second acquisition (FIG. 14B).
Figure 14B:
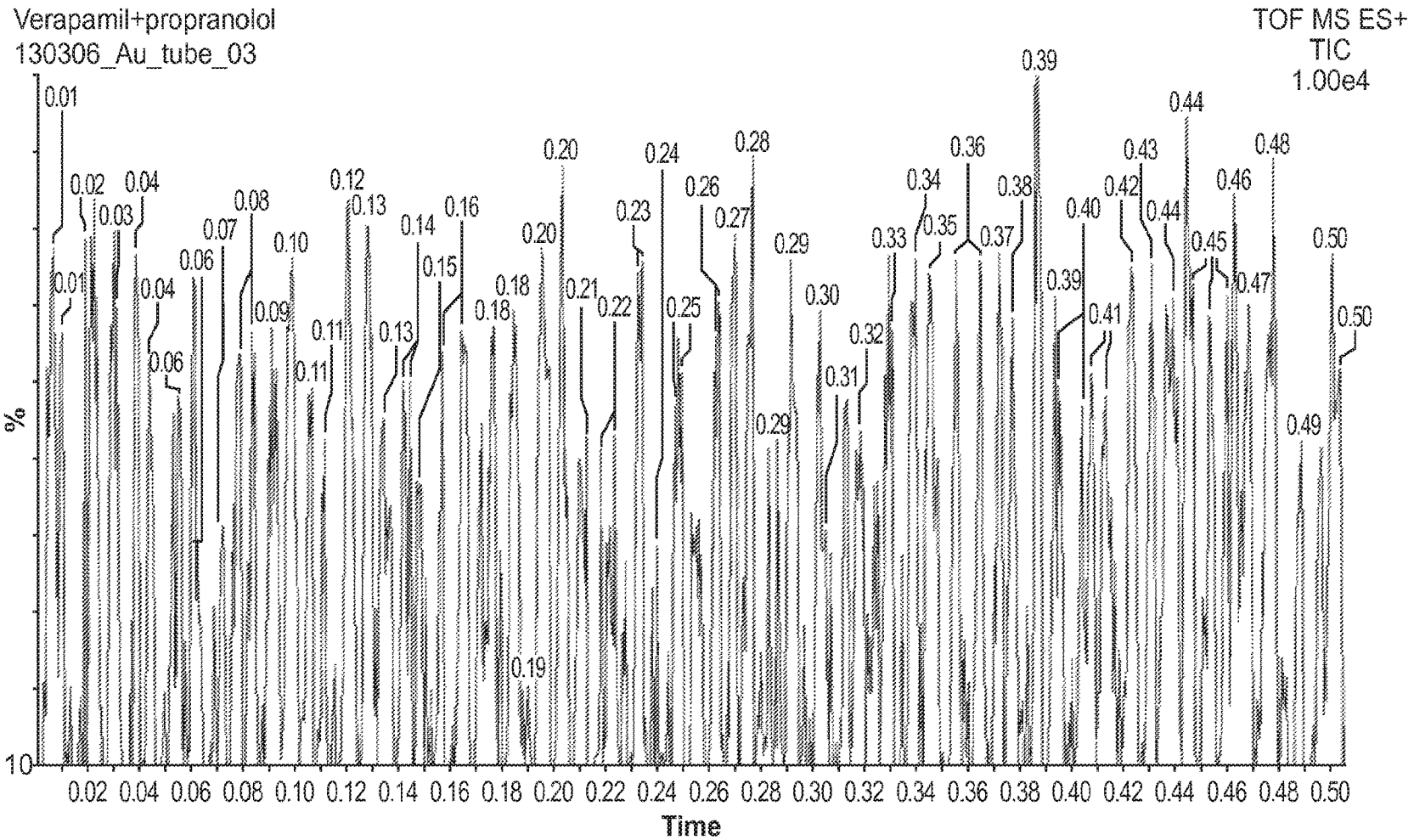
Figure 15A:
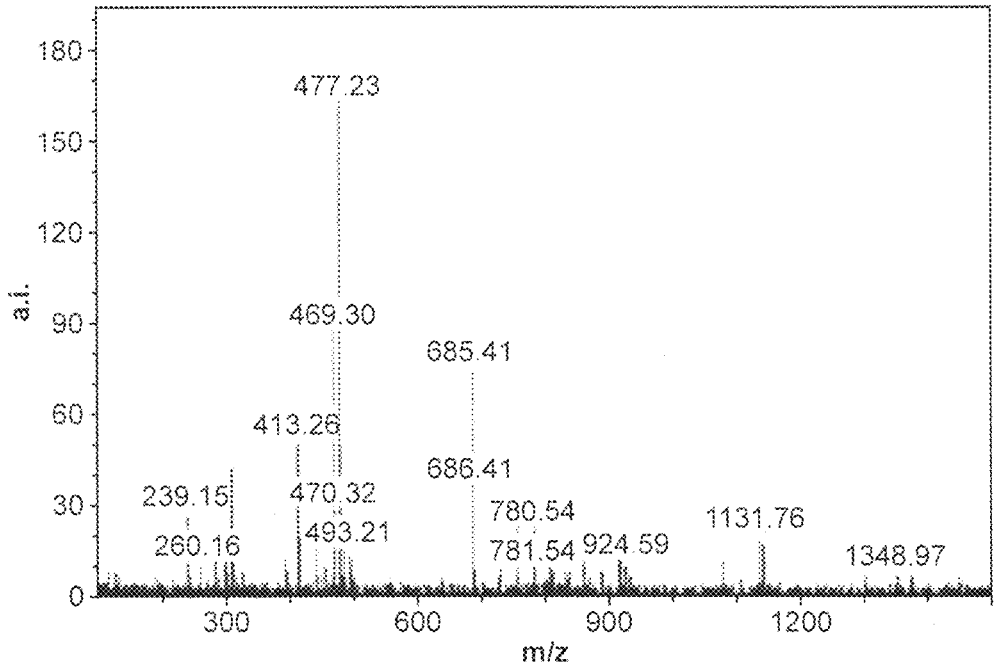
FIGS. 15A and 15B show a mass spectrum obtained by recording the signal of a single plug of lysed cells in water spiked with propranolol and verapamil.
Figure 15B:
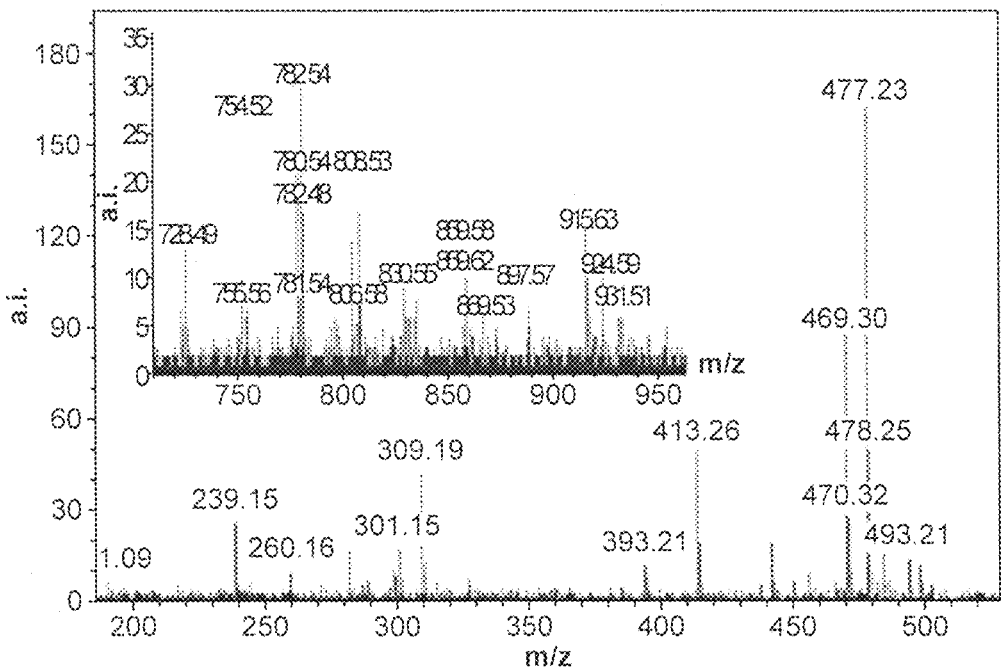
Figure 16A:
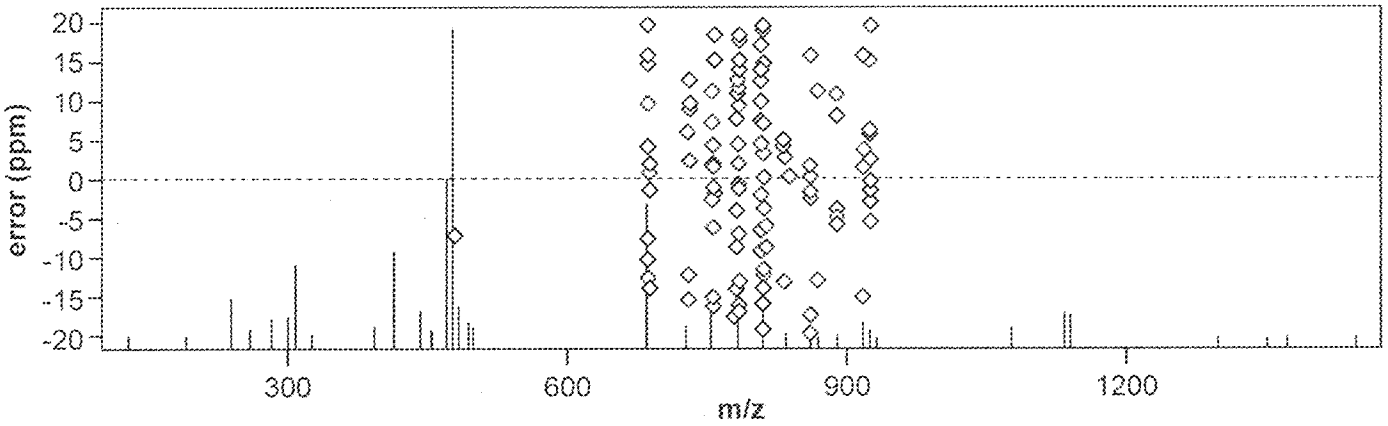
FIG. 16A shows the glycerophospholipids.
Figure 16B:
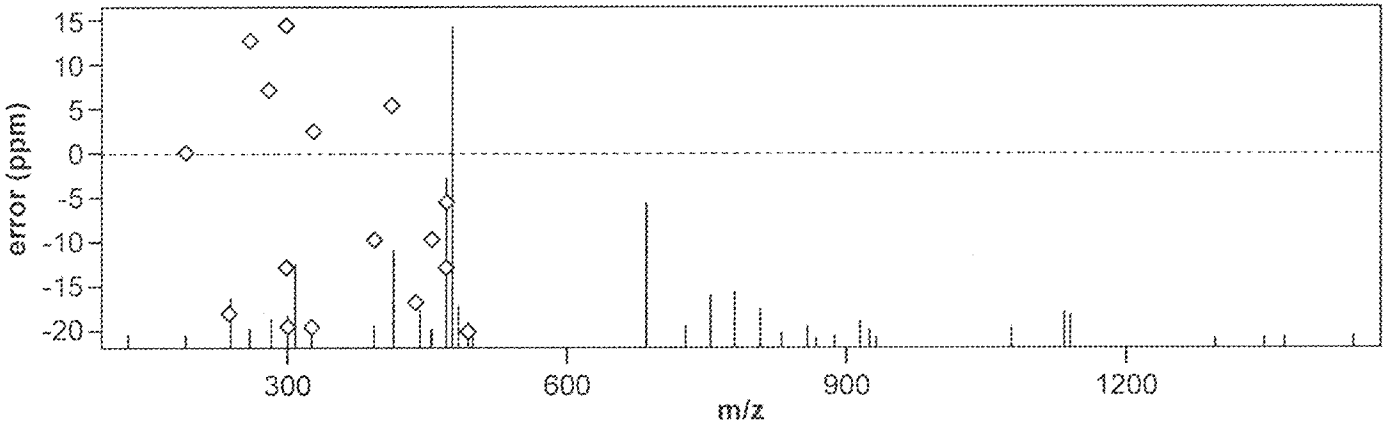
FIG. 16 shows the assignment of known lipid species to peaks in the cell lysate spectrum (from FIGS. 15A and 15B) using the open source program mMass.
Figure 17A:
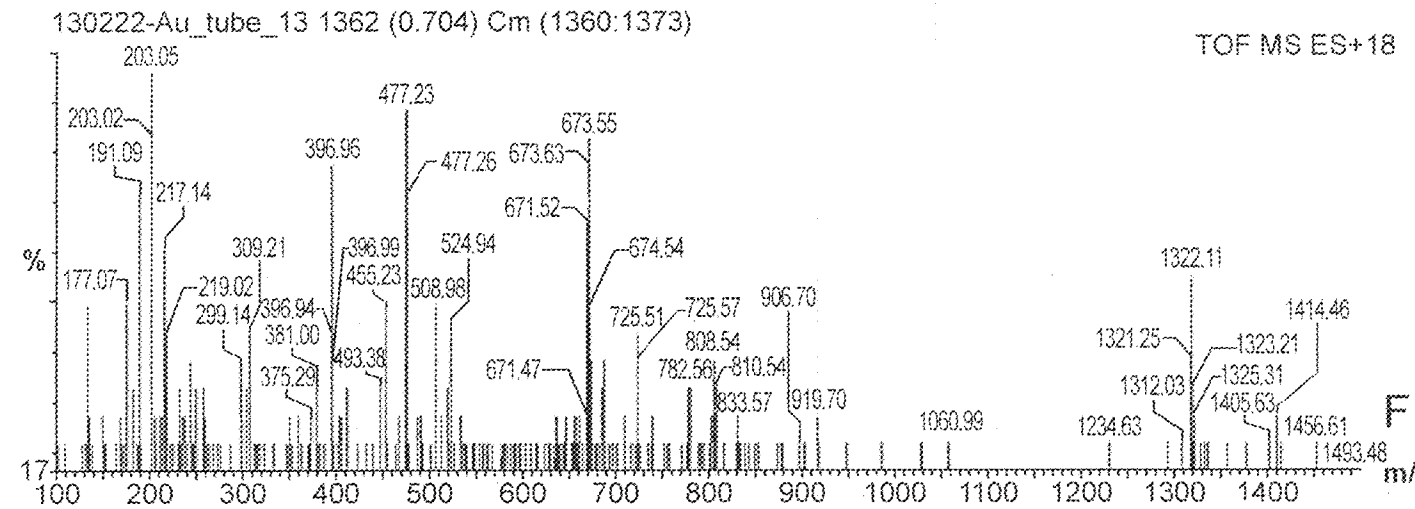
FIGS. 17A and 17B show a mass spectrum obtained from the analysis of a porcine blood plasma sample spiked with 20 femtomols of verapamil (m/z=455 ($MH^+$) and 477 ($MNa^+$)).
Figure 17B:
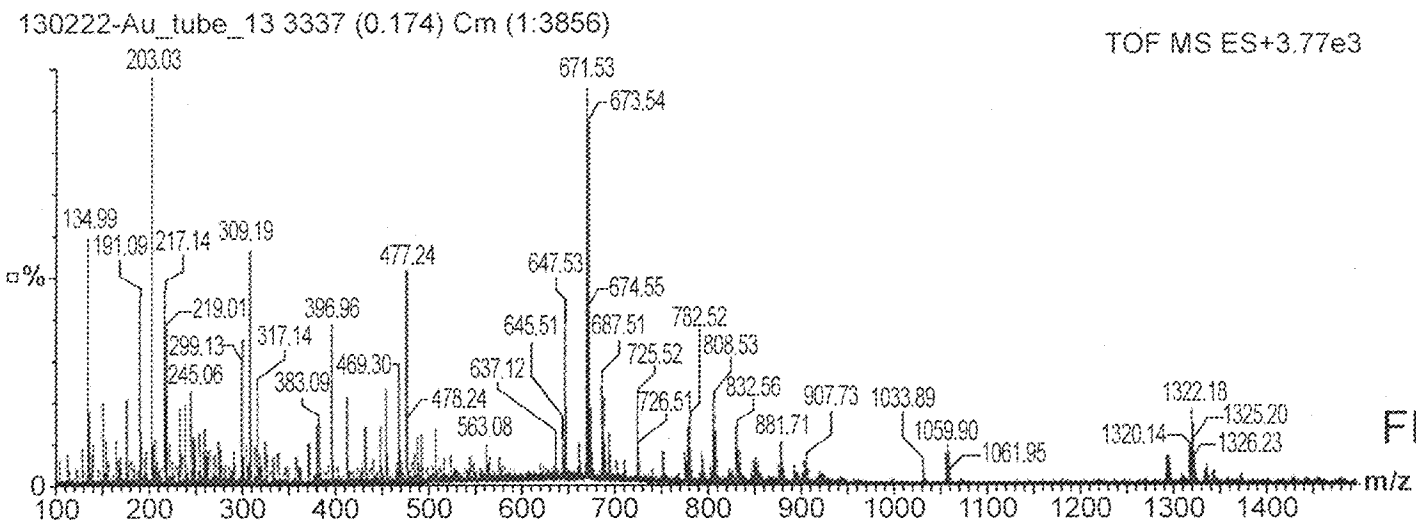

Mammalian cell lysate was spiked with verapamil and propranolol solutions to the final concentration of $10^{-5}$ M. The original density of harvested cell suspension was $10^{6}$ cells per mL, but after lysis the cell content was diluted so a single 5 nL plug containing approximately 1-10 cells. Plugs of this spiked cell lysate were successfully generated in a two phase flow system with perfluorohexane (FIGS. 14A-14B), although the separation and plug-to-plug repeatability were worse than in the case of pure water or buffer solutions. The mass spectrum of a single plug of spiked cell lysate is shown in FIG. 15A. It shows the peaks of protonated, sodiated, and potassiated propranolol with $MH^{+}$, $MNa^{+}$ and $MK^{+}$ at m/z 260, 282, and 299, respectively, and verapamil with $MH^{+}$, $MNa^{+}$, and $MK^{+}$ at m/z 455, 477, and 493, respectively. Notably, for both compounds the protonated forms were the most dominant ion species (for a detailed zoom, see FIG. 15B). The spectrum also showed peaks representing the content of approximately 10 lysed cells in two distinct mass regions. The first region consisted of several peaks between m/z 650 and 950 (inset in FIG. 15B) that can be attributed to known glycerophosphopeptides. The lower mass region of m/z 200-500 showed peaks that matched m/z of several fatty acids (FIG. 15B). The assignments were made from a search in the Lipidmaps database at the Lipidomics gateway. The results of the search are given in (FIGS. 16A and 16B and Tables 1 and 2). It should be noted that the search was performed with a 20 ppm mass accuracy limit.

Table 1 (below) provides a list of mass/charge (m/s) ratios and respective molecular formulae that correspond to fatty acids listed in the Lipid Maps database:

TABLE 1

Identified peaks from the analysis of cell lysate, corresponding to fatty acids listed in the Lipid Maps database. The search was performed with a tolerance of 20 ppm. Each molecular formula presumably corresponds to multiple known isomers. The relative intensities are relative to that of the verapamil base peak at m/z 477.

| Meas. m/z | Calc. m/z | δ (ppm) | Rel. Int. (%) | Formula |
|---|---|---|---|---|
| 239.12 | 239.13 | −18 | 7.86 | C11H20O4(Na)(H-1) |
| 299.18 | 299.19 | −12.8 | 6.55 | C16H26O5 |
| 299.18 | 299.18 | 14.3 | 6.55 | C18H28O(K)(H-1) |
| 301.15 | 301.16 | −19.5 | 10.44 | C17H26O2(K)(H-1) |
| 327.2 | 327.21 | −19.5 | 4.21 | C20H32O(K)(H-1) |
| 327.23 | 327.23 | 2.5 | 4.9 | C20H32O2(Na)(H-1) |
| 393.31 | 393.31 | −9.5 | 7.3 | C23H46O2(K)(H-1) |
| 413.23 | 413.23 | 5.3 | 26.66 | C23H34O5(Na)(H-1) |
| 441.29 | 441.3 | −16.8 | 12.35 | C26H42O4(Na)(H-1) |
| 470.32 | 470.32 | −5.5 | 16.84 | C27H45NO4(Na)(H-1) |

Table 2 (below) provides a list of mass/charge (m/s) ratios and respective molecular formulae that correspond to glycerophospho lipids listed in the Lipid Maps database:

TABLE 2

Identified peaks from the analysis of cell lysate, corresponding glycerophospho lipids listed in the Lipid Maps database. The search was performed with a tolerance of 20 ppm. Each molecular formula presumably corresponds to multiple known isomers. The relative intensities are relative to that of the verapamil base peak at m/z 477.

| Meas. m/z | Calc. m/z | δ (ppm) | Rel. Int. (%) | Formula |
|---|---|---|---|---|
| 477.23 | 477.24 | −7.1 | 100 | C21H43O7P(K)(H-1) |
| 685.41 | 685.42 | −12.8 | 45.69 | C35H67O8P(K)(H-1) |
| 685.41 | 685.41 | 9.7 | 45.69 | C34H63O10P(Na)(H-1) |
| 685.53 | 685.52 | 16 | 8.47 | C39H73O7P |
| 685.53 | 685.51 | 19.6 | 8.47 | C37H75O7P(Na)(H-1) |
| 686.41 | 686.4 | 14.7 | 21.71 | C33H62NO10P(Na)(H-1) |
| 686.41 | 686.42 | −7.7 | 21.71 | C34H66NO8P(K)(H-1) |
| 686.48 | 686.47 | 4.2 | 13.77 | C35H70NO8P(Na)(H-1) |
| 686.48 | 686.48 | 0.7 | 13.77 | C37H68NO8P |
| 686.5 | 686.51 | −13.8 | 7.84 | C38H72NO7P |
| 686.5 | 686.51 | −10.3 | 7.84 | C36H74NO7P(Na)(H-1) |
| 687.39 | 687.4 | −14 | 5.58 | C37H61O8P(Na)(H-1) |
| 687.42 | 687.42 | −1.5 | 4.83 | C36H63O10P |
| 687.42 | 687.42 | 2 | 4.83 | C34H65O10P(Na)(H-1) |
| 726.49 | 726.48 | 5.9 | 4.2 | C38H74NO7P(K)(H-1) |
| 728.45 | 728.46 | −15.5 | 4.26 | C37H72NO8P(K)(H-1) |
| 728.45 | 728.45 | 5.6 | 4.26 | C36H68NO10P(Na)(H-1) |
| 728.45 | 728.45 | 2.3 | 4.26 | C38H66NO10P |
| 728.49 | 728.5 | −12.3 | 7.99 | C38H76NO7P(K)(H-1) |
| 728.49 | 728.48 | 8.9 | 7.99 | C37H72NO9P(Na)(H-1) |
| 728.49 | 728.5 | −12.3 | 7.99 | C38H76NO7P(K)(H-1) |
| 728.53 | 728.52 | 12.9 | 7.32 | C38H76NO8P(Na)(H-1) |
| 728.53 | 728.52 | 9.6 | 7.32 | C40H74NO8P |
| 754.49 | 754.5 | −16.5 | 8.69 | C39H74NO9P(Na)(H-1) |
| 754.49 | 754.48 | 11.3 | 8.69 | C39H74NO8P(K)(H-1) |
| 754.52 | 754.51 | 7.2 | 16.62 | C40H78NO7P(K)(H-1) |
| 754.52 | 754.51 | 7.4 | 16.62 | C43H74NO6P(Na)(H-1) |
| 754.57 | 754.57 | −2.8 | 6.82 | C41H82NO7P(Na)(H-1) |
| 754.57 | 754.57 | −6 | 6.82 | C43H80NO7P |
| 754.61 | 754.61 | 2 | 6.2 | C42H86NO6P(Na)(H-1) |
| 754.61 | 754.61 | −1.2 | 6.2 | C44H84NO6P |
| 755.5 | 755.5 | 4.3 | 6.08 | C40H77O8P(K)(H-1) |
| 755.5 | 755.5 | 4.5 | 6.08 | C43H73O7P(Na)(H-1) |
| 755.5 | 755.51 | −6.5 | 6.08 | C38H75O12P |
| 755.56 | 755.56 | 1.3 | 4.28 | C43H79O8P |
| 755.56 | 755.56 | 4.5 | 4.28 | C41H81O8P(Na)(H-1) |
| 755.58 | 755.59 | −15.3 | 4.26 | C42H85O7P(Na)(H-1) |
| 757.55 | 757.54 | 15.2 | 4.26 | C42H77O9P |
| 757.55 | 757.54 | 18.4 | 4.26 | C40H79O9P(Na)(H-1) |
| 757.55 | 757.55 | −2 | 4.26 | C41H83O7P(K)(H-1) |
| 780.48 | 780.48 | −3.9 | 6.63 | C42H70NO10P |

TABLE 2-continued

Identified peaks from the analysis of cell lysate, corresponding glycerophospho lipids listed in the Lipid Maps database. The search was performed with a tolerance of 20 ppm. Each molecular formula presumably corresponds to multiple known isomers. The relative intensities are relative to that of the verapamil base peak at m/z 477.

| Meas. m/z | Calc. m/z | δ (ppm) | Rel. Int. (%) | Formula |
|---|---|---|---|---|
| 780.48 | 780.48 | −0.8 | 6.63 | C40H72NO10P(Na)(H-1) |
| 780.54 | 780.55 | −17.2 | 12.88 | C44H78NO8P |
| 780.54 | 780.55 | −14.1 | 12.88 | C42H80NO8P(Na)(H-1) |
| 780.54 | 780.53 | 13 | 12.88 | C45H76NO6P(Na)(H-1) |
| 780.54 | 780.53 | 12.8 | 12.88 | C42H80NO7P(K)(H-1) |
| 780.57 | 780.59 | −17.6 | 7.81 | C43H84NO7P(Na)(H-1) |
| 780.61 | 780.62 | −17.7 | 6.14 | C44H88NO6P(Na)(H-1) |
| 781.54 | 781.54 | 10.9 | 4.96 | C42H79O9P(Na)(H-1) |
| 781.54 | 781.54 | 7.9 | 4.96 | C44H77O9P |
| 781.54 | 781.55 | −8.8 | 4.96 | C43H83O7P(K)(H-1) |
| 782.48 | 782.49 | −13.1 | 10.79 | C40H74NO10P(Na)(H-1) |
| 782.48 | 782.47 | 13.7 | 10.79 | C40H74NO9P(K)(H-1) |
| 782.48 | 782.5 | −16.2 | 10.79 | C42H72NO10P |
| 782.48 | 782.47 | 13.9 | 10.79 | C43H70NO8P(Na)(H-1) |
| 782.51 | 782.5 | 18.5 | 15.78 | C42H72NO10P |
| 782.51 | 782.51 | 1.9 | 15.78 | C41H78NO8P(K)(H-1) |
| 782.54 | 782.55 | −7.3 | 18.53 | C42H82NO7P(K)(H-1) |
| 782.54 | 782.53 | 12.4 | 18.53 | C41H78NO9P(Na)(H-1) |
| 782.54 | 782.55 | −7.1 | 18.53 | C45H78NO6P(Na)(H-1) |
| 782.58 | 782.57 | 11.4 | 16.87 | C44H80NO8P |
| 782.58 | 782.57 | 14.5 | 16.87 | C42H82NO8P(Na)(H-1) |
| 782.62 | 782.61 | 14.8 | 8.44 | C45H84NO7P |
| 782.62 | 782.6 | 17.9 | 8.44 | C43H86NO7P(Na)(H-1) |
| 783.46 | 783.46 | 4.5 | 4.24 | C40H73O10P(K)(H-1) |
| 783.5 | 783.49 | 9.5 | 7.85 | C41H77O9P(K)(H-1) |
| 783.5 | 783.51 | −17.2 | 7.85 | C41H77O10P(Na)(H-1) |
| 783.5 | 783.5 | −0.8 | 7.85 | C39H75O13P |
| 783.5 | 783.49 | 9.7 | 7.85 | C44H73O8P(Na)(H-1) |
| 783.57 | 783.55 | 15.3 | 10.26 | C44H79O9P |
| 783.57 | 783.55 | 18.4 | 10.26 | C42H81O9P(Na)(H-1) |
| 783.57 | 783.57 | −1.3 | 10.26 | C43H85O7P(K)(H-1) |
| 806.5 | 806.51 | −11.7 | 4.3 | C43H78NO8P(K)(H-1) |
| 806.5 | 806.5 | 4.4 | 4.3 | C44H72NO10P |
| 806.5 | 806.49 | 7.4 | 4.3 | C42H74NO10P(Na)(H-1) |
| 806.54 | 806.55 | −6.5 | 8.49 | C44H82NO7P(K)(H-1) |
| 806.54 | 806.53 | 12.6 | 8.49 | C43H78NO9P(Na)(H-1) |
| 806.58 | 806.58 | −9.2 | 4.34 | C45H86NO6P(K)(H-1) |
| 806.58 | 806.59 | −19.3 | 4.34 | C43H84NO10P |
| 806.58 | 806.57 | 6.9 | 4.34 | C46H80NO8P |
| 806.58 | 806.57 | 9.9 | 4.34 | C44H82NO8P(Na)(H-1) |
| 807.56 | 807.55 | 17.2 | 4.19 | C44H81O9P(Na)(H-1) |
| 807.56 | 807.55 | 14.2 | 4.19 | C46H79O9P |
| 807.56 | 807.57 | −1.9 | 4.19 | C45H85O7P(K)(H-1) |
| 808.5 | 808.51 | −11.3 | 7.3 | C42H76NO10P(Na)(H-1) |
| 808.5 | 808.49 | 14.9 | 7.3 | C45H72NO8P(Na)(H-1) |
| 808.5 | 808.51 | −14.2 | 7.3 | C44H74NO10P |
| 808.5 | 808.49 | 14.7 | 7.3 | C42H76NO9P(K)(H-1) |
| 808.53 | 808.53 | 6.9 | 12.85 | C46H76NO7P(Na)(H-1) |
| 808.53 | 808.53 | 6.7 | 12.85 | C43H80NO8P(K)(H-1) |
| 808.53 | 808.55 | −19.3 | 12.85 | C43H80NO9P(Na)(H-1) |
| 808.6 | 808.59 | 19.7 | 9.18 | C46H82NO8P |
| 809.52 | 809.53 | −12.6 | 10.46 | C43H79O10P(Na)(H-1) |
| 809.52 | 809.52 | 3.3 | 10.46 | C41H77O13P |
| 809.52 | 809.53 | −15.5 | 10.46 | C45H77O10P |
| 809.57 | 809.57 | 3.2 | 7.78 | C44H83O9P(Na)(H-1) |
| 809.57 | 809.58 | −15.8 | 7.78 | C45H87O7P(K)(H-1) |
| 809.57 | 809.55 | 19.1 | 7.78 | C42H81O12P |
| 809.57 | 809.57 | 0.2 | 7.78 | C46H81O9P |
| 809.6 | 809.61 | −6.8 | 4.96 | C47H85O8P |
| 809.6 | 809.6 | −3.8 | 4.96 | C45H87O8P(Na)(H-1) |
| 810.57 | 810.58 | −11.7 | 4.21 | C44H86NO7P(K)(H-1) |
| 810.57 | 810.56 | 7.4 | 4.21 | C43H82NO9P(Na)(H-1) |
| 810.63 | 810.63 | −5.9 | 4.96 | C45H90NO7P(Na)(H-1) |
| 810.63 | 810.64 | −8.9 | 4.96 | C47H88NO7P |
| 830.55 | 830.55 | 5 | 5.55 | C46H82NO7P(K)(H-1) |
| 831.54 | 831.55 | −13.3 | 3.72 | C46H81O9P(Na)(H-1) |
| 831.54 | 831.54 | 5.1 | 3.72 | C42H81O12P(Na)(H-1) |
| 831.54 | 831.55 | −13.5 | 3.72 | C43H85O10P(K)(H-1) |
| 831.59 | 831.59 | 2.9 | 3.72 | C47H85O8P(Na)(H-1) |
| 831.59 | 831.59 | 2.7 | 3.72 | C44H89O9P(K)(H-1) |

TABLE 2-continued

Identified peaks from the analysis of cell lysate, corresponding glycerophospho lipids listed in the Lipid Maps database. The search was performed with a tolerance of 20 ppm. Each molecular formula presumably corresponds to multiple known isomers. The relative intensities are relative to that of the verapamil base peak at m/z 477.

| Meas. m/z | Calc. m/z | δ (ppm) | Rel. Int. (%) | Formula |
|---|---|---|---|---|
| 832.57 | 832.56 | 4.2 | 3.72 | C46H84NO7P(K)(H-1) |
| 836.65 | 836.65 | 0.5 | 4.85 | C47H92NO7P(Na)(H-1) |
| 859.53 | 859.53 | 0.3 | 6.06 | C43H81O13P(Na)(H-1) |
| 859.53 | 859.55 | −17.5 | 6.06 | C47H81O10P(Na)(H-1) |
| 859.53 | 859.53 | −2.5 | 6.06 | C45H79O13P |
| 859.58 | 859.57 | 16.1 | 7.44 | C44H85O12P(Na)(H-1) |
| 859.58 | 859.58 | −1.7 | 7.44 | C48H85O9P(Na)(H-1) |
| 859.58 | 859.58 | −1.9 | 7.44 | C45H89O10P(K)(H-1) |
| 859.62 | 859.62 | 1.8 | 6.15 | C46H93O9P(K)(H-1) |
| 860.69 | 860.71 | −19.8 | 3.72 | C49H98NO8P |
| 868.53 | 868.55 | −13.2 | 3.72 | C45H84NO10P(K)(H-1) |
| 868.53 | 868.53 | 11.2 | 3.72 | C48H80NO8P(K)(H-1) |
| 887.57 | 887.56 | 8.3 | 5.42 | C47H83O13P |
| 887.57 | 887.56 | 11 | 5.42 | C45H85O13P(Na)(H-1) |
| 887.57 | 887.58 | −6.1 | 5.42 | C49H85O10P(Na)(H-1) |
| 887.67 | 887.67 | −3.9 | 4.94 | C50H95O10P |
| 888.62 | 888.62 | −4.7 | 4.34 | C50H92NO7P(K)(H-1) |
| 915.63 | 915.63 | 4 | 9.18 | C49H97O8PS(K)(H-1) |
| 915.63 | 915.63 | 1.4 | 9.18 | C48H93O12P(Na)(H-1) |
| 915.63 | 915.65 | −15.4 | 9.18 | C49H97O10P(K)(H-1) |
| 916.69 | 916.68 | 15.5 | 6.06 | C52H96NO8P(Na)(H-1) |
| 917.66 | 917.65 | 16 | 3.72 | C48H95O12P(Na)(H-1) |
| 923.56 | 923.56 | −2.8 | 4.96 | C50H83O13P |
| 923.56 | 923.56 | −0.2 | 4.96 | C48H85O13P(Na)(H-1) |
| 923.62 | 923.61 | 5.6 | 6.08 | C50H93O10P(K)(H-1) |
| 923.62 | 923.6 | 19.7 | 6.08 | C51H87O12P |
| 923.65 | 923.65 | 6.2 | 4.96 | C47H98O11P2(Na)(H-1) |
| 923.65 | 923.66 | −5.3 | 4.96 | C49H95O13P |
| 924.59 | 924.59 | 2.5 | 6.15 | C52H88NO8P(K)(H-1) |
| 924.68 | 924.68 | −1.3 | 4.86 | C51H100NO8P(K)(H-1) |
| 924.68 | 924.67 | 15.4 | 4.86 | C50H96NO10P(Na)(H-1) |

The above-described devices for segmented flow provide a user-friendly delivery system for the generation of compartmentalized aqueous droplets. The system can be realized as a PDMS chip or assembled from commercially available fused silica capillaries. A substantial improvement in this device was the use of a volatile water-immiscible phase that avoided the need for removal of the oil phase from the microfluidics channel prior the ionization. The capillary microfluidic system offered advantages that facilitated the development of the interface, e.g., the fact that the individual parts were readily replaceable. Another advantage of this device relative to plastic microfluidics chips was the much more tolerant surface properties of fused silica compared to PDMS. These advantages enabled experimentation with a wide range of water-immiscible phases while avoiding surfactants to modify the surface tension in the aqueous droplets. The flow rates achieved with the capillary-based system (12 nL/s) were quite comparable to those used in microfluidic channels on standard chips.

A notable feature of the new microfluidic-mass spectrometry system was its robustness towards high salt content in buffers and blood plasma. This was presumably related to rapid droplet evaporation in the infrared laser beam that makes analyte ion desorption into the gas phase less sensitive to surface effects compared to ionization by electrospray. It was also notable that the interface was capable of handling a continuous stream of plugs of water and perfluorinated oil at very low flow rates. A comparable a solvent system would not be efficiently ionized by standard electrospray.

The TOF mass analyzer used covered the entire mass range, e.g., m/z 100-1000, and not only a few channels as in the selected or multiple reaction monitoring modes used on tandem quadrupole instruments for ultrasensitive detection. Thus, the present method allowed multiple analytes, including unknowns, to be detected in the mass spectrum, not just those in a priori known and preselected channels. Although the TOF mass analyzer was exemplified in this Example, other types of mass analyzers can be used as well. The sensitivity and detection limits can be enhanced by mating the interface with a mass spectrometer equipped with a more advanced ion optics, mass analyzer, and multichannel plate ion detector than those described in this Example.

Example 7

Operation in Electrospray Regime

This example demonstrates that the devices and methods of the present disclosure are compatible with electrospray ionization methods.

The mass spectrometer interface described in this Example is also compatible with an electrospray emitter (fused silica or metal) embedded in a microfluidics chip. In this arrangement two phases, an aqueous phase and a water-immiscible solvent phase were combined in the chip to form separated partitions. The device was operated at flow rates ranging from 10-100 μL/hr. The two partitions exited the chip at the tip of the embedded emitter capillary. The capillary was kept on a high DC voltage that exceeded the minimal value necessary for the evolution of a stable electrospray. The connection of a high voltage power supply could also have been achieved by a direct contact or by noncontact arrangement as well. When the aqueous plug (i.e., partition) exited the end of a capillary at the droplet emitter, a stable Taylor cone was formed and the droplets were introduced into the gas phase. The newly created plume was introduced into the inlet capillary of the mass spectrometer by a pressure difference and the ions were subsequently formed by the standard electrospray mechanism. When the oil plug (i.e., water-immiscible phase surrounding the aqueous partition) exited the tip of the droplet emitter, no Taylor cone was formed and the liquid dropped from the tip of the needle. Because the permittivity of the oil was not sufficient to allow formation of charged droplets, the oil phase was separated from the chip and did not enter the mass spectrometer. This resulted in separation of mass spectra for each individual aqueous compartment and thus in preservation of compartmentalization of the analytical information.

The description of embodiments of the disclosure is not intended to be exhaustive or to limit the disclosure to the precise form disclosed. While the specific embodiments of, and examples for, the disclosure are described herein for illustrative purposes, various equivalent modifications are possible within the scope of the disclosure, as those skilled in the relevant art will recognize.

Specific elements of any foregoing embodiments can be combined or substituted for elements in other embodiments. Furthermore, while advantages associated with certain embodiments of the disclosure have been described in the context of these embodiments, other embodiments may also exhibit such advantages, and not all embodiments need necessarily exhibit such advantages to fall within the scope of the disclosure.

ADDITIONAL ASPECTS

In some aspects, the disclosure provides a device capable of generating double emulsions in the gas phase comprising:

a first fluidic channel, having a proximal end and a distal end, in fluidic communication with an aqueous sample and in electrical communication with an electrode; a second fluidic channel, having a proximal end and a distal end, in fluidic communication with an oil that is immiscible with the aqueous sample, wherein the second fluidic channel connects with the first fluidic channel in between the proximal and distal end; an emitter in fluidic communication with the distal end of the first fluidic channel in electrical communication with an electrode; a ground electrode comprising a hole configured to allow the passage of double emulsions emitted from the emitter; and a voltage source in electrical communication with the electrodes, wherein the voltage source is sufficient to produce double emulsions.

In some aspects, the fluidic channels are made of PDMS. In some aspects, the fluidic channels are made of fused silica capillaries. In some aspects, the emitter is a three-dimensional, conical emitter. In some aspects, the emitter is silanized. In some aspects, the electrode in electrical communication with the first fluidic channel is a positive electrode and the electrode in electrical communication with the emitter is a negative electrode. In some aspects, the electrode in electrical communication with the first fluidic channel is a negative electrode and the electrode in electrical communication with the emitter is a positive electrode. In some aspects, the oil is immiscible with aqueous solutions and has a high vapor pressure. In some aspects, the oil has a boiling point of lower than 150° C. and/or a vapor pressure higher than 5 Torr at room temperature. In some aspects, the oil is perfluorinated. In some aspects, the perfluorinated oil is perfluorohexane perfluorodecalin, or any perfluorinated hydrocarbon, ester or ether. In some aspects, the device further comprises a pump in fluidic communication with at least one of the aqueous sample or the oil. In some aspects, the aqueous samples comprises an analyte. In some aspects, the analyte can be a small molecule, a nucleotide, a peptide, a protein, a lipid, a carbohydrate, a metabolite, a drug, an antibody, a cell, a cell lysate, a virus, a bacteria, and a polymer.

In some aspects, the disclosure provides an interface for coupling a microfluidic droplet source to a mass spectrometer comprising: an outer surface providing a substantially enclosed inner space; a capillary inlet configured to allow the passage of droplets into the substantially enclosed inner space; a port transparent to laser light disposed on the outer surface; a laser configured to pass light through the port into the substantially enclosed inner space; a tube lens, disposed within the substantially enclosed inner space, coated with a substance that reflects light comprising: a main axis; a plurality of connected sides parallel to the main axis; and an optical lens or mirror at angle other than parallel to the main axis, wherein the tube lens is configured to reflect the laser light off of the lens or mirror and through the tube lens bouncing a plurality of times off of the plurality of sides of the tube lens; a voltage source connected to the capillary; a voltage source connected to the tube lens; a vacuum port in the outer surface configured to connect to a vacuum source; and an aperture in the outer surface configured to allow the passage of droplets through the capillary inlet and tube lens.

In some aspects, the laser emits infrared light. In some aspects, the capillary inlet is between 0.1 to 5 milllimeter in diameter. In some aspects, the capillary inlet is between 0.25 and 2 milllimeter in diameter. In some aspects, the laser is sufficiently strong to evaporate aqueous droplets and double emulsions in the gas phase. In some aspects, the port is comprised of a material selected from ZnSe, $BaF_2$, KBr, CsI, KCl, CdTe, $CaF_2$, GaAs, NaCl, Ge, LiF, $SiO_2$, TlBr, ZnS, $Ge_{33}As_{12}Se_5$, or a combination thereof. In some aspects, the tube lens is coated with Au, Ag, or a dielectric mirror material.

In some aspects, the disclosure provides an analytical system comprising the device capable of generating double emulsions in air described above and the interface for coupling a microfluidic droplet source to a mass spectrometer described above, wherein the emitter and capillary inlet are configured to allow the passage of double emulsions.

In some aspects, the interface for coupling a microfluidic droplet source to a mass spectrometer further comprises a vacuum region abutting the aperture in the outer surface; an ionization source configured to ionize the evaporated double emulsions; and a mass spectrometer configured to accept the evaporated, ionized double emulsions.

In some aspects, the mass spectrometer is a time-of-flight mass spectrometer, a quadrupole mass spectrometer, an ion trap mass spectrometer, a linear ion trap mass spectrometer, an orbitrap mass spectrometer, a magnetic sector mass spectrometer, or an ion cyclotron resonance mass spectrometer.

In some aspects, the disclosure provides an interface for coupling a microfluidic droplet source to a mass spectrometer comprising: an outer surface providing a substantially enclosed inner space; a capillary inlet configured to allow the passage of droplets into the substantially enclosed inner space; a voltage source connected to the capillary; a vacuum port in the outer surface configured to connect to a vacuum source; and an aperture in the outer surface configured to allow the passage of droplets through the capillary inlet.

What is claimed is:

1. A method for producing a double emulsion, the method comprising:

generating an electric field between a first electrode and a second electrode, wherein the first electrode is in electrical communication with a first fluid and wherein the second electrode is contacted with a gas;

flowing a discrete partition comprising a first liquid surrounded at least in part by a second liquid through a droplet emitter, the droplet emitter comprising a proximal end and a distal end, wherein the proximal end receives the first fluid and the distal end is contacted with the gas; and producing a droplet from the distal end of the droplet emitter, wherein the droplet is contacted with the gas, and wherein the droplet and the gas together comprise a double emulsion.

2. The method of claim 1, wherein the first liquid comprises an analyte.

3. The method of claim 2, wherein the analyte is selected from a small molecule, a polynucleotide, a polypeptide, a lipid, a carbohydrate, a metabolite, a drug, a cell, a cell lysate, a virus, a polymer or a combination thereof.

4. The method of claim 2, wherein the analyte comprises a nucleic acid.

5. The method of claim 1, wherein the second liquid comprises an oil.

6. The method of claim 1, wherein the second liquid comprises a liquid selected from a hydrocarbon-based liquid, a fluorocarbon-based liquid, a silicone-based liquid or a combination thereof.

7. The method of claim 1, wherein the second liquid comprises a liquid selected from a mineral oil, a vegetable oil, a silicone oil, a fluorinated oil, a fluorinated alcohol, a perfluorinated ester, a perfluorinated ether or a combination thereof.

8. The method of claim 1, wherein one or both of the first liquid or the second liquid comprises a surfactant.

9. The method of claim 1, further comprising a plurality of inner droplets comprising the first liquid, wherein the plurality of inner droplets is positioned within an outer droplet comprising the second liquid.

10. The method of claim 9, wherein the diameter of the at least one inner droplet is between 5 microns and 1000 microns.

11. The method of claim 1, wherein the first liquid is aqueous.

12. The method of claim 1, wherein the droplet is nano-liter-sized.

13. The method of claim 1, further comprising producing a plurality of droplets from the distal end of the droplet emitter.

14. The method of claim 1, further comprising collecting the droplets in a container.

15. The method of claim 14, wherein the container includes oil therein.

* * * * *